United States Patent [19]

Abe et al.

[11] Patent Number: 4,873,179

[45] Date of Patent: Oct. 10, 1989

[54] METHOD FOR PROCESSING A SILVER HALIDE COLOR PHOTOGRAPHIC MATERIAL WHILE REPLENISHING WASHING WATER AND STABILIZING SOLUTION

[75] Inventors: Akira Abe; Keiji Mihayashi; Seiji Ichijima, all of Kanagawa, Japan

[73] Assignee: Fuji Photo Film Co., Ltd., Kanagawa, Japan

[21] Appl. No.: 52,086

[22] Filed: May 20, 1987

[30] Foreign Application Priority Data

May 20, 1986 [JP] Japan ..... 61-115792

[51] Int. Cl.[4] ..... G03C 7/16; G03C 7/40; G03C 7/32; G03C 11/00

[52] U.S. Cl. ..... 430/382; 430/372; 430/376; 430/384; 430/385; 430/386; 430/387; 430/389; 430/463; 430/542; 430/544; 430/564; 430/566; 430/607; 430/955; 430/957

[58] Field of Search ..... 430/544, 542, 955, 957, 430/566, 564, 607, 463, 398, 372, 376, 384–389, 382

[56] References Cited

U.S. PATENT DOCUMENTS

| | | | |
|---|---|---|---|
| 4,248,962 | 2/1981 | Lau | 430/385 |
| 4,336,324 | 6/1982 | Koboshi et al. | 430/463 |
| 4,409,323 | 11/1983 | Sato et al. | 430/543 |
| 4,438,193 | 3/1984 | Uemura et al. | 430/505 |
| 4,477,563 | 10/1984 | Ichijima et al. | 430/557 X |
| 4,567,134 | 1/1986 | Koboshi et al. | 430/553 |
| 4,618,571 | 10/1986 | Ichijima et al. | 430/505 |
| 4,652,516 | 3/1987 | Ichijima et al. | 430/564 X |

FOREIGN PATENT DOCUMENTS 0147016 7/1985 European Pat. Off. .

*Primary Examiner*—Mukund J. Shah

*Attorney, Agent, or Firm*—Sughrue, Mion, Zinn, Macpeak & Seas

[57] ABSTRACT

A method for processing a silver halide color photographic material which comprises, after color development of a silver halide color photographic material comprising a support having thereon at least one light-sensitive silver halide emulsion layer and at least one compound capable of releasing, upon a reaction with an oxidation product of a developing agent, a compound which is capable of releasing a development inhibitor upon a reaction with another molecule of an oxidation product of a developing agent, treating said photographic material with a liquid having a fixing ability, followed by processing thereof while replenishing washing water or a stabilizing solution in an amount of from 2 to 50 times the amount carried over from the preceding bath per unit area of the silver halide color photographic material.

In accordance to the method of the present invention the color photographic materials processed are resistant to fading of dyes formed, growth of molds, and formation of stain, even when the amount of washing water or a stabilizing solution is reduced.

52 Claims, No Drawings

METHOD FOR PROCESSING A SILVER HALIDE COLOR PHOTOGRAPHIC MATERIAL WHILE REPLENISHING WASHING WATER AND STABILIZING SOLUTION

FIELD OF THE INVENTION

The present invention relates to a method for processing a silver halide color photographic material (hereinafter referred to as a color light-sensitive material), and more particularly to an improved method for processing a silver halide color photographic material, which method resists the occurrence of molds, formation of stain, and color fading in color light-sensitive materials after processing, even when the amount of water used in a water washing step is reduced.

BACKGROUND OF THE INVENTION

Several approaches have been suggested for the purpose of reducing the amount of water used, such as an amount of washing water, etc., in processing steps in view of environmental conservation, water resources or cost. For example, in S. R. Goldwasser, "Water Flow Rates in Immersion-Washing of Motion Picture Film" in *Journal of the Society of Motion Picture and Television Engineers,* No. 64, pages 248 to 253 (May, 1955), a method for reducing the amount of washing water by means of utilizing multi-stage water washing tanks and countercurrent water is proposed. Further, a system for saving water wherein color photographic materials are subjected to a stabilizing step substantially without a water washing step after a bleach-fixing step is disclosed in U.S. Pat. No. 4,336,324. These methods are effective for saving water, and have been applied to various types of automatic processing machines.

However, reduction of the amount of washing water leads to an increase in an amount of various kinds of processing solution components remaining in color light-sensitive materials after processing. Some parts of these remaining processing solution components act as nutritive elements, and, as a result, a new problem occurrs, in that photographic materials thus-processed are highly likely to become moldy during preservation. Further, the increase in the amount of remaining components cause other problems. More specifically, they react with unreacted coupler remaining in the photographic materials to form stain, or they react with image-forming dyes to accelerate fading of the dyes.

Of the above described problems, the growth of mold is also troublesome even in conventional cases wherein the amount of washing water is not reduced. Therefore, many methods have been proposed for preventing the growth of mold. For instance, it has been described that pentachlorophenol is effective as an antimold to be added to a stabilizing bath after a conventional water washing step in *Phot. Sci. Eng.,* Vol. 3, page 132 (1959). However, this compound is extremely poisonous and can not be practicably utilized. Further, in Japanese Patent Application (OPI) No. 135942/85 (the term "OPI" as used herein means a "published unexamined published application"), the effectiveness of ammonium ion releasing compounds as antimolds is described particularly for processing methods in which the amount of washing water is reduced. However, the mold inhibiting function of these compounds is not completely sufficient, and, in addition, they have a problem in that they accelerate fading of dyes in color photographic materials depending on types of dyes employed.

On the other hand, with respect to the prevention from stain, methods using a stabilizing solution containing a water-soluble chelate compound of barium, calcium, cerium, etc., as described in Japanese Patent Application (OPI) No. 184343/84, a water-soluble compound of magnesium, aluminum, strontium, etc., as described in Japanese Patent Application (OPI) No. 185336/84, or a water-soluble metal salt of barium, magnesium, calcium, aluminium, etc., and a hydrogen ion releasing compound as described in Japanese Patent Application (OPI) No. 239751/85.

However, the effects of these methods are still not fully satisfactory. In particular, their effects on color light-sensitive materials for photographing are very poor. Moreover, when these methods are applied to color light-sensitive materials for photography, a problem also occurrs in that fading of image forming dyes is accelerated. Accordingly, a processing method which does not cause such problems even when the amount of washing water or stabilizing solution is reduced has been strongly desired.

SUMMARY OF THE INVENTION

Therefore, an object of the present invention is to provide a method for processing a color light-sensitive material, upon which the amount of washing water or a stabilizing solution used can be reduced.

Another object of the present invention is to provide a method for processing a color light-sensitive material, which method does not accelerate fading of dyes formed, even when the amount of washing water or a stabilizing solution used therein is reduced in a wide range.

A further object of the present invention is to provide a method for processing a color light-sensitive material, the color photographic material processed, by which method the growth of mold is prevented, even when the amount of washing water or a stabilizing solution used therein is reduced.

A still further object of the present invention is to provide a method for processing a color light-sensitive material, the color photographic material processed by which method is prevented from the formation of stain, even when the amount of washing water or a stabilizing solution is reduced.

Other objects of the present invention will become apparent from the following detailed description and examples.

These objects of the present invention can be attained by a method for processing a silver halide color photographic material which comprises, after color development of a silver halide color photographic material comprising a support having thereon at least one light-sensitive silver halide emulsion layer and at least one compound capable of releasing, after reaction with an oxidation product of a developing agent, a development inhibitor upon a reaction with another molecule of an oxidation product of a developing agent, treating said photographic material with a liquid having a fixing ability, and thereafter washing or stabilizing said photographic material while replenishing the washing water and stabilizing solution, respectively, each in amount of from 2 to 50 times the amount carried over from the preceding bath per unit area of the silver halide color photographic material.

DETAILED DESCRIPTION OF THE INVENTION

The compound capable of releasing upon a reaction with an oxidation product of a developing agent a compound which is capable of releasing a development inhibitor upon a reaction with another molecule of an oxidation product of a developing agent used in the present invention can be represented by formula (I):

$$A—PDI \quad (I)$$

wherein A represents a group capable of releasing PDI upon reaction with an oxidation product of a developing agent; and PDI represents a group which forms a development inhibitor through a reaction with an oxidation product of a developing agent after being released from A.

Compounds represented by formula (I) are described in more detail below.

Of the compounds represented by formula (I) according to the present invention, preferred compounds are represented by formula (II)

$$A—(L_1)_v—B—(L_2)_w—DI \quad (II)$$

wherein A represents a group capable of releasing $(L_1)_v$—B—$(L_2)_w$—DI upon a reaction with an oxidation product of a developing agent; $L_1$ represents a group capable of releasing B—$(L_2)_w$—DI after being released from A; B represents a group capable of releasing $(L_2)_w$—DI upon reaction with an oxidation product of a developing agent after being released from A—$(L_1)_v$; $L_2$ represents a group capable of releasing DI after being released from B; DI represents a development inhibitor: and V and w each represents 0 or 1.

The reaction process upon which the compound represented by formula (II) releases DI at the time of development can be represented by the schematic reaction sequence $$A—(L_1)_v—B—(L_2)_w—DI \xrightarrow{T^{\oplus}} (L_1)_v—B—(L_2)_w—DI \longrightarrow$$

$$B—(L_2)_w—DI \xrightarrow{T^{\oplus}} (L_2)_w—DI \longrightarrow DI$$

wherein A, $L_1$, B, $L_2$, DI, v, and w each has the same meaning as defined for formula (II) above; and $T^{\oplus}$ represents an oxidation product of a developing agent.

In the above described reaction formulae, the excellent effect according to the present invention is characterized by the reaction of forming $(L_2)_w$—DI from B—$(L_2)_w$—DI. Specifically, this reaction is a second order reaction between $T^{\oplus}$ and B—$(L_2)_w$—DI and the rate of reaction depends on a concentration of each reactant. Therefore, B—$(L_2)_w$—DI immediately releases $(L_2)_w$—DI in a region where $T^{\oplus}$'s generate in a large amount. On contrast therewith, in a region where $T^{\oplus}$'s generate only in a small amount, B—$(L_2)_w$—DI releases slowly $(L_2)_w$—DI. Such a reaction process coupled with the above described reaction processes reveals effectively the function of DI.

The compound represented by formula (II) is described in greater detail below.

In formula (II), A preferably represents a coupler residual group or an oxidation reduction group.

When A represents a coupler residual group, any known coupler residual group can be utilized. Suitable examples thereof include a yellow coupler residual group (for example, an open-chain ketomethylene type, etc.), a magenta coupler residual group (for example, a 5-pyrazolone type, a pyrazoloimidazole type, a pyrazolotriazole type, a pyrazoloimidazole type, a pyrazolotriazole type, etc.), a cyan coupler residual group (for example, a phenol type, a naphthol type, etc.), and a non-color forming coupler residual group (for example, an indanone type, an acetophenone type, etc.), etc. Further, coupler residual group as described in U.S. Pat. Nos. 4,315,070, 4,183,752, 4,171,223, 4,226,934, etc., are also useful.

When A represents an oxidation reduction group, the group is specifically represented by formula (III)

$$A_1—P—(X=Y)_n—Q—A_2 \quad (III)$$

wherein P and Q each represents an oxygen atom or a substituted or unsubstituted imino group; at least one of the X and Y groups represents a methine group having a group —$(L_1)_v$—B$(L_2)_w$—DI as a substituent, and other X and Y groups each represents a substituted or unsubstituted methine group or a nitrogen atom; n represents an integer from 1 to 3 (wherein the X and Y groups may be the same or different); $A_1$ and $A_2$ each represents a hydrogen atom or a group capable of being eliminated with an alkali; or any two substituents of P, X, Y, Q, $A_1$ and $A_2$ represent divalent groups and connected together to form a cyclic structure.

Examples of the cyclic structure include a benzene ring, a pyridine ring, formed by $(X=Y)_n$.

In formula (II), the groups represented by $L_1$ and $L_2$ may or may not be present, depending on the purpose. Preferred examples of the groups represented by $L_1$ and $L_2$ include known linking groups described below. (1) A group utilizing a cleavage reaction of hemiacetal.

Examples of these groups include those as described, for example, in U.S. Pat. No. 4,146,396, Japanese Patent Application (OPI) Nos. 249148/85 and 249149/85, etc., and are represented by the following general formula (T-1):

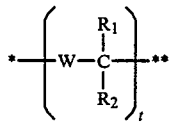

(T-1)

wherein the bond indicated by * denotes the position at which the group is connected to the left side group in formula (II); a bond indicated by ** denotes the position at which the group is connected to the right side group in the general formula (II); W represents an oxygen atom a sulfur atom or a group of

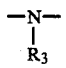

(wherein $R_3$ represents an organic substituent); $R_1$ and $R_2$ each represents a hydrogen atom, an alkyl group, an aryl group, a heterocyclic group, an acyl group, or a sulfonyl group; t represents 1 or 2, and when t represents 2, the two R groups and two R groups may be the same or different; or any two or R, R, and R together form a cyclic structure.

Specific examples of the groups represented by formula (T-1) are set forth below.

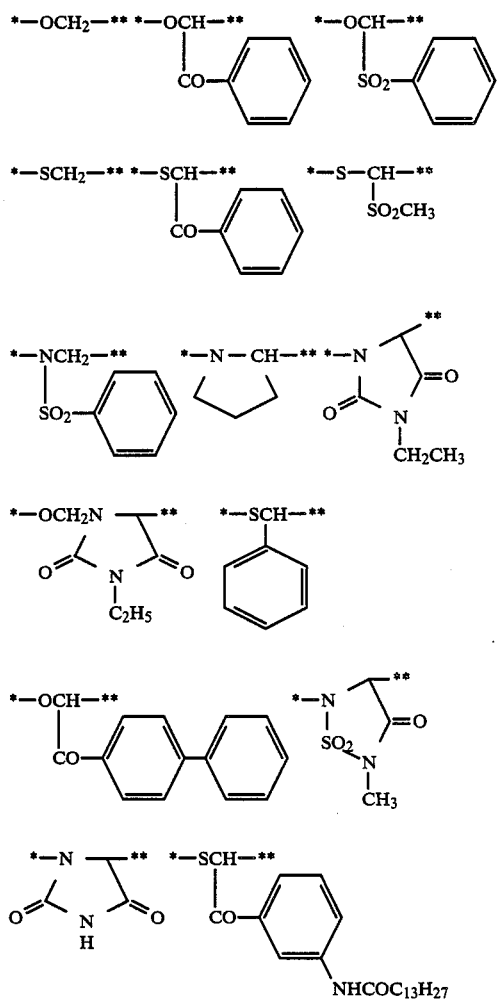

(2) A group causing a cleavage reaction utilizing an intermolecular nucleophilic displacement reaction.

Examples of these groups include the timing groups as described in U.S. Pat. No. 4,248,962, etc., and are represented by the following general formula (T-2):

*—Nu—Link—E—** (T-2)

wherein the bond indicated by * denotes the position at which the group is connected to the left side group in formula (II); the bond indicated by  denotes the position at which the group is connected to the right side group in formula (II); Nu represents a nucleophilic group (such as an oxygen atom, a sulfur atom, etc.); E represents an electrophilic group which is able to cleave the bond indicated by  upon a nucleophilic attack of Nu; and Link represents a linking group which connectes Nu with E in a stereochemical position capable of causing an intramolecular nucleophilic displacement reaction between Nu and E.

Specific examples of the groups represented by formula (T-2) are set forth below.

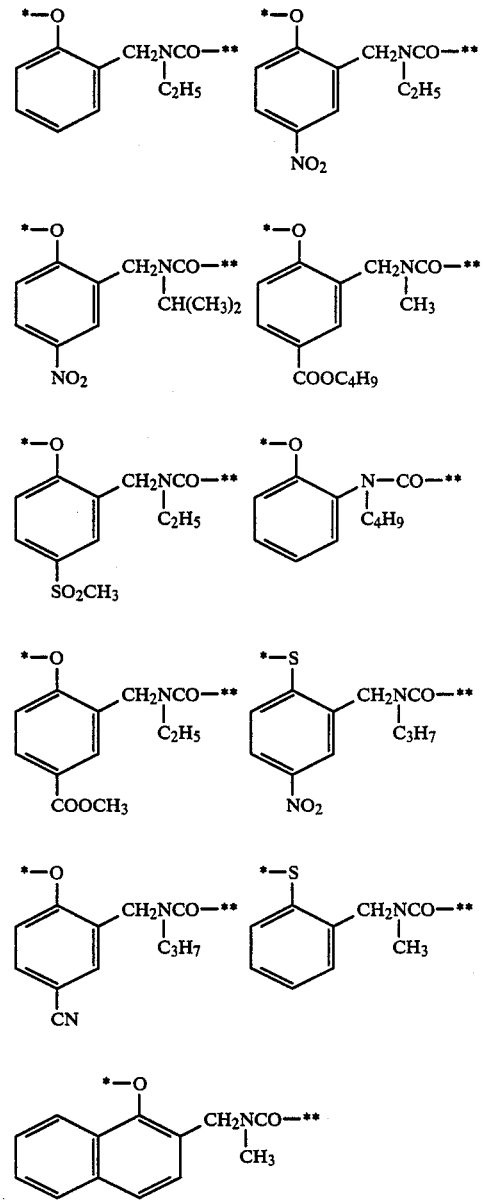

(3) A group causing a cleavage reaction utilizing an electron transfer reaction via a conjugated system.

Examples of these groups include those as described in U.S. Pat. Nos. 4,409,323 and 4,421,845, and are represented by formula (T-3)

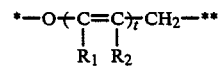

(T-3)

wherein the bond indicated by *, the bond indicated by **, $R_1$, $R_2$, and t each has the same meaning as defined for formula (T-1) above.

Specific examples of the groups represented by formula (T-3) are set forth below.

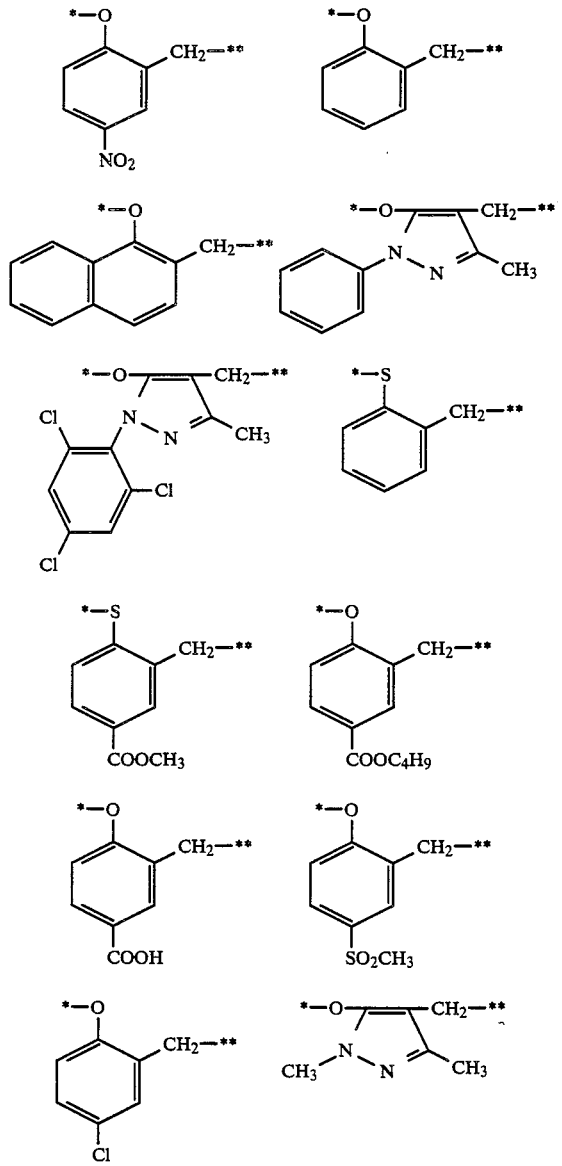

(4) A group utilizing a cleavage reaction of an ester upon hydrolysis.

Examples of these groups include those as described in West German Patent Application (OLS) No. 2,626,315, etc., and are each specifically represented by

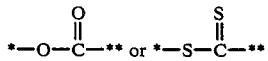

wherein the bond indicated by * and the bond indicated by ** each has the same meaning as defined for formula (T-1) above.

In formula (II), the group represented by B is preferably a group capable of forming a coupler after being released from A—$(L_1)_v$ or a group capable of forming an oxidation reduction group after being released from A—$(L_1)_v$. Examples of the group forming a coupler include a group which is formed by eliminating a hydrogen atom from a hydroxy group of a phenol type coupler and is connected to A—$(L_1)_v$ at the oxygen atom of the hydroxy group, and a group which is formed by eliminating a hydrogen atom from a hydroxy group of a 5-hydroxypyrazole which is a tautomer of a 5-pyrazolone type coupler and is connected to A—$(L_1)_v$ at the oxygen atom of the hydroxy group. In these cases, the group forms a phenol type coupler or a 5-pyrazolone type coupler for the first time after being released from A—$(L_1)_v$. These couplers have $(L_2)_w$—DI at their coupling position.

When B represents a group capable of forming an oxidation reduction group, B is preferably represented by formula (B-1)

$$*\text{—P—}(X'=Y')_n\text{—Q—}A_2 \qquad \text{(B-1)}$$

wherein the bond indicated by * denotes the position at which the group is connected to A—$(L_1)_v$; $A_2$, P, Q and n each has the same meaning as defined for formula (III); at least one of the X' and Y' groups represents a methine group having a group of $(L_2)_w$—DI as a substituent, and the other X' and Y' groups each represents a substituted or unsubstituted methine group or a nitrogen atom; or any two substituents of A, P, Q, X' and Y' represent divalent groups connected together to form a cyclic structure.

In formula (II), the group represented by DI specifically includes a tetrazolylthio group, a benzimidazolylthio group, a benzothiazolylthio group, a benzoxazolylthio group, a benzotriazolyl group, a benzindazolyl group, a triazolylthio group, an imidazolylthio group, a thiadiazolylthio group, a thioether-substituted triazolyl group (for example, the development inhibitors as described in U.S. Pat. No. 4,579,816, etc.), and an oxadiazolyl group, etc., and these groups may have one or more substituents.

Representative examples of such substituents include a halogen atom, an aliphatic group, a nitro group, an acylamino group, an aliphatic hydroxycarbonyl group, an aromatic hydroxycarbonyl group, an imido group, a sulfonamido group, an aliphatic hydroxyl group, an aromatic hydroxyl group, an amino group, an imino group, a cyano group, an aromatic group, an acyloxy group, a sulfonyloxy group, an aliphatic thio group, an aromatic thio group, an aromatic hydroxysulfonyl group, an aliphatic hydroxysulfonyl group, an aliphatic hydroxycarbonylamino group, an aromatic hydroxycarbonylamino group, an aliphatic hydroxycarbonyloxy group, a heterocyclic hydroxycarbonyl group, a heterocyclic hydroxyl group, a sulfonyl group, an acyl group, a ureido group, a heterocyclic group, a hydroxyl group, etc.

In formula (II), any two groups represented by A, $L_1$, B, $L_2$, and DI may have a bond in addition to the bond represented in formula (II) any may be connected with each other. In such cases, even when the second bond is not cleaved at the time of development, the effect of the present invention can be achieved. Examples of compounds including the such second bond are represented by the formula

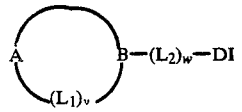

-continued

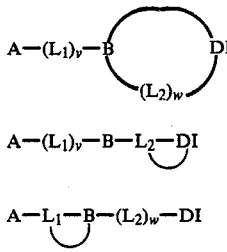

wherein A, $L_1$, B, $L_2$, DI, v and w each has the same meaning as defined for formula (II) above.

The compound represented by formula (II) used in the present invention includes the case that the compound is a polymer. That is, the compound may be a polymer derived from a monomer compound represented by formula (P-1) described below and having a recurring unit represented by formula (P-2) described below, or may be a copolymer of the above described monomer compound and at least one non-color forming monomer containing at least one ethylene group which does not have an ability of coupling with an oxidation product of an aromatic primary amine developing agent. In this case, two or more kinds of the monomer compounds may be simultaneously polymerized.

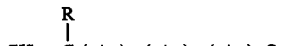

(P-1)

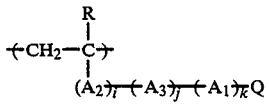

(P-2)

In formulae (P-1) and (P-2), R represents a hydrogen atom, a lower alkyl group having from 1 to 4 carbon atoms or a chlorine atom; $A_1$ represents —CONH—, —NHCONH—, NHCOO—, —COO—, —$SO_2$—, —CO—, —NHCO—, —$SO_2$NH—, —NH$SO_2$—, —OCO—, —OCONH—, —S—, —NH— or —O—; $A_2$ represents —CONH— or —COO—; $A_3$ represents a substituted or unsubstituted alkylene group having from 1 to 10 carbon atoms, a substituted or unsubstituted aralkylene group, or a substituted or unsubstituted arylene group.

The alkylene group may be a straight chain or branched chain alkylene group. Examples of the alkylene group include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group include a benzylidene group, etc. Examples of the arylene group include a phenylene group, a naphthylene group, etc.

Q in the above described formulae represents a residue of the compound represented by formula (II) and may be bonded through any moiety of A, $L_1$, B, or $L_2$ in formula (II).

Further, i, j, and k each represents 0 or 1, excluding the case where i, j, and k are simultaneously 0.

Examples of the substituent(s) for the alkylene group, aralkylene group, or arylene group represented by $A_3$ include an aryl group (e.g., a phenyl group, etc.), a nitro group, a hydroxyl group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., a fluorine atom, a chlorine atom, a bromine atom, etc.), a carbosyl group, a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), etc. When the group represents by $A_3$ has two or more substituents, they may be the same or different.

Examples of the non-color forming ethylenic monomer which does not cause coupling with the oxidation product of an aromatic primary amine developing agent include an acrylic acid such as acrylic acid, α-chloroacrylic acid, α-alkylacrylic acid, etc., an ester or amide derived from an acrylic acid, methylenebisacrylamide, a vinyl ester, an acrylonitrile, an aromatic vinyl compound, a maleic acid derivative, a vinylpyridine, etc. Two or more of such non-color forming ethylenically unsaturated monomers can be used together.

Of the compounds according to the present invention, preferred compounds are explained in detail below.

In the case wherein A represents a coupler residual group in formula (I) or (II), preferred coupler residual groups include those represented by the formula (Cp-1), (Cp-2), (Cp-3), (Cp-4), (Cp-5), (Cp-6), (Cp-7), (Cp-8), and (Cp-9) described below. These coupler residual groups are preferred because of their high coupling rates.

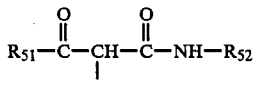

(Cp-1)

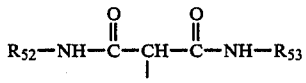

(Cp-2)

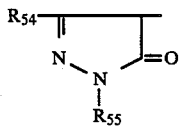

(Cp-3)

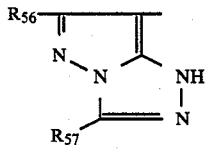

(Cp-4)

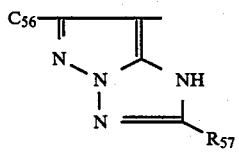

(Cp-5)

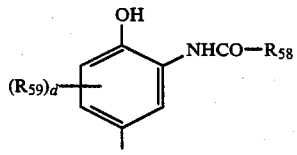

(Cp-6)

-continued (Cp-7)

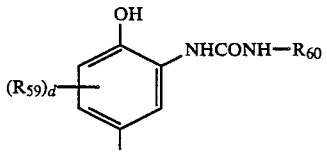

(Cp-8)

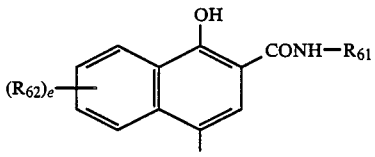

(Cp-9)

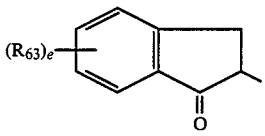

In the above-described formulae, a free bond attached to the coupling position indicates a position to which a group of —PDI in the formula (I) or —$(L_1)_v$—B—$(L_2)_w$—DI in the formula (II) is bonded. When $R_{51}$, $R_{52}$, $R_{53}$, $R_{54}$, $R_{55}$, $R_{56}$, $R_{57}$, $R_{58}$, $R_{59}$, $R_{69}$, $R_{61}$, $R_{62}$, or $R_{63}$ in the above-described formulae contains a diffusion-resistant group, it is selected so that the total number of carbon atoms included therein is preferably from 8 to 40, and more preferably from 10 to 30. In other cases, the total number of carbon atoms included therein is preferably not more than 15. In cases of bis type, telomer type, or polymer type couplers, any of the above-described substituents forms a divalent group and may connect to a repeating unit. In such cases, the total number of carbon atoms can be outside of the above-described range.

$R_{51}$ to $R_{63}$, d and e in the above-described formulae (Dp-1) to (Cp-9) are explained in detail. In the following, $R_{41}$ represents an aliphatic group, an aromatic group, or a heterocyclic group; $R_{42}$ represents an aromatic group or a heterocyclic group; and $R_{43}$, $R_{44}$, and $R_{45}$ each represents a hydrogen atom, an aliphatic group, an aromatic group or a heterocyclic group.

$R_{51}$ represents a group as defined for $R_{41}$.

$R_{52}$ and $R_{53}$ each represents a group as defined for $R_{42}$.

$R_{54}$ represents a group as defined for $R_{41}$, $R_{41}$—CON($R_{43}$)—, $R_{41}$—N($R_{43}$)—, $R_{41}$—$SO_2$N($R_{43}$)—, $R_{41}$—S—, $R_{43}$—O—, $R_{45}$—N($R_{43}$)CON($R_{44}$)—, $R_{41}$—OOC—, $R_{44}$—N($R_{43}$)CO—, or N≡C—.

$R_{55}$ represents a group as defined for $R_{41}$.

$R_{56}$ and $R_{57}$ each represents a group as defined for $R_{43}$, $R_{41}$—S—, $R_{43}$—O—, $R_{41}$—CON($R_{43}$)—, $R_{41}$—N($R_{43}$)—, $R_{43}$—N($R_{44}$)CON($R_{45}$)—. or $R_{41}$—$SO_2$N($R_{43}$)—.

$R_{58}$ represents a group as defined for $R_{41}$.

$R_{59}$ represents a group as defined for $R_{41}$, $R_{41}$—CON($R_{43}$)—, $R_{41}$—OCON($R_{43}$)—, $R_{41}$—$SO_2$N($R_{43}$)—, $R_{43}$—N($R_{44}$)CON($R_{45}$)—, $R_{43}$—N($R_{44}$)$SO_2$N($R_{45}$)—, $R_{41}$—O—, $R_{41}$—S—, a halogen atom, or $R_{41}$—N($R_{43}$)—.

d represents an integer from 0 to 3. When d represents 2 or more, the two or more $R_{59}$ groups are the same or different. Further, each of two $R_{59}$'s may be a divalent group connected together to form a cyclic structure.

Examples of the divalent groups for forming a cyclic structure include

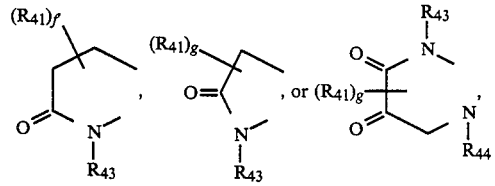

wherein f represents an integer from 0 to 4; and g represents an integer from 0 to 2.

$R_{60}$ represents a group as defined for $R_{41}$.

$R_{61}$ represents a group as defined for $R_{41}$.

$R_{62}$ represents a group as defined for $R_{41}$, $R_{41}$—CONH—, $R_{41}$—OCONH—, $R_{41}$—$SO_2$HN—, $R_{43}$—N($R_{44}$)CON($R_{45}$)—, $R_{43}$—N($R_{44}$)$SO_2$N($R_{45}$)—, $R_{43}$—O—, $R_{41}$—S—, a halogen atom, or $R_{41}$—N($R_{43}$)—.

$R_{63}$ represents a group as defined for $R_{41}$, $R_{43}$—CON($R_{44}$)—, $R_{43}$—N($R_{44}$)CO—, $R_{41}$—$SO_2$N($R_{44}$)—, of $R_{43}$—N($R_{44}$)$SO_2$—, $R_{41}$—$SO_2$—, $R_{43}$—OCO—, $R_{43}$—$OSO_2$—, a halogen atom, a nitro group, a cyano group, or $R_{43}$—CO—.

e represents an integer from 0 to 4. When e represents 2 or more, the $R_{62}$ or $R_{63}$ groups may be the same or different.

The aliphatic group described above is an aliphatic hydrocarbon group preferably having from 1 to 32 carbon atoms, more preferably from 1 to 22 carbon atoms and may be saturated or unsaturated, a straight-chain, branched chain or cyclic, or substituted or unsubstituted. Representative examples of the unsubstituted aliphatic group include a methyl group, an ethyl group, a propyl group, an isopropyl group, a butyl group, a tert-butyl group, an isobutyl group, a tert-amyl group, a hexyl group, a cyclohexyl group, a 2-ethylhexyl group, an octyl group, a 1,1,3,3-tetramethylbutyl group, and decyl group, a dodecyl group, a hexadecyl group, or an octadecyl group, etc.

The aromatic group described above is an aromatic group preferably having from 6 to 20 carbon atoms, and more preferably an unsubstituted or substituted phenyl group or an unsubstituted or substituted naphthyl group.

The heterocyclic group described above is a heterocyclic group preferably having from 1 to 20 carbon atoms, more preferably from 1 to 7 carbon atoms and containing at least one of a nitrogen atom, an oxygen atom and a sulfur atom, as a hetero atom, and preferably a three-membered to eight-membered, substituted or unsubstituted heterocyclic group. Representative examples of the unsubstituted heterocylic group include a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-5-yl group, a succinimido group, a phthalimido group, a 1,2,4-triazol-2-yl group, or a 1-pyrazolyl group, etc.

The aliphatic group, aromatic group, and heterocyclic group may have one or more substituent as described above. Representative examples of the substituents include a halogen atom,

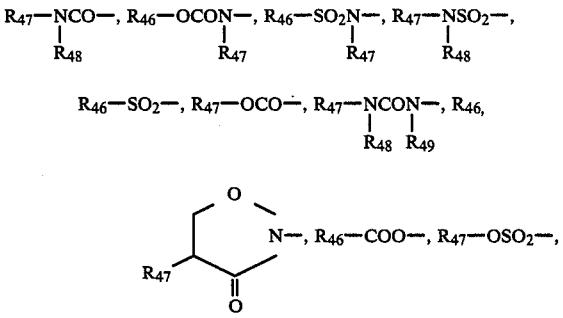

a cyano group, or a nitro group, etc. In the above described formulae, $R_{46}$ represents an aliphatic group, an aromatic group, or a heterocyclic group; and $R_{47}$, $R_{48}$ and $R_{49}$ each represents a hydrogen atom, an aliphatic group, an aromatic group or a heterocyclic group. The aliphatic group, aromatic group and heterocyclic group each has the same meaning as defined above.

Preferred embodiments with respect to $R_{51}$ to $R_{63}$, d, and e are described below.

$R_{51}$ is preferably an aliphatic group or an aromatic group.

$R_{52}$, $R_{53}$, and $R_{55}$ each is preferably an aromatic group.

$R_{54}$ is preferably $R_{41}$—CONH— or

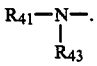

$R_{56}$ and $R_{57}$ each is preferably an aliphatic group, $R_{41}$—O—, or $R_{41}$—S—.

$R_{58}$ is preferably an aliphatic group or an aromatic group.

$R_{59}$ in formula (Cp-6) is preferably a chlorine arom, an aliphatic group, or $R_{41}$—CONH—.

d in formula (Cp-6) is preferably 1 to 2.

$R_{60}$ is preferably an aromatic group.

$R_{59}$ in formula (Cp-7) is preferably $R_{41}$—CONH—.

d in formula (Cp-7) is preferably 1.

$R_{61}$ is preferably an aliphatic group or an aromatic group.

e in formula (Cp-8) is preferably 0 or 1.

$R_{62}$ is preferably $R_{41}$ OCONH—, $R_{41}$ CONH— or $R_{41}$ $SO_2NH$—. The position of $R_{62}$ is preferably the 5-position of the naphthol ring.

e in formula (Cp-9) is preferably 1 or 2.

$R_{63}$ is preferably

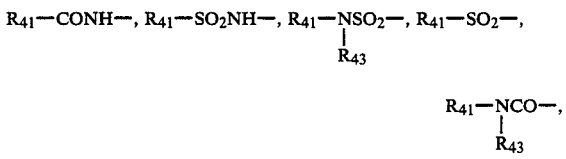

a nitro group, or a cyano group.

Representative examples of $R_{51}$ to $R_{63}$ are set forth below.

Examples of $R_{51}$ include a tert-butyl group, a 4-methoxyphenyl group, a phenyl group, a 3-[2-(2,4-di-tert-amylphenoxy)butanamidophenyl group, a 4-octadecyloxyphenyl group, a methyl group, etc.

Examples of $R_{52}$ and $R_{53}$ include a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-tert-amylphenoxy)butanamido]phenyl group, a 2-chloro-5-[2-(2,4-di-tert-amylphenoxy)butanamido]phenyl group, 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(1-dodecyloxy carbonylethoxycarbonyl)phenyl group, a 2-chlorophenyl group, a 2-ethoxyphenyl group, etc.

Examples of $R_{54}$ include a 3-[2-(2,4-di-tert-amylphenoxybutanamido]benzamido group, a 3-[4-(2,4-di-tert-amylphenoxy)butananido]benzamido group, a 2-chloro-5-tetradecanamidoanilino group, a 5-(2,4-di-tert-amylphenoxyacetamido)benzamido group, a 2-chloro-5-dodecenylsuccinimidoanilino group, a 2-chloro-5-[2-(3-tert-butyl-4-hydroxyphenoxy)tetradecanamido]anilino group, a 2,2-dimethylpropanimido group, a 2-(3-pentadecylphenoxy)-butanamido group, a pyrrolidino group, an N,N-dibutylamino group, etc.

Examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-tert-amylphenoxy)butanamido]phenyl group, a 2,6-dichloro-4-methanesulfonylphenyl group, etc.

Examples of $R_{56}$ include a methyl group, an ethyl group, an isopropyl group, a methoxy group, an ethoxy group, a methylthio group, an ethylthio group, a 3-phenylureido group, a 3-butylureido group, a 3-(2,4-di-tert-amylphenoxy)propyl group, etc.

Examples of $R_{57}$ include a 3-(2,4-di-tert-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)-phenylsulfonamido]phenylsulfonamido}ethyl group, a 3-[4-(4-dodecyloxyphenylsulfonamido)phenyl]propyl group, a 1,1-dimethyl-2-[2-octyloxy-5-(1,1,3,3-tetramethylbutyl)phenylsulfonamido]ethyl group, a dodecylthio group, etc.

Examples of $R_{58}$ include a 2-chlorophenyl group, a pentafluorophenyl group, a heptafluoropropyl group, a 1-(2,4-di-tert-amylphenoxy)propyl group, a 3-(2,4-di-tert-amylphenoxy)propyl group, a 2,4-di-tert-amylmethyl group, a furyl group, etc.

Examples of $R_{59}$ include a chlorine atom, a methyl group, an ethyl group, a propyl group, a butyl group, an isopropyl group, a 2-(2,4-di-tert-amylphenoxy)-butanamido group, a 2-(2,4-di-tert-amylphenoxy)hexanamido group, a 2-(2,4-di-tert-octylphenoxy)octanamido group, a 2-(2-chlorophenoxy)tetradecanamido group, a 2,2-dimethylpropanamido group, a 2-[4-(4-hydroxyphenylsulfonyl)phenoxy]tetradecanamido group, a 2-[2-(2,4-di-tert-amylphenoxyacetamido)phenoxy]butanamido group, etc.

Examples of $R_{60}$ include a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfomoylphenyl group, a 3,4-dichlorophenyl group, or a 3-methoxycarbonylphenyl group, etc.

Examples of $R_{61}$ include a dodecyl group, a hexadecyl group, a cyclohexyl group, a butyl group, a 3-(2,4-di-tert-amylphenoxy)propyl group, a 4-(2,4-di-tert-amylphenoxy)butyl group, a 3-dodecyloxypropyl group, a 2-tetradecyloxyphenyl group, a tert-butyl group, a 2-(2-hexadecyloxy)phenyl group, a 2-methoxy-5-dodecyloxycarbonylphenyl group, a 2-butoxyphenyl group, a 1-naphthyl group, etc.

Examples of $R_{62}$ include an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, an acetamido group, etc.

Examples of $R_{63}$ include a 2,4-di-tert-amylphenoxyacetamido group, a 2-(2,4-di-tert-amylphenoxy)-butanamido group, a hexadecylsulfonamido group, an N-methyl-N-octadecylsulfamoyl group, an N,N-dioctylsulfamoyl group, a dodecyloxycarbonyl group, a chlorine atom, a fluorine atom, a nitro group, a cyano group, an N-3-(2,4-di-tert-amylphenoxy)propylsulfamoyl group, a methanesulfonyl group, a hexadecylsulfonyl group, etc.

Preferred embodiments of the case wherein A in formula (II) represents a group of formula (III) are described below.

When P and Q each represents a substituted or unsubstituted imino group, an imino group substituted with a sulfonyl group or an acyl group is preferred. In such a case, P or Q is represented by formula (N-1) or (N-2)

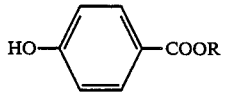

(PHB)

wherein the bond indicated by * denotes the position at which the group is connected to $A_1$ or $A_2$; the bond indicated by ** denotes the position at which the group is connected to one of the free bonds of $-(X{=}Y)_n-$; and G represents an aliphatic group containing from 1 to 32 carbon atoms, preferably from 1 to 22 carbon atoms, which may be a straight chain, branched chain or cyclic, saturated or unsaturated, or substituted or unsubstituted (for example, a methyl group, an ethyl group, a benzyl group, a phenoxybutyl group, an isopropyl group, etc.), a substituted or unsubstituted aromatic group containing from 6 to 10 carbon atoms (for example, a phenyl group, a 4-methylphenyl group, a 1-naphthyl group, a 4-dodecyloxyphenyl group, etc.) or a 4-membered to 7-membered heterocyclic group containing as a hetero atom a nitrogen atom, a sulfur atom, or an oxygen atom (for example, a 2-pyridyl group, 1-phenyl-4-imidazolyl group, a 2-furyl group, a benzothienyl group, etc.).

When $A_1$ and $A_2$ each represents a group capable of being eliminated with an alkali (hereinafter referred to as a precursor group), preferred examples of the precursor groups include a hydrolizable group, for example, an acyl group, an alkoxycarbonyl group, an aryloxycarbonyl group, a carbamoyl group, an imidoyl group, an oxazolyl group, a sulfonyl group, etc.; a precursor group of a type utilizing a reversal Michael reaction as described in U.S. Pat. No. 4,009,029, etc.; a precursor group of a type utilizing an anion generated after a ring cleavage reaction as an intramolecular nucleophilic group as described in U.S. Pat. No. 4,310,612, etc.; a precursor group utilizing an electron transfer of an anion via a conjugated system whereby a cleavage reaction occurrs as described in U.S. Pat. Nos. 3,674,478, 3,932,480 and 3,993,661 etc.; a precursor group utilizing an electron transfer of an anion reacted after a ring cleavage reaction whereby a cleavage reaction occurrs as described in U.S. Pat. No. 4,335,200, a precursor group utilizing an imidomethyl group as described in U.S. Pat. Nos. 4,363,865, and 4,410,618, etc.

In formula (III), it is preferred that P represents an oxygen atom and $A_2$ represents a hydrogen atom.

It is more preferred that in formula (III), X and Y each represents a substituted or unsubstituted methine group except that X or Y represents a methine group having a group of $-(L_1)_v-B-(L_2)_w-DI$ as a substituent.

Of the groups represented by formula (III), those particularly preferred are represented by formula (IV) or (V)

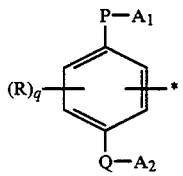

(IV)

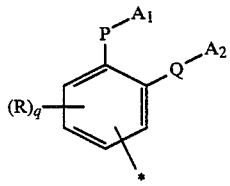

(V)

wherein the bond indicated by * denotes the position at which the group is connected to $-(L_1)_z-B-(L_2-$ $)_w$—DI; P, Q, $A_1$ and $A_2$ each has the same meaning as defined in the general formula (III); R represents a substituent; q represents an integer of 0, 1, 2 or 3; and when q represents 2 or 3, the two or three R groups may be the same or different, or two R groups represent substituents positioned on the adjacent two carbon atoms, they may be divalent groups connected together to form a cyclic structure.

Examples of the cyclic structures formed by condensing the benzene ring and another ring include a naphthalene ring, a benzonorbornene ring, a chroman ring, an indole ring, a benzothiophene ring, quinoline ring, a benzofuran ring, a 2,3-dihydrobenzofuran ring, an indane ring, an indene ring, etc. These rings may further have one or more substituents.

Preferred examples of the substituents represented by R and the substituents on the condensed ring described above include an aliphatic group (for example, a methyl group, an ethyl group, an allyl group, a benzyl group, a dodecyl group, etc.), an aromatic group (for example, a phenyl group, a naphthyl group, a 4-phenoxycarbonylphenyl group, etc.), a halogen atom (for example, a chlorine atom, a bromine atom, etc.), an alkoxy group (for example, a methoxy group, a hexadecyloxy group, etc.), an alkylthio group (for example, a methylthio group, a dodecylthio group, a benzylthio group, etc.), an aryloxy group (for example, a phenoxy group, a 4-tert-octylphenoxy group, a 2,4-di-tert-amylphenoxy group, etc.), an arylthio group (for example, a phenylthio group, a 4-dodecyloxphenylthio group, etc.), a carbamoyl group (for example, an N-ethylcarbamoyl group, an N-propylcarbamoyl group, an N-hexadecylcarbamoyl group, an N-tert-butylcarbamoyl group, an N-3-(2,4-di-tert-amylphenoxy)propylcarbamoyl group, an N-methyl-N-octadecylcarbamoyl group, etc.), an alkoxycarbonyl group (for example, a methoxycarbonyl group, a 2-cyanoethoxycarbonyl group, an ethoxycarbonyl group, a dodecyloxycarbonyl group, a 3-(2,4-di-tert-amylphenoxy)propoxycarbonyl group, etc.), an aryloxycarbonyl group (for example, a phenoxycarbonyl group, a 4-nonylphenoxycarbonyl group, etc.), a sulfonyl group (for example, a methanesulfonyl group, a benzenesulfonyl group, a p-toluenesulfonyl group, etc.), a sulfamoyl group (for example, an N-propylsulfamoyl group, an N-methyl-N-octadecylsulfamoyl group, an N-phenylsulfamoyl group, an N-dodecylsulfamoyl group, etc.), an acylamino group (for example, an acetamido group, a benzamido group, a tetradecanamido group, a 4-(2,4-di-tert-amylphenoxy)butanamido group, a 2-(2,4-di-tert-amylphenoxy)butanamido group, a 2-(2,4-di-tert-amylphenoxy)tetradecanamido group, etc.), a sulfonamido group (for example, a methanesulfonamido group, a benzenesulfonamido group, a hexadecylsulfonamido group, etc.), an acyl group (for example, an acetyl group, a benzoyl group, a myristoyl group, a palmitoyl group, etc.), a nitroso group, an acyloxy group (for example, an acetoxy group, a benzoyloxy group, an lauryloxy group, etc.), a ureido group (for example, a 3-phenylureido group, a 3-(4-cyanophenyl)ureido group, etc.), a nitro group, a cyano group, a heterocyclic group (preferably a 4-membered, 5-membered, or 6-membered heterocyclic group containing a nitrogen atom, an oxygen atom, or a sulfur atom as a hetero atom, for example, a 2-furyl group, a 2-pyridyl group, a 1-imidazolyl group, a 1-morpholino group, etc.), a hydroxyl group, a carboxyl group, an alkoxycarbonylamino group (for example, a methoxycarbonylamino group, a phenoxycarbonylamino group, a dodecyloxycarbonylamino group, etc.), a sulfo group, an amino group, an arylamino group (for example, an anilino group, a 4-methoxycarbonylanilino group, etc.), an aliphatic amino group (for example, an N,N-diethylamino group, a dodecylamino group, etc.), a sulfinyl group (for example, a benzenesulfinyl group, a propylsulfinyl group, etc.), a sulfamoylamino group (for example, a 3-phenylsulfomoylamino group, etc.), a thioacyl group (for example, a thiobenzoyl group, etc.), a thioureido group (for example, a 3-phenylthioureido group, etc.), a heterocyclic thio group (for example, a thiadiazolylthio group, etc.), an imido group (for example, a succinimido group, a phthalimido group, an octadecenylimido group, etc.), or a heterocyclic amino group (for example, a 4-imidazolylamino group, a 4-pyridylamino group, etc.), etc.

The aliphatic moiety included in the above described substituents may have from 1 to 32 carbon atoms, preferably from 1 to 20 carbon atoms, and may be a straight chain, branched chain or cyclic, saturated or unsaturated, substituted or unsubstituted aliphatic group.

The aromatic moiety included in the above described substituents preferably from 6 to 10 carbon atoms, and is more preferably a substituted or unsubstituted phenyl group.

It is preferred that the group represented by B in formula (II) is a group represented formula (B-1).

In formula (B-1), P preferably represents an oxygen atom and Q preferably represents an oxygen atom or one of the groups

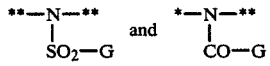

wherein the bond indicated by * denotes the position at which the group is connected to $—(X'=Y')_n—$; the bond indicated by ** denotes the position at which the group is connected to $A_2$; and G has the same meaning as defined by formula (N-1) and (N-2).

Further, the effects of the present invention are particularly exhibited when the group represented by B in formula (II) represents a group represented by formula (B-2) or (B-3)

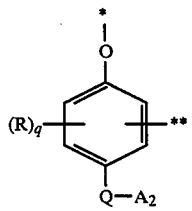

(B-2)

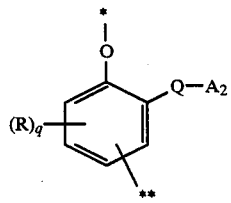

(B-3)

wherein the bond indicated by * denotes the position at which the group is connected to $A—(L_1)_v—$; the bond indicated by ** denotes the position at which the group is connected to $—(L_2)_w—DI$; and R, q, Q, and $A_2$ each has the same meaning as defined for formula (IV) or (V).

Preferred examples of the substituents represented by R in formula (B-2) or (B-3) include an aliphatic group (for example, a methyl group, an ethyl group, etc.), an alkoxy group (for example, a methoxy group, an ethoxy group, etc.), an alkylthio group (for example, a methylthio group, an ethylthio group, etc.), an alkoxycarbonyl group (for example, a methoxycarbonyl group, a propoxycarbonyl group, etc.), an aryloxycarbonyl group (for example, a phenoxycarbonyl group, etc.), a carbamoyl group (for example, an N-propylcarbamoyl group, an N-tert-butylcarbamoyl group, an N-ethylcarbamoyl group, etc.), a sulfonamido group (for example, a methanesulfonamido group, etc.), an acylamino group (for example, an acetamido group, etc.), a heterocyclic thio group (for example, a tetrazolylthio group etc.), a hydroxy group, or an aromatic group, etc. It is preferred that the total number of carbon atoms included in the above described group for R is not more than 15.

In formula (II), it is preferred that each of v and w is O.

It is particularly preferred that the group represented by A in formula (II) is a coupler residual group.

In the following, further preferred embodiments according to the present invention are described.

In formula (II), a particularly preferred example of the development inhibitor represented by DI is a development inhibitor which is a compound having a development inhibiting function when being released as DI and capable of being decomposed (or changed into) a compound having substantially no effect on photographic properties after being discharged into a color developing solution.

Examples of these development inhibitors include those as described in U.S. Pat. No. 4,477,563, Japanese patent application (OPI) Nos. 218644/85, 221750/85, 233650/85, 11743/86, etc.

Preferred examples of the development inhibitors represented by DI include those represented by formula (D-1), (D-2), (D-3), (D-4), (D-5), (D-6), (D-7), (D-8), (D-9), (D-10) or (D-11)

(D-1)

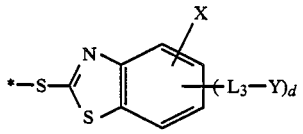

(D-2)

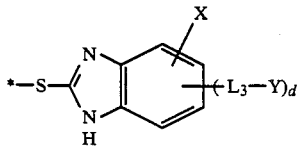

(D-3)

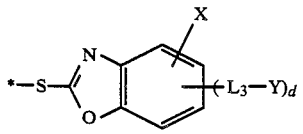

(D-4)

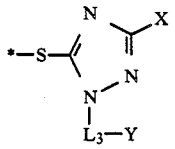

-continued (D-5)

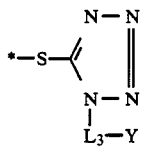

(D-6)

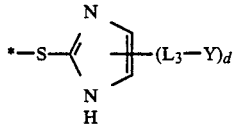

(D-7)

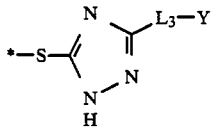

(D-8)

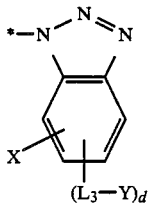

(D-9)

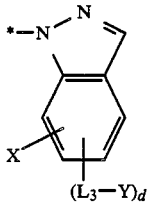

(D-10)

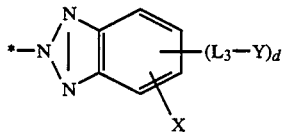

(D-11)

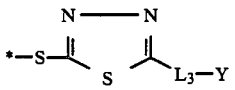

wherein the bond indicated by * denotes the position at which the group is connected $A—(L_1)_v—B—(L_2)_w—$; X represents a hydrogen atom or a substituent which is discussed below; d represents 1 or 2; $L_3$ represents a group containing a chemical bond which is capable of being cleaved in a developing solution; and Y represents a substituent capable of generating the development inhibiting function and is selected from an aliphatic group, an aromatic group, or a heterocyclic group.

The development inhibitor represented by DI described above which is released from $A—(L_1)_v—B—(L_2)_w—$ diffuses in a photographic layer while exhibiting the development inhibiting function and a part thereof discharges into the color developing solution. The development inhibitor discharged into the color developing solution rapidly decomposes at the chemical bond included in $L_3$ to release the group represented by Y (for example, hydrolysis of an ester bond) upon a reaction with a hydroxy ion or hydroxylamine generally present in the color developing solution, whereby the compound changes into a compound having a large water-solubility and a small development inhibiting function, and thus the development inhibiting function substantially disappears.

While X in the above described formulae is preferably a hydrogen atom, it may be another substituent. Representative examples of such substituent include an aliphatic group (for example, a methyl group, an ethyl group, etc.), an acylamino group (for example, an acetamido group, a propionamido group, etc.), an alkoxy group (for example, a methoxy group, an ethoxy group, etc.), a halogen atom (for example, a chlorine atom, a bromine atom), a nitro group, or a sulfonamido group (for example, a methanesulfonamido group, etc.), etc.

The linking group represented by $L_3$ in the above described formulae includes a chemical bond which is cleaved in a developing solution. Suitable examples of such chemical bonds include those described in Table A below. These chemical bonds are cleaved with a nucleophilic reagent such as a hydroxy ion, hydroxylamine, etc., which is a component of the color developing solution.

TABLE A

| Chemical Bond Included in $L_3$ | Cleavage Reaction of Chemical Bond (Reaction with —OH) |
|---|---|
| —COO— | —COOH + HO— |
| H<br>—NCOO— | —$NH_2$ + HO— |
| —$SO_2O$—<br>—$OCH_2CH_2SO_2$— | —$SO_3H$ + HO—<br>—OH + $CH_2$=$CHSO_2$— |
| —OCO—<br>‖<br>O | —OH + HO— |
| —NHCCO—<br>‖‖<br>OO | —$NH_2$ + HO— |

The divalent linking group shown in Table A above is connected directly or through an alkylene group and/or a phenylene group with a heterocyclic moiety constituting a development inhibitor or is connected directly with Y. When the divalent linking group is connected through an alkylene group and/or a phenylene group, the alkylene group and/or phenylene group may contain an ether bond, an amido bond, a carbonyl group, a thioether bond, a sulfon group, a sulfamido bond or a ureido bond.

The aliphatic group represented by Y is an aliphatic hydrocarbon group preferably having from 1 to 20 carbon atoms, more preferably from 1 to 10 carbon atoms, and may be saturated or unsaturated, a straight chain, branched chain or cyclic, or substituted or unsubstituted. A substituted aliphatic hydrocarbon group is particularly preferred.

The aromatic group represented by Y is a substituted or unsubstituted phenyl group or a substituted or unsubstituted naphthyl group.

The heterocyclic group represented by Y is a substituted or unsubstituted four-membered to eight-membered heterocyclic group containing a sulfur atom, an oxygen atom, or a nitrogen atom as a hetero atom.

Specific examples of the heterocyclic groups to be used include a pyridyl group, an imidazolyl group, a furyl group, a pyrazolyl group, an oxazolyl group, a thiazolyl group, a thiadiazolyl group, a triazolyl group, a diazolidinyl group, or a diadinyl group, etc.

Examples of the substituents for the substituted aliphatic group, aromatic group or heterocyclic group include a halogen atom, a nitro group, an alkoxy group having from 1 to 10 carbon atoms, an aryloxy group having from 6 to 10 carbon atoms, an alkanesulfonyl group having from 1 to 10 carbon atoms, an arylsulfonyl group having from 6 to 10 carhon atoms, an alkanamido group having from 1 to 10 carbon atoms, an anilino group, a benzamido group, a carbamoyl group, an alkyl carbamoyl group having from 1 to 10 carbon atoms, an aryl carbamoyl group having from 6 to 10 carbon atoms, an alkylsulfonamido group having from 1 to 10 carbon atoms, an arylsulfonamido group having from 6 to 10 carbon atoms, an alkylthio group having from 1 to 10 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 10 carbon atoms, an alkanoyl group having from 1 to 10 carbon atoms, a benzoyl group, an alkanoyloxy group having from 1 to 10 carbon atoms, a benzoyloxy group, a perfluoroalkyl group having from 1 to 5 carbon atoms, a cyano group, a tetrazolyl group, a hydeoxyl group, a mercapto group, an amino group, an alkylsulfamoyl group having from 1 to 10 carbon atoms, an arylsulfamoyl group having from 6 to 10 carbon atoms, a morpholino group, an aryl group having from 6 to 10 carbon atoms, a pyrrolidinyl group, a ureido group, a urethane group, an alkoxy carbonyl group having from 1 to 10 carbon atoms, an aryloxy carbonyl group having from 6 to 10 carbon atoms, an imidazolidinyl group, or an alkylidenamino group having from 1 to 10 carbon atoms, etc.

Specific examples of the compounds used in accordance with the present invention are set forth below, but the present invention is not to be construed as being limited thereto.

(1)
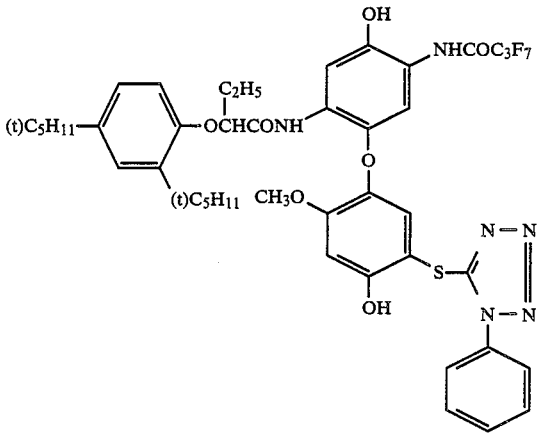
(2)
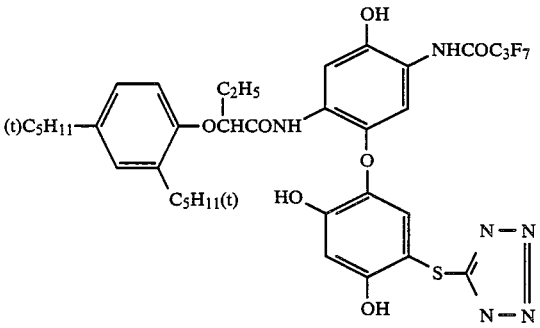
(3)
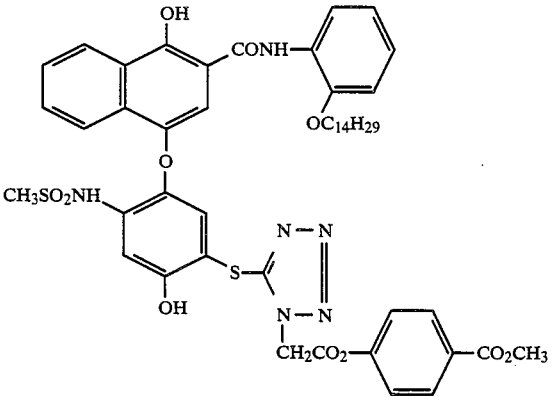
(4)
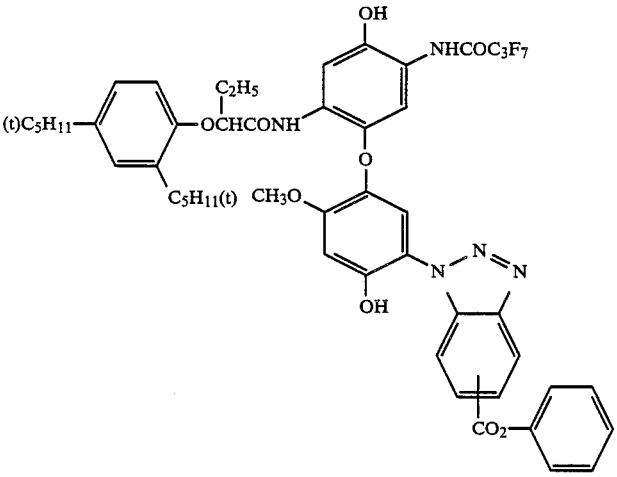

-continued
(5)
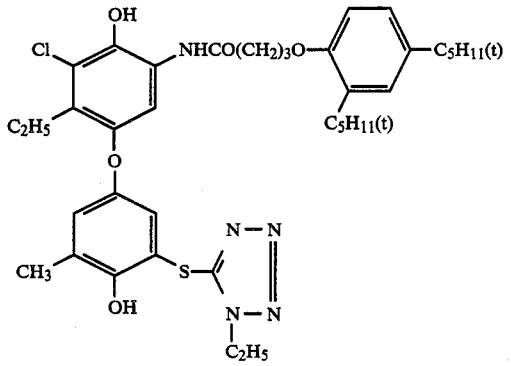
(6)
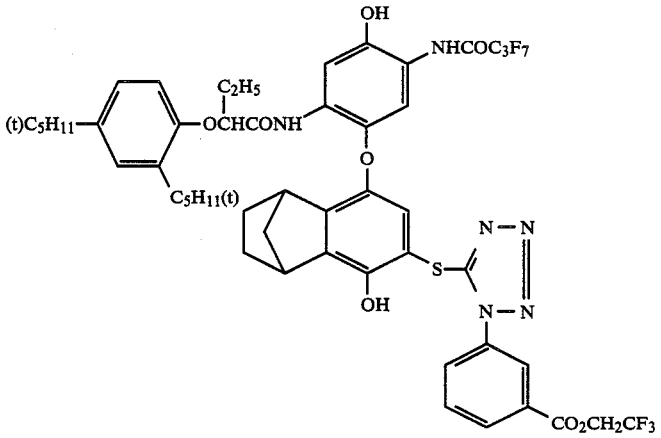
(7)
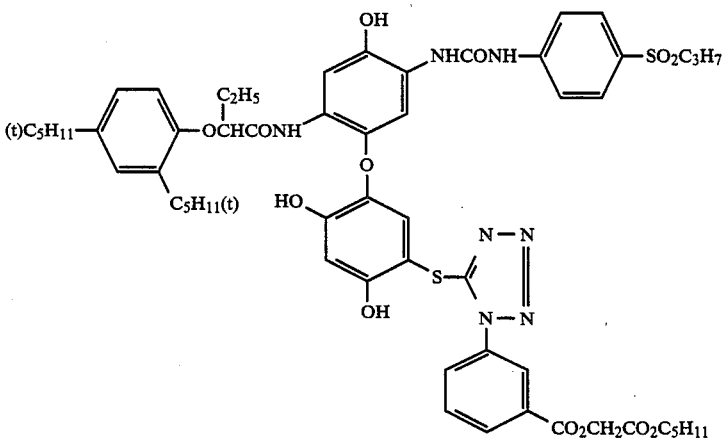
(8)
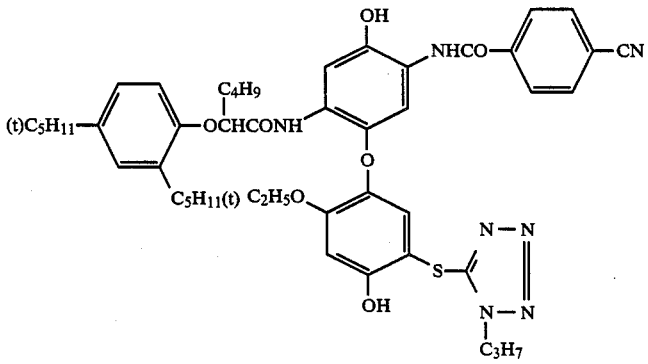

-continued
(9)
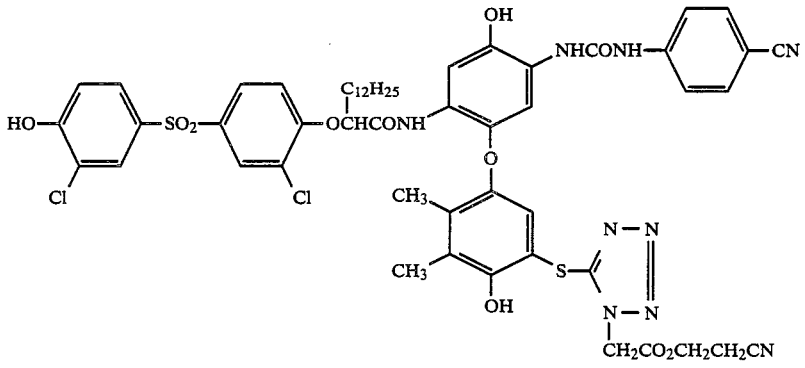
(10)
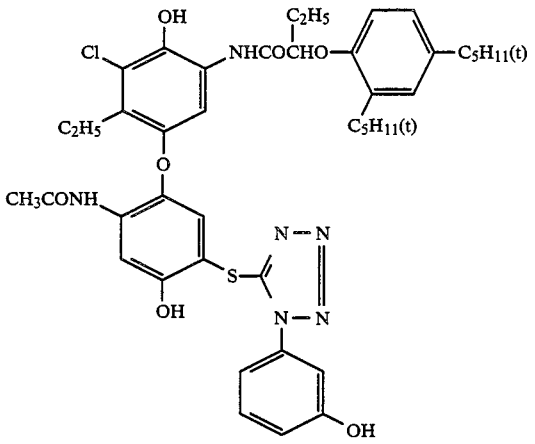
(11)
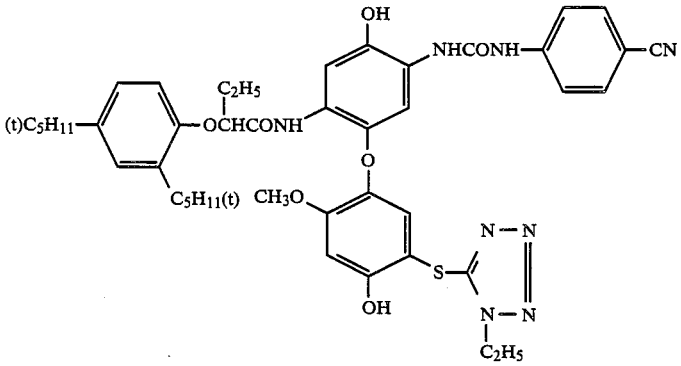
(12)
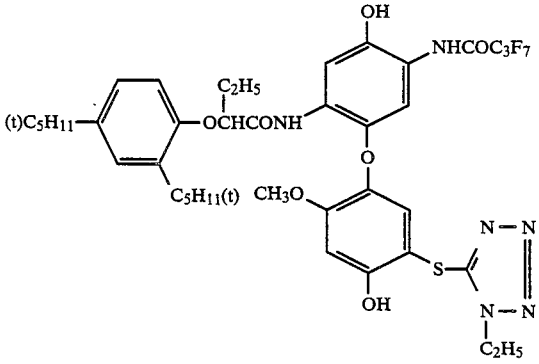

-continued
(13)
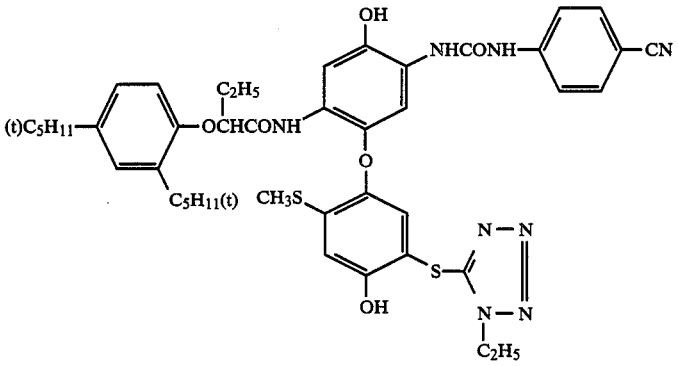
(14)
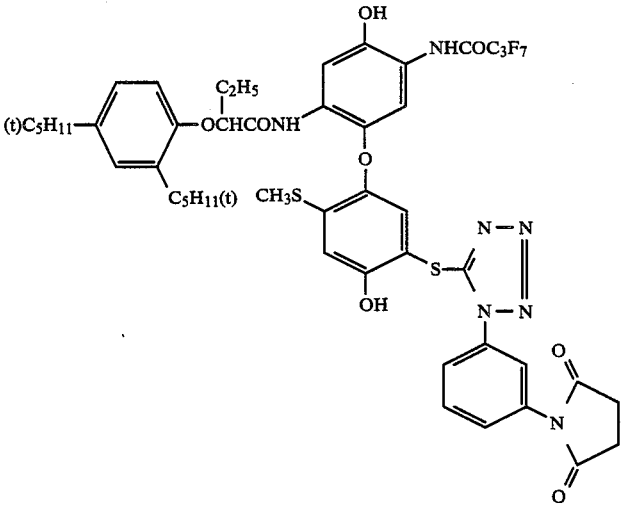
(15)
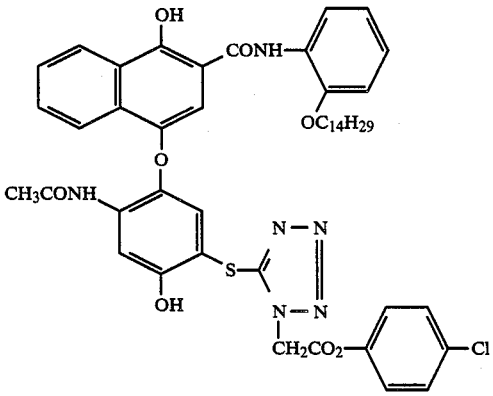
(16)
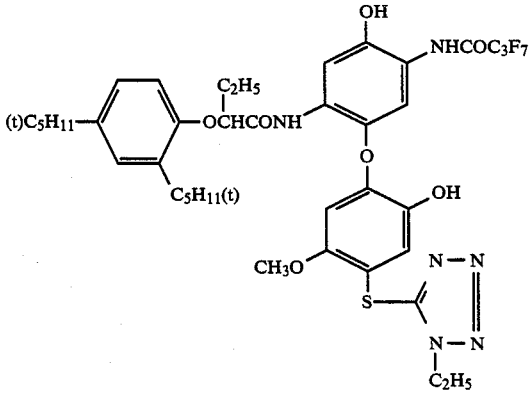

-continued
(17)
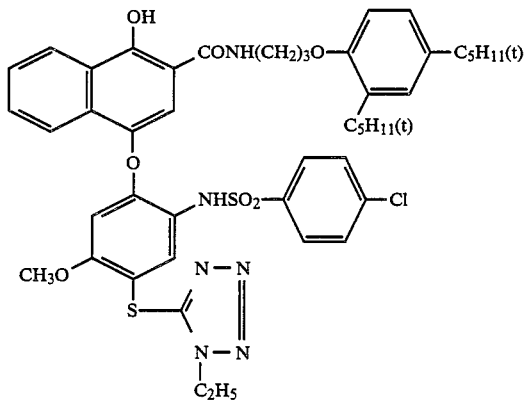
(18)
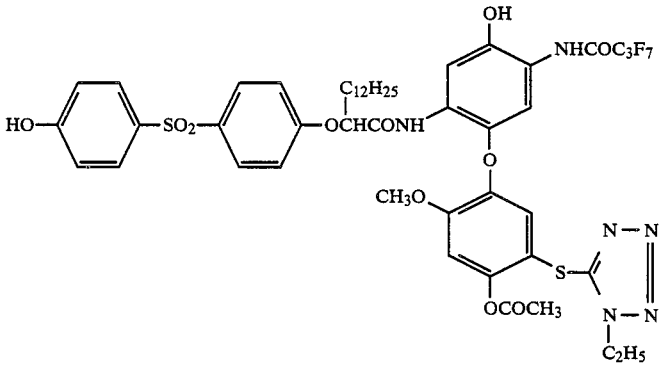
(19)
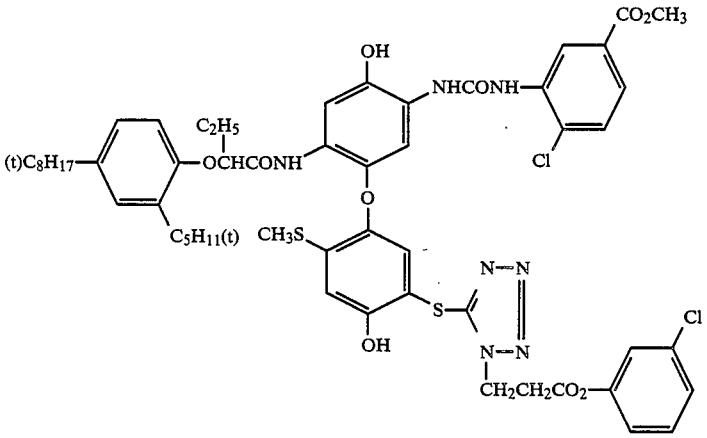
(20)
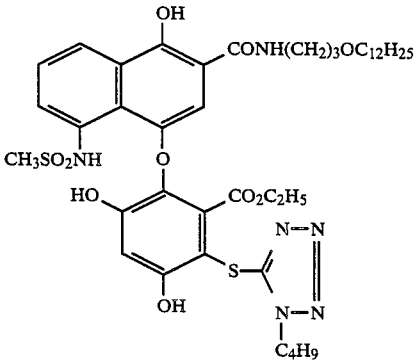

-continued
(21)
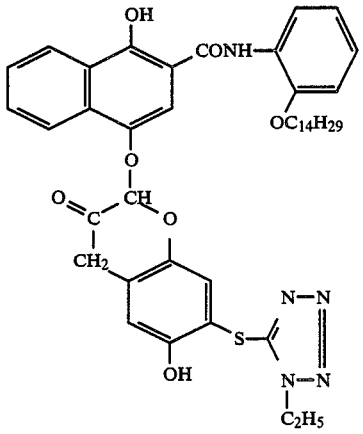
(22)
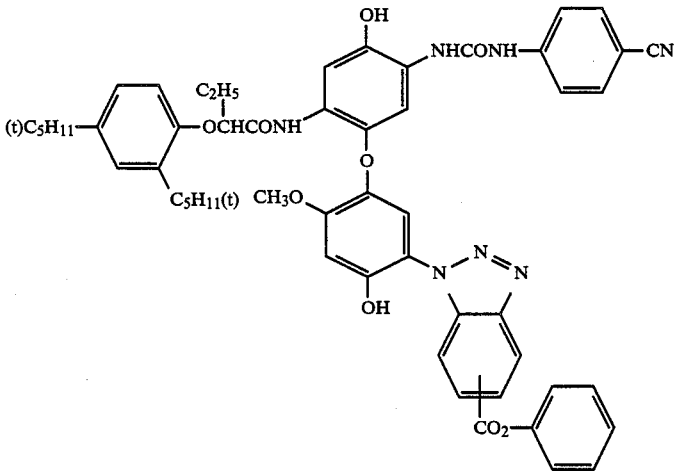
(23)
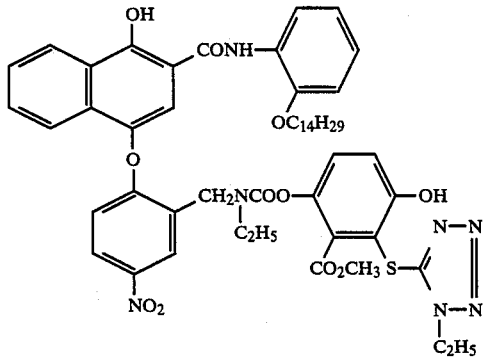

-continued
(24)
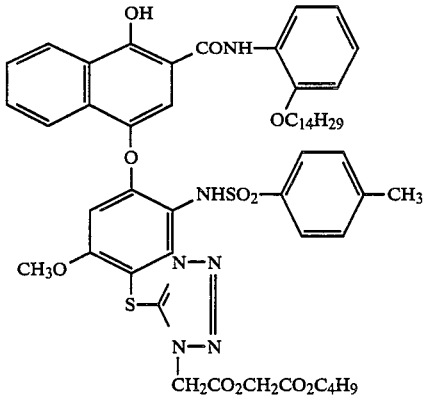
(25)
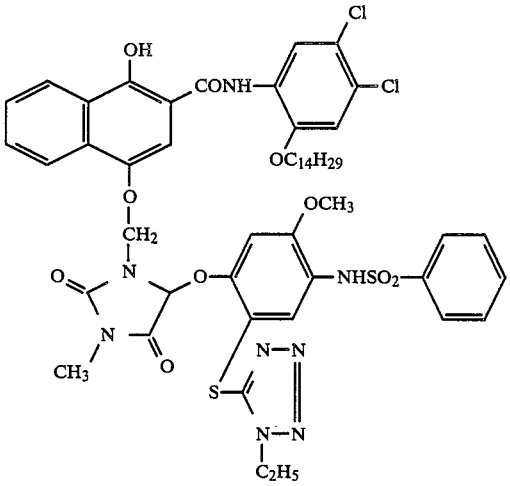
(26)
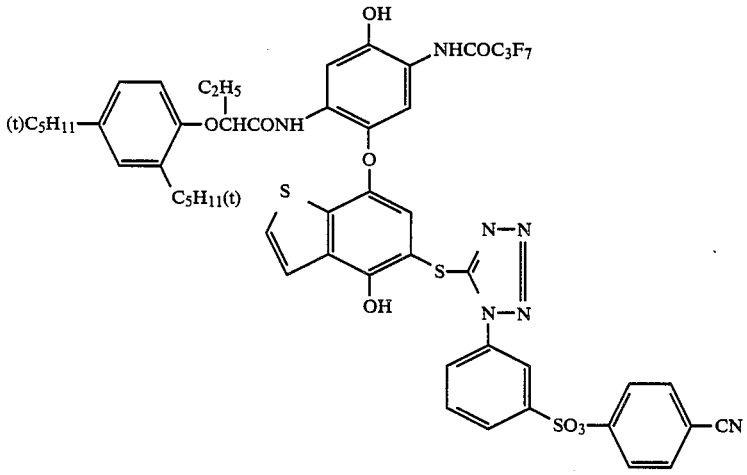

-continued
(27)
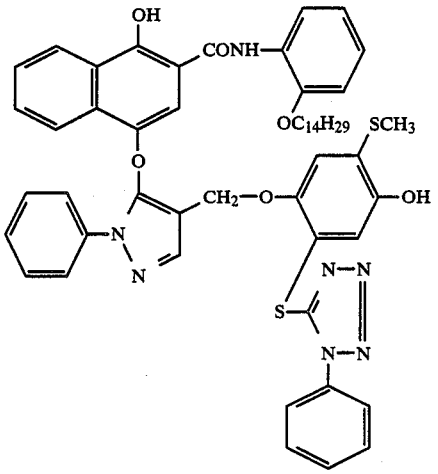
(28)
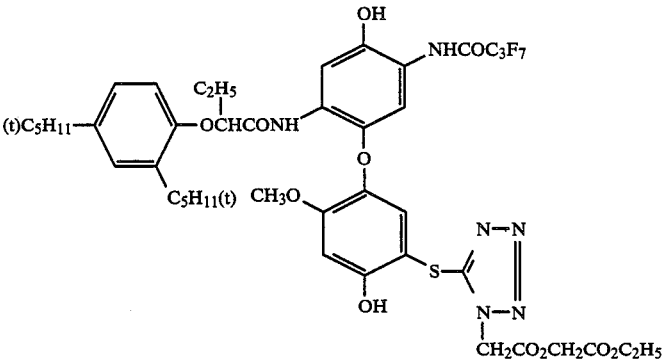
(29)
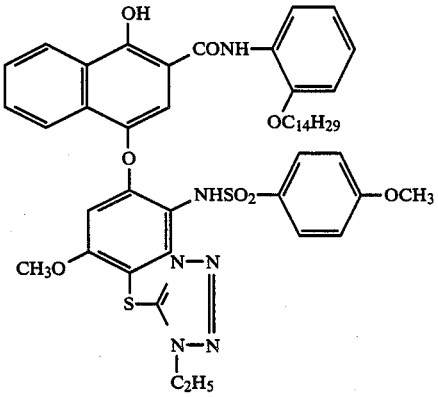
(30)
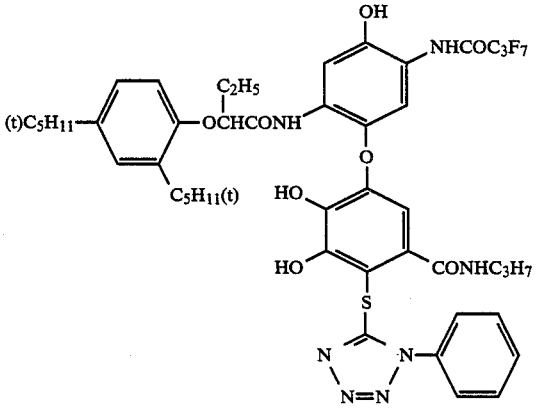

-continued
(31)
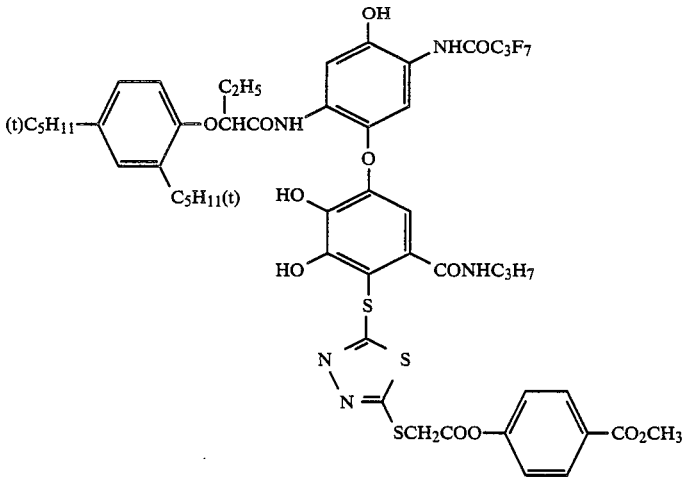
(32)
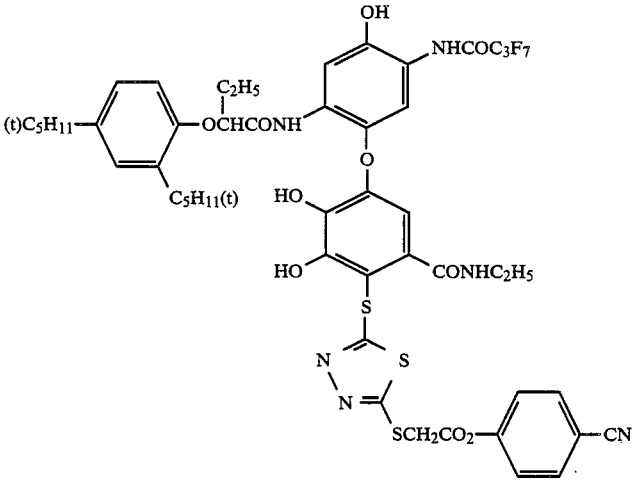
(33)
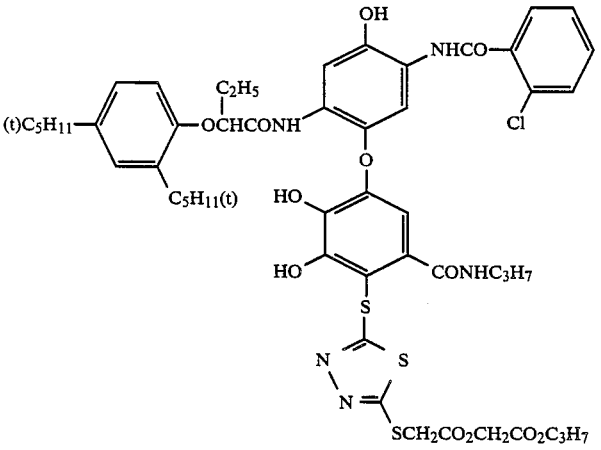

-continued
(34)
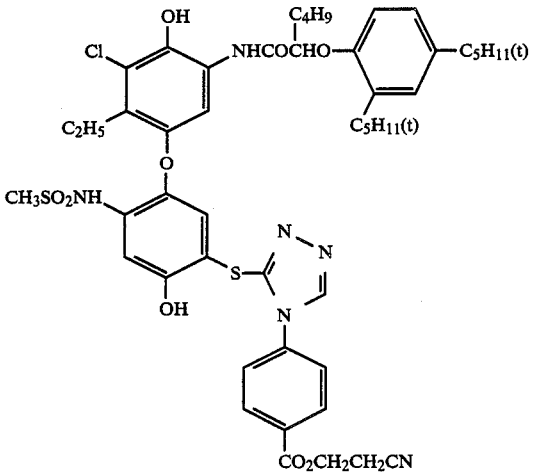
(35)
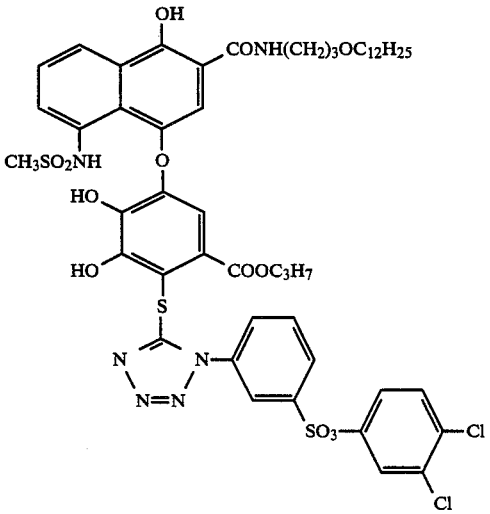
(36)
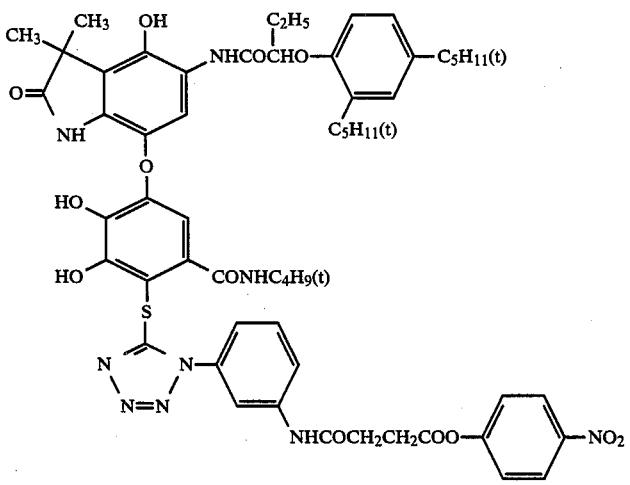

-continued
(37)
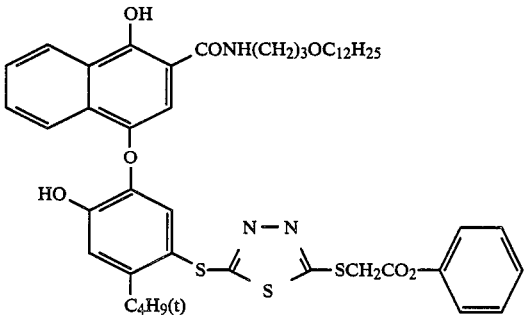
(38)
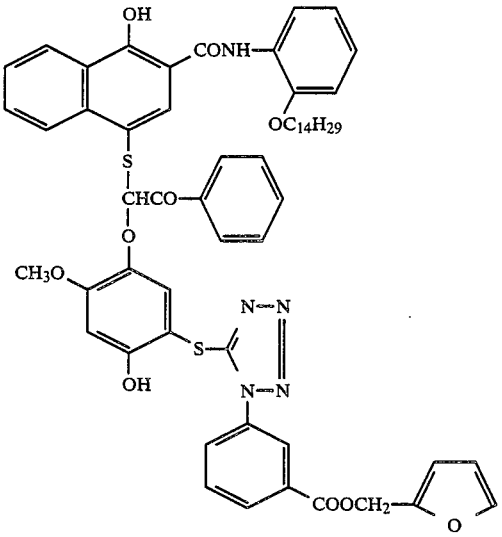
(39)
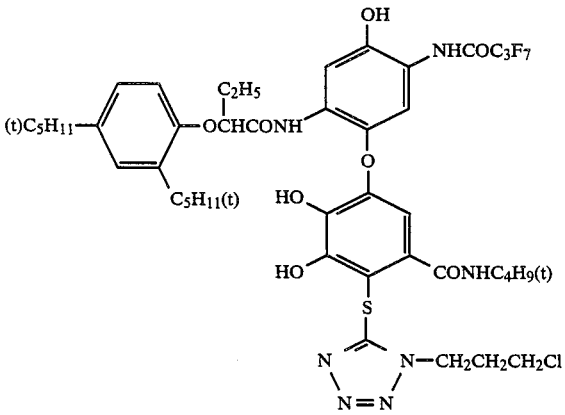

-continued
(40)
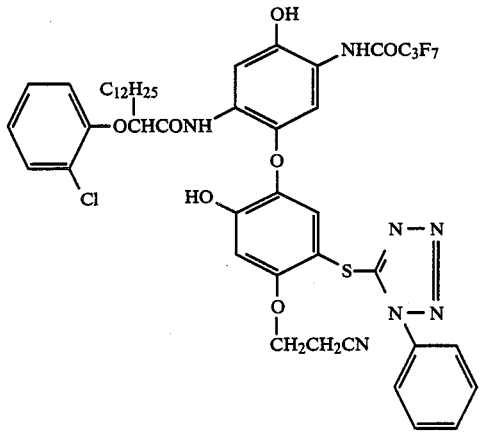
(41)
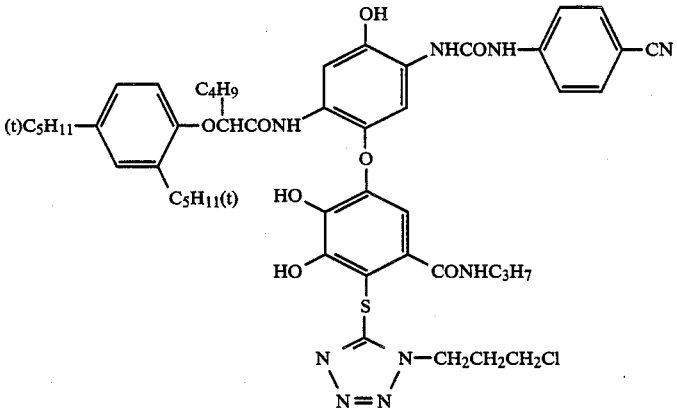
(42)
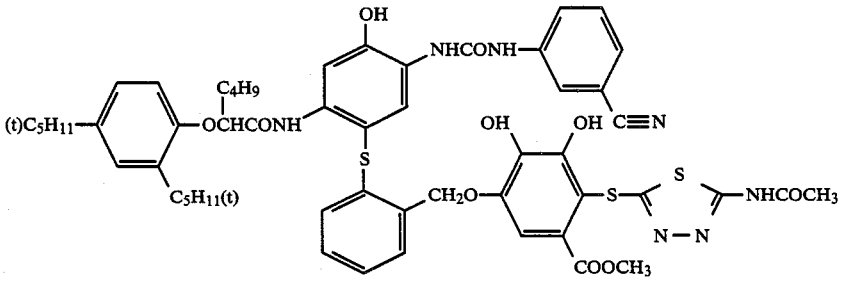
(43)
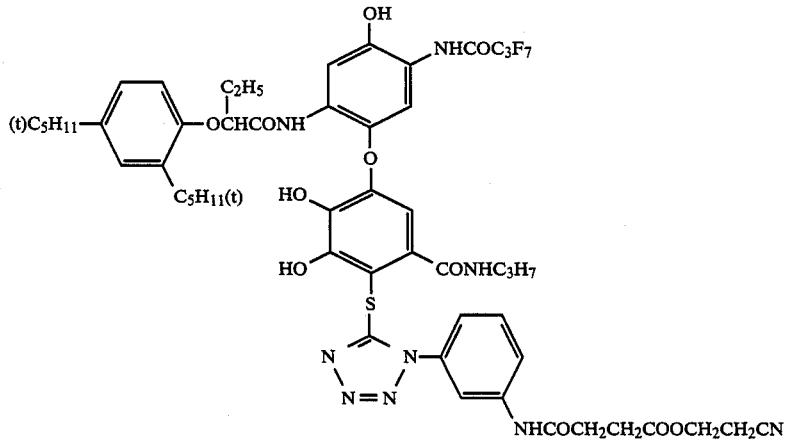

-continued
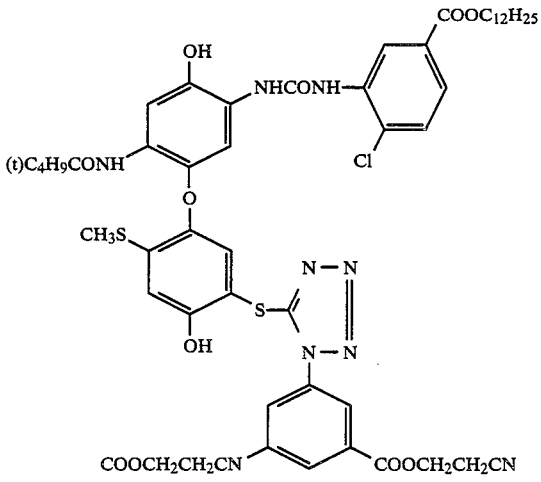
(44)
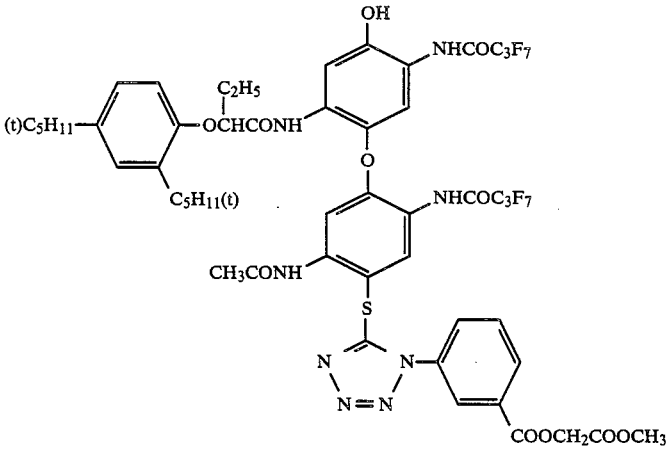
(45)
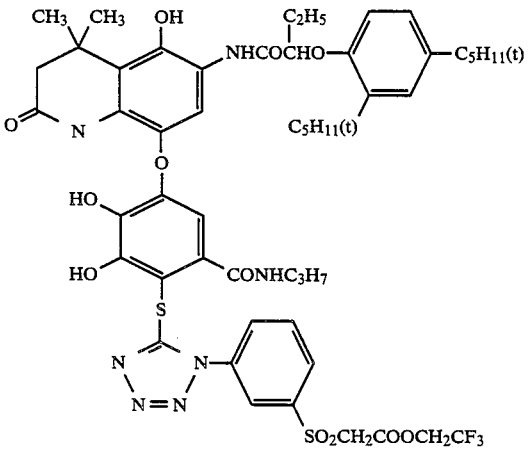
(46)

-continued
(47)
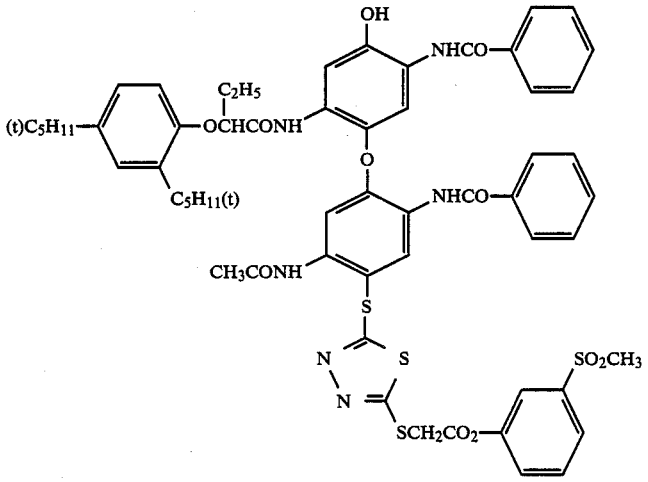
(48)
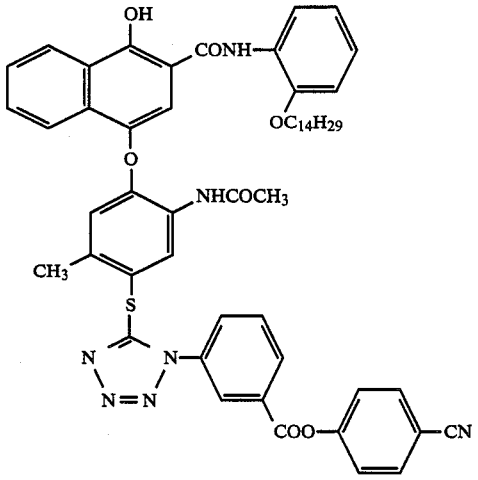
(49)
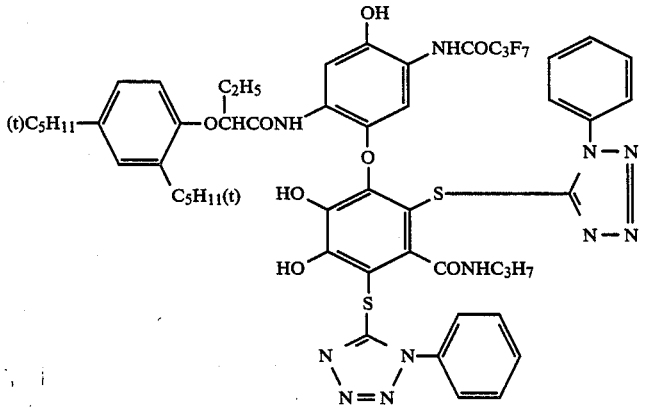

-continued
(50)
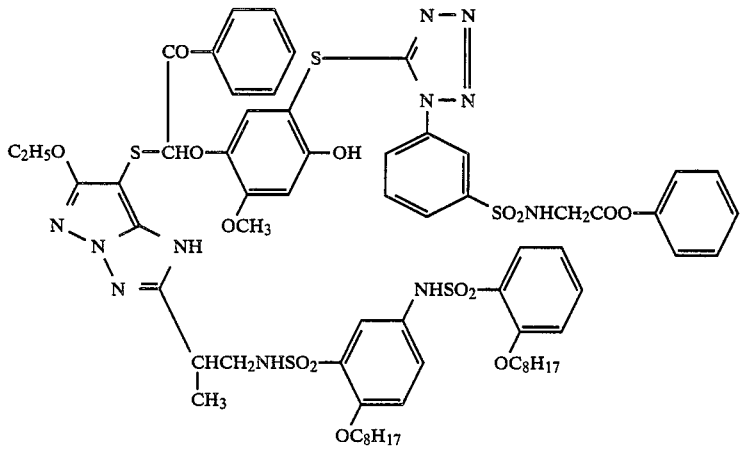
(51)
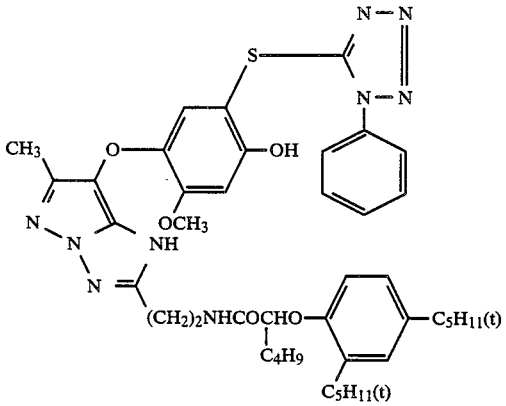
(52)
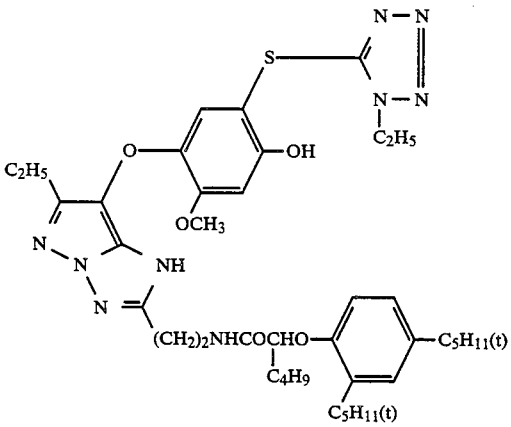

-continued
(53)
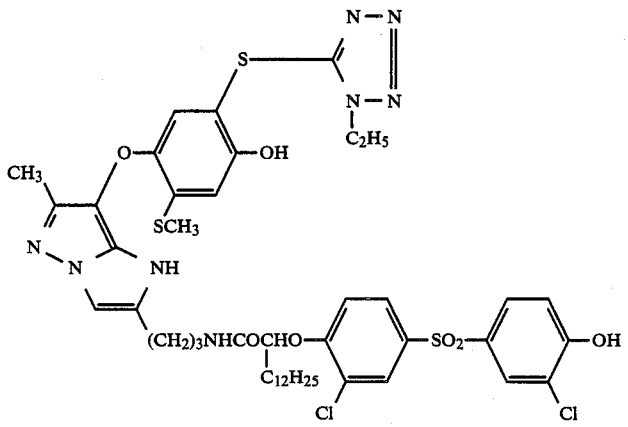
(54)
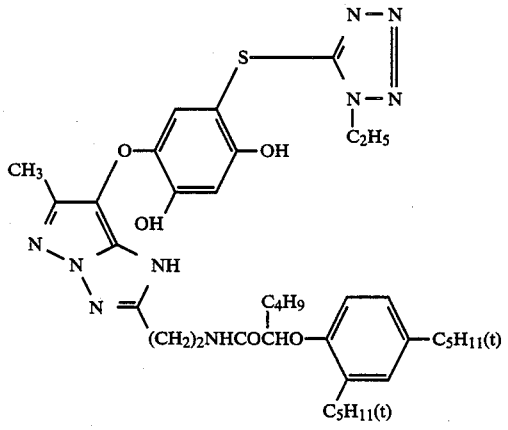
(55)
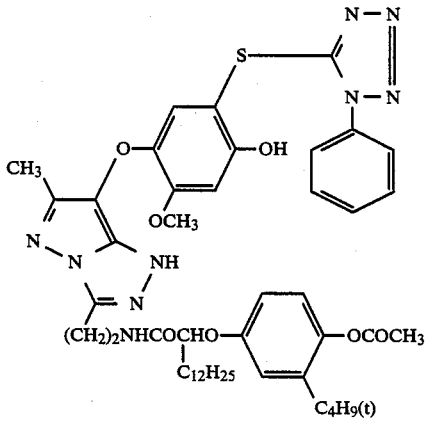

-continued
(56)
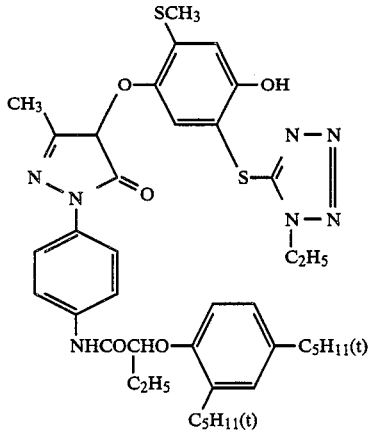
(57)
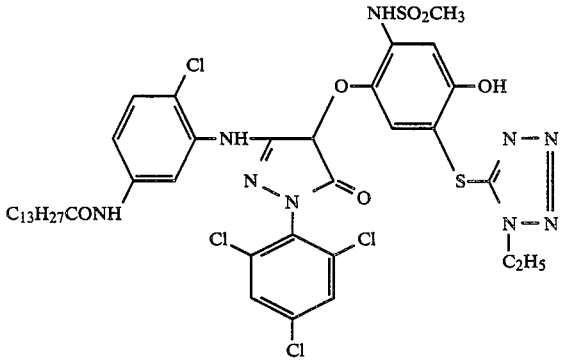
(58)
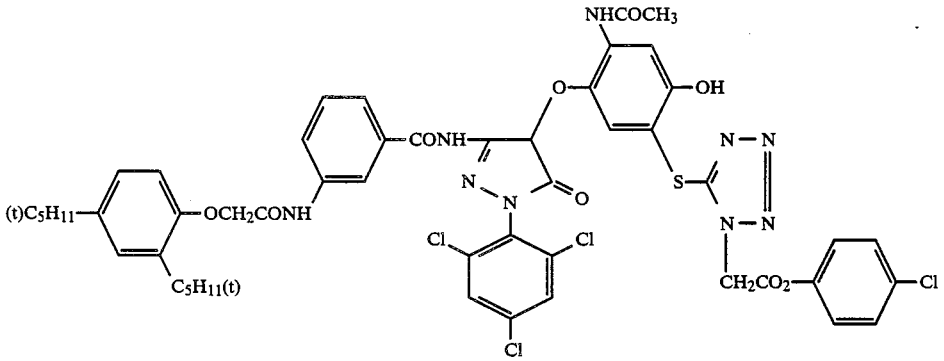
(59)
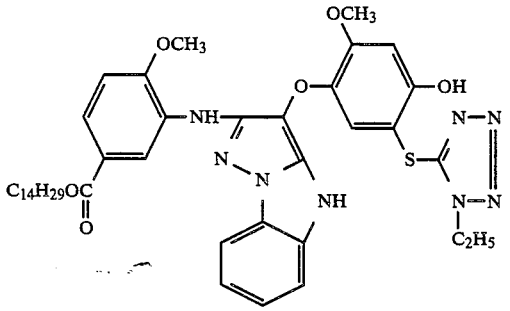

-continued
(60)
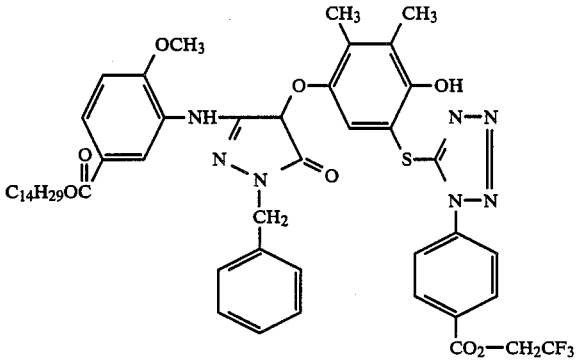
(61)
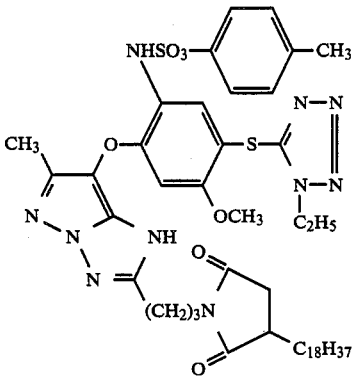
(62)
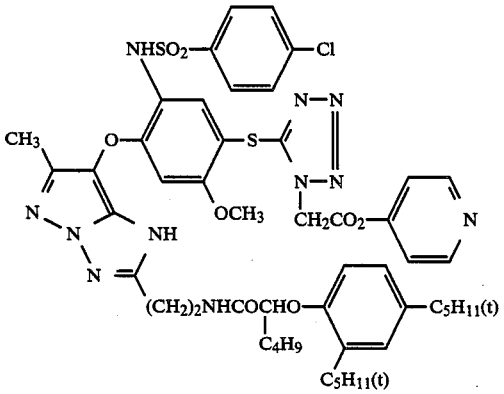
(63)
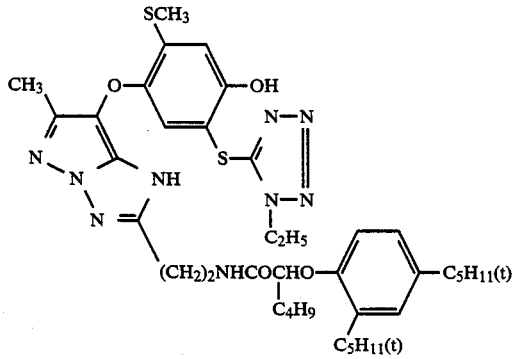

-continued
(64)
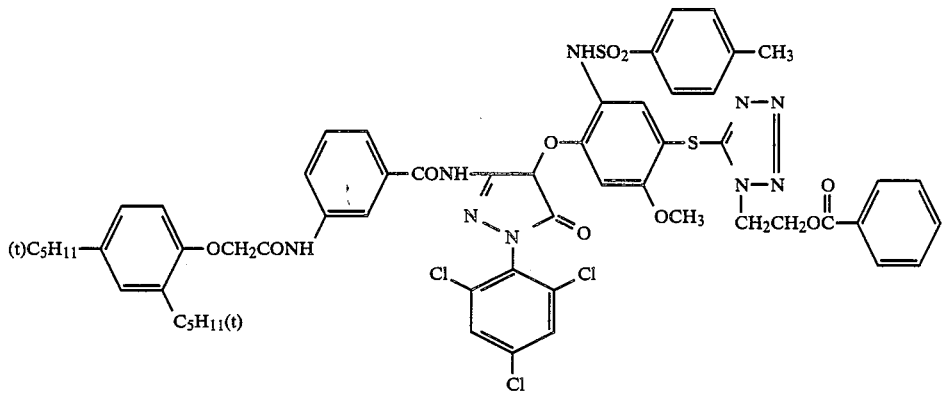
(65)
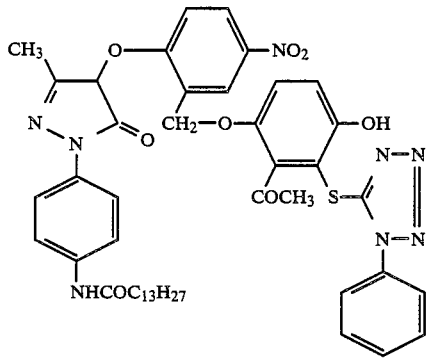
(66)
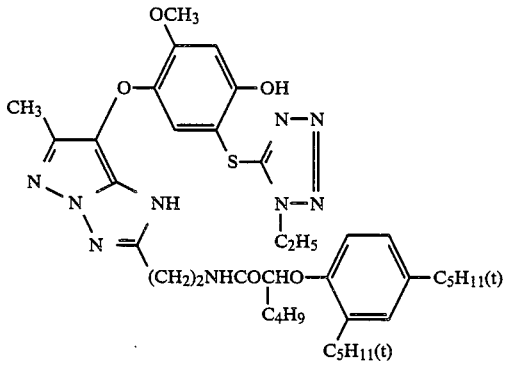
(67)
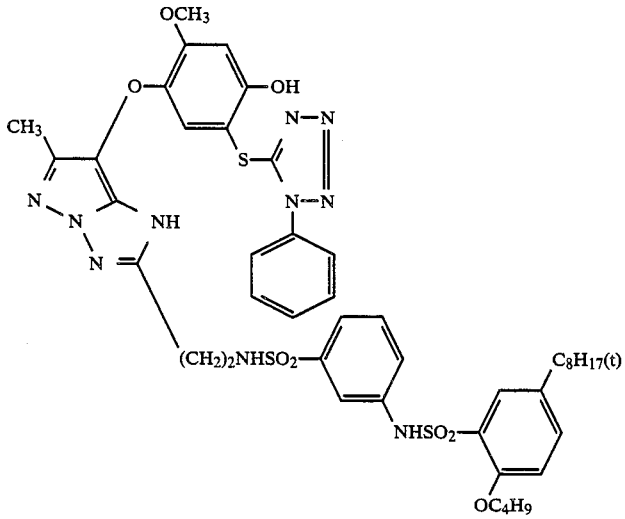

-continued
(68)
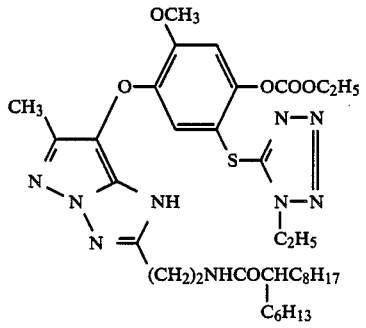
(69)
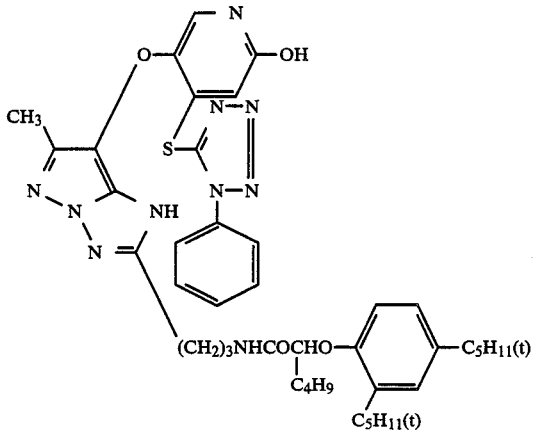
(70)
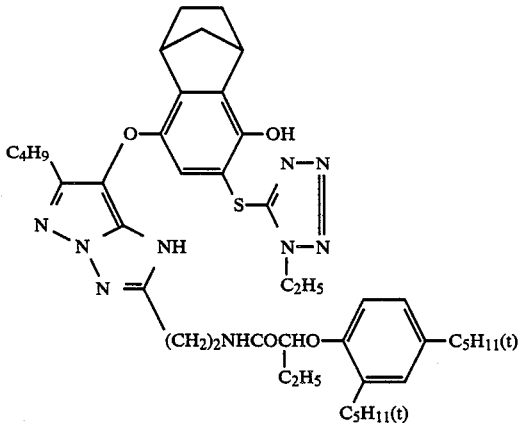
(71)
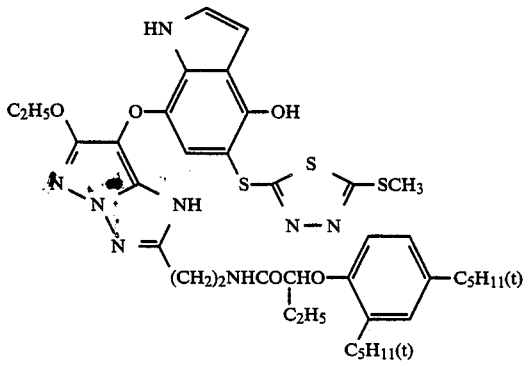

-continued
(72)
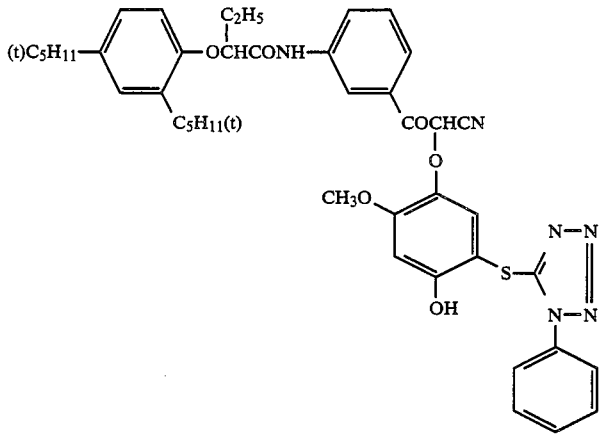
(73)
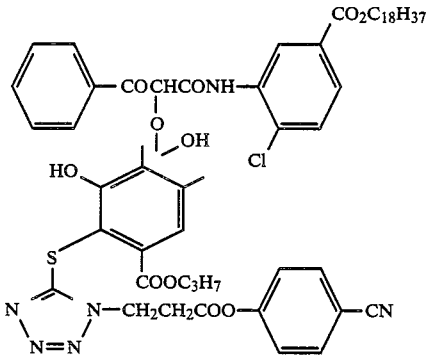
(74)
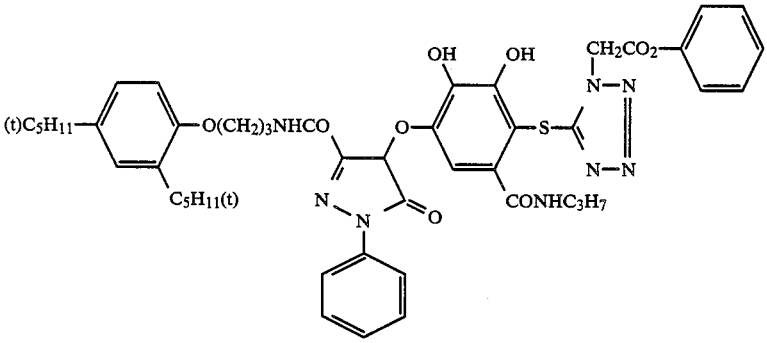
(75)
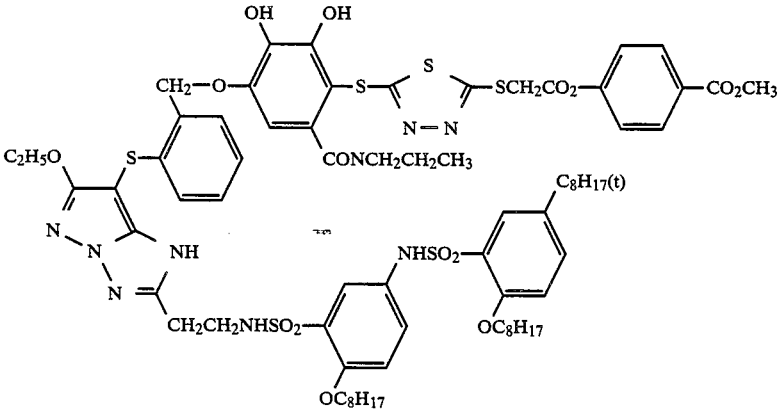

-continued
(76)
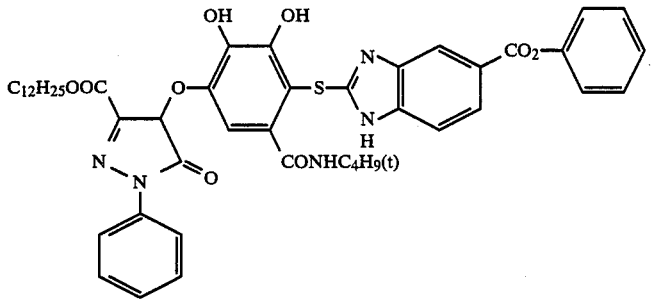
(77)
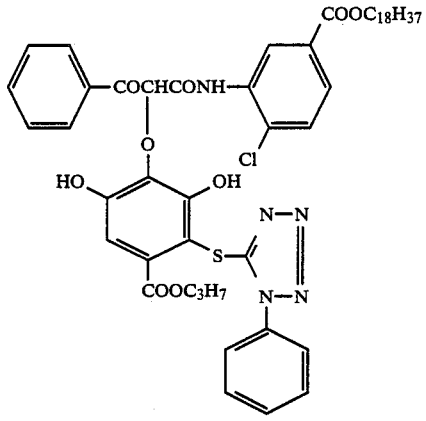
(78)
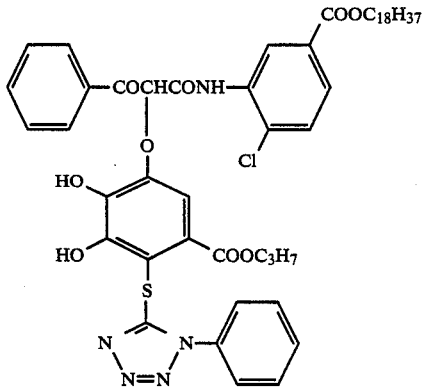
(79)
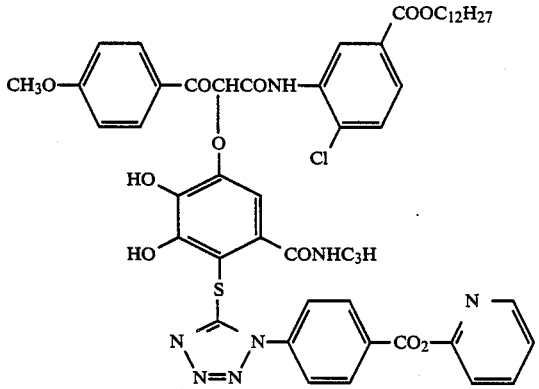

-continued
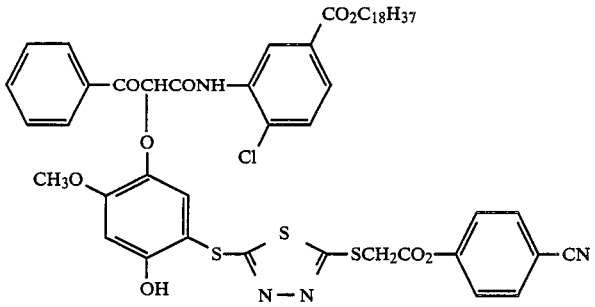
(80)
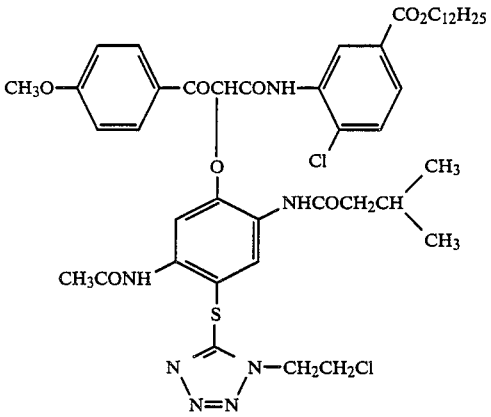
(81)
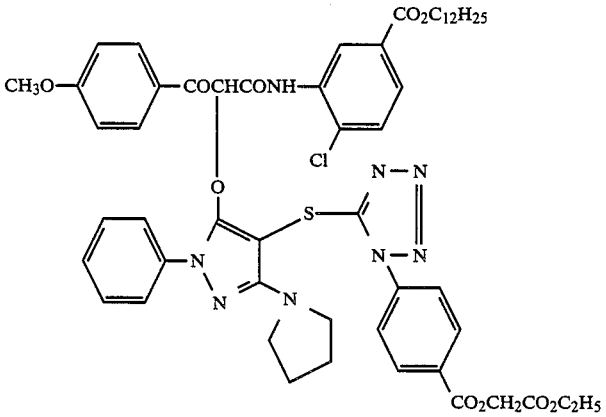
(82)
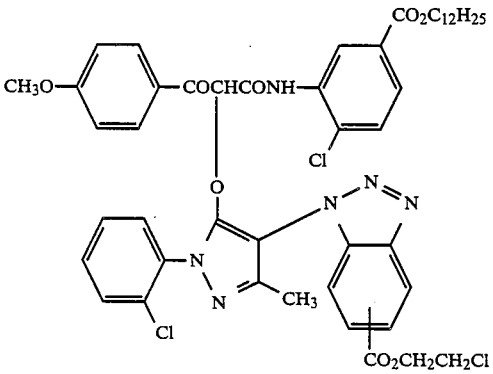
(83)

-continued
(84)
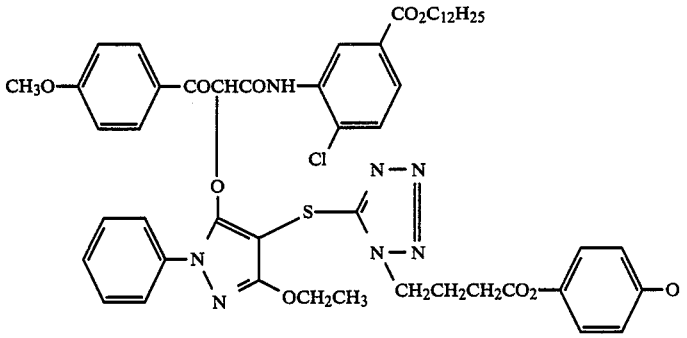
(85)
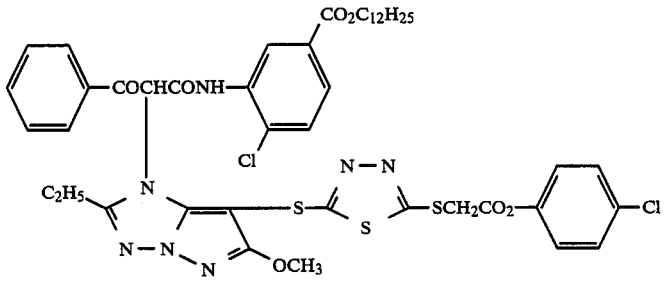
(86)
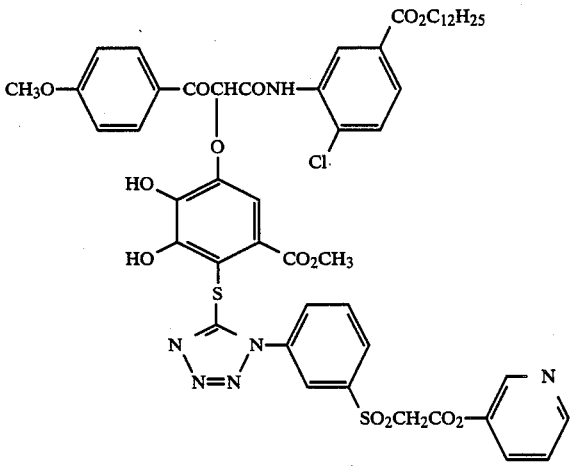
(87)
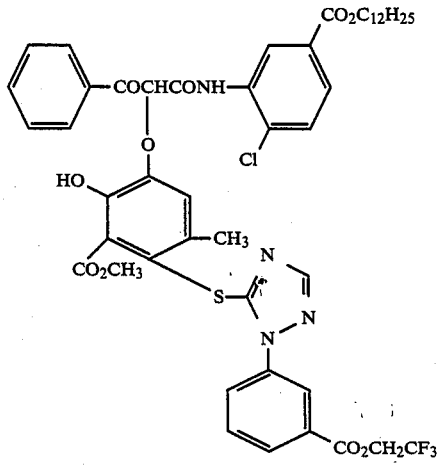

-continued
(88)
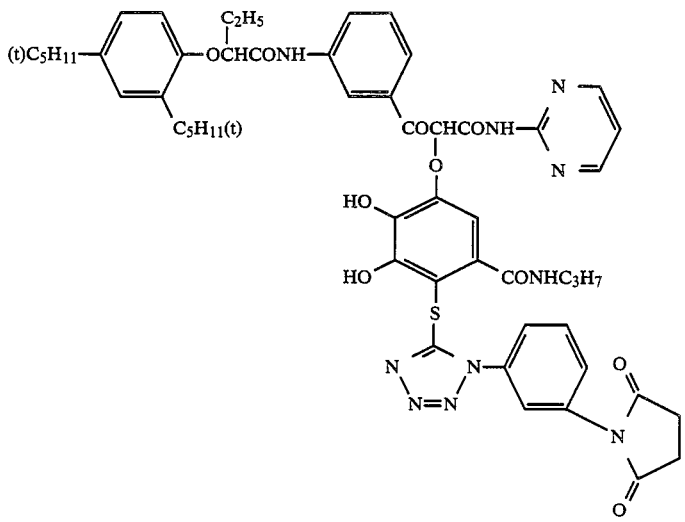
(89)
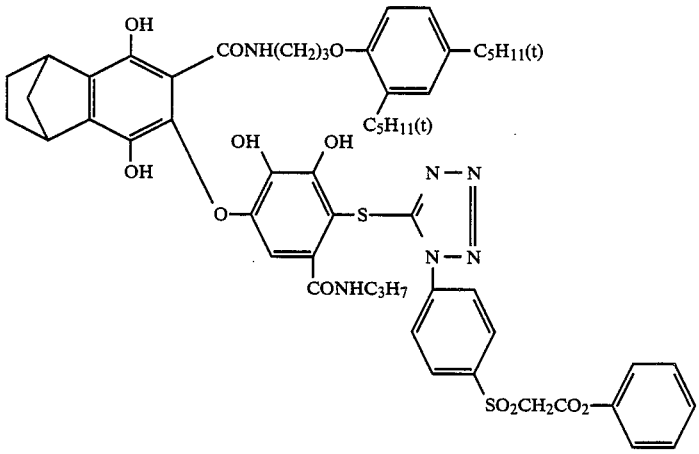
(90)
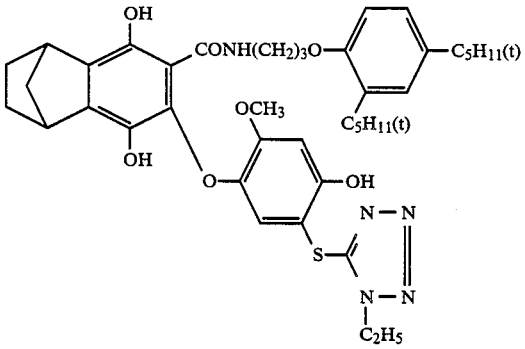

-continued
(91)
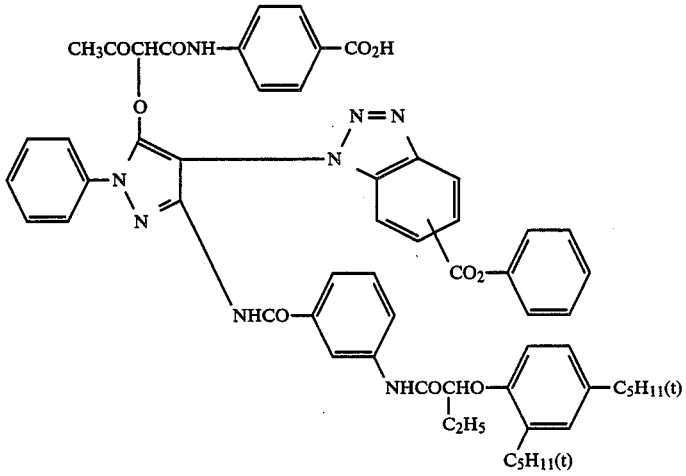
(92)
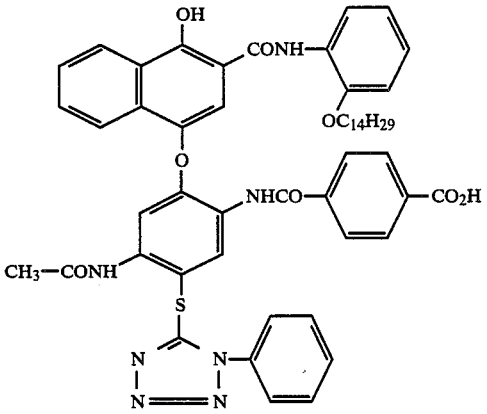
(93)
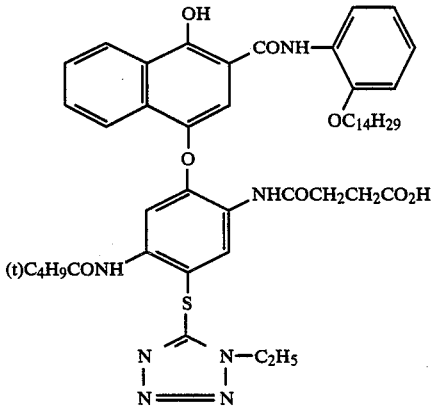
(94)
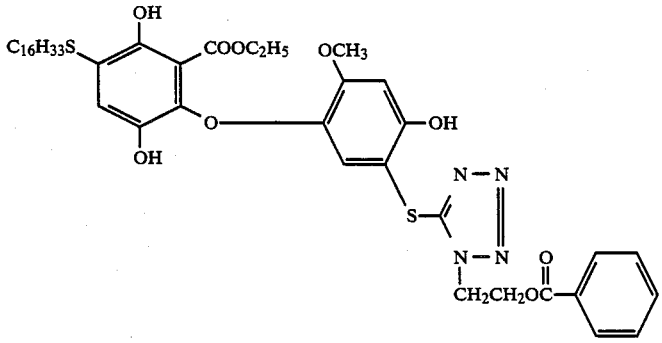

-continued
(95)
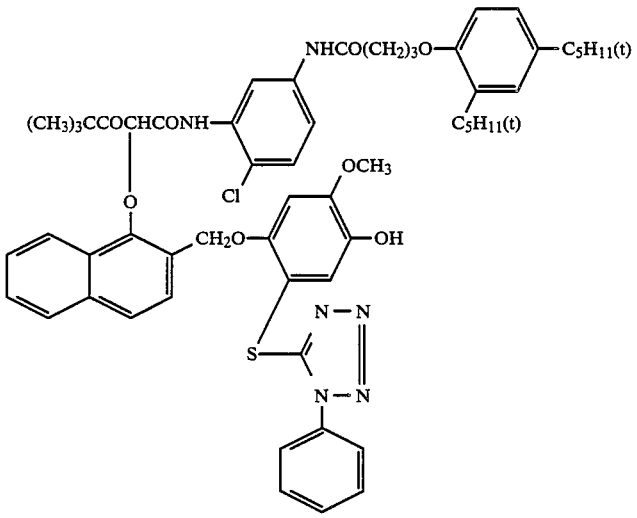
(96)
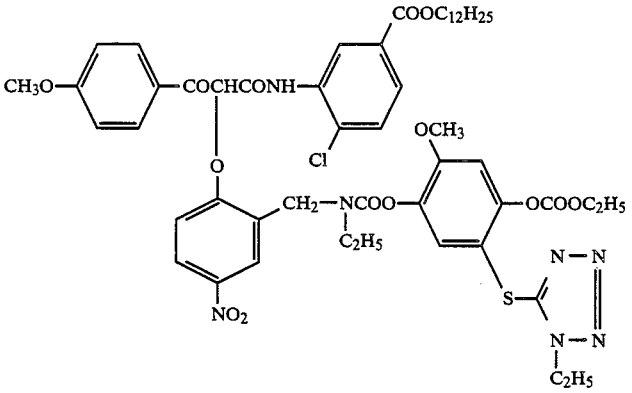
(97)
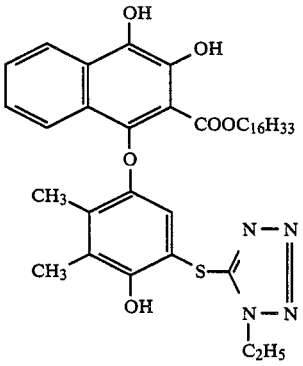

(98)
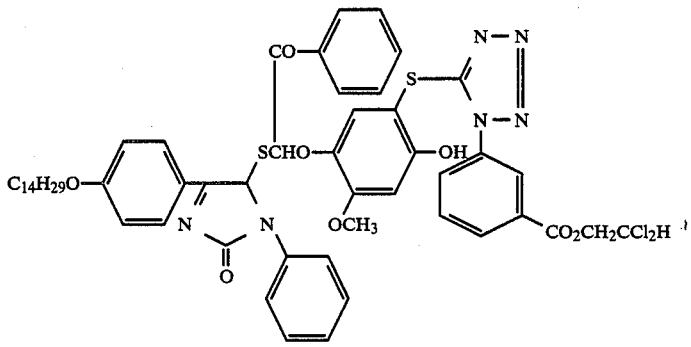
(99)
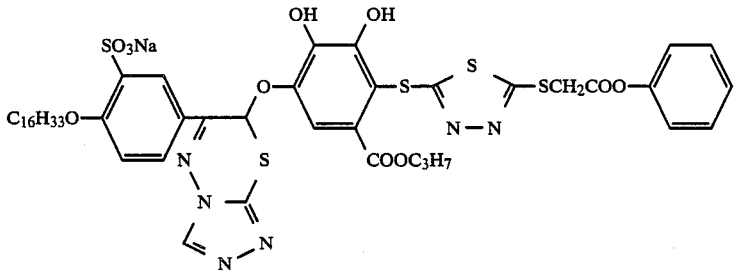
(100)
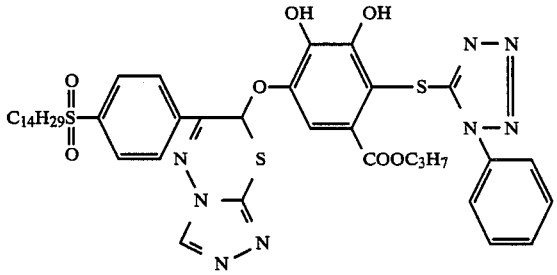
(101)
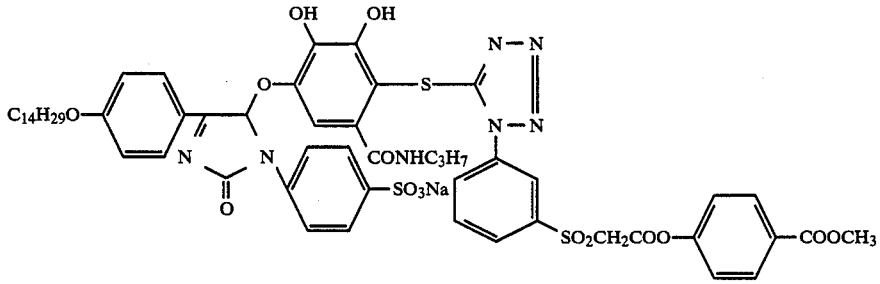
(102)
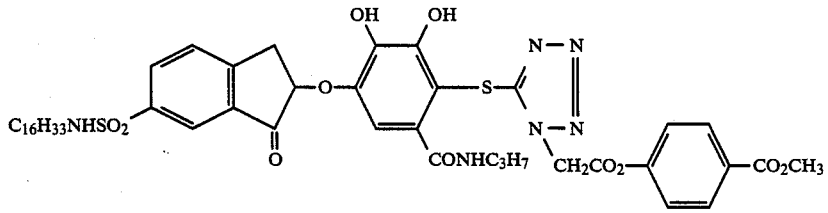
(103)
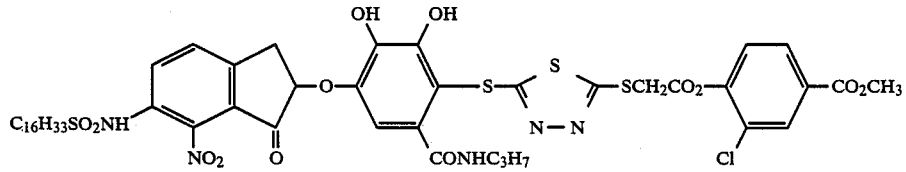

-continued
(104)
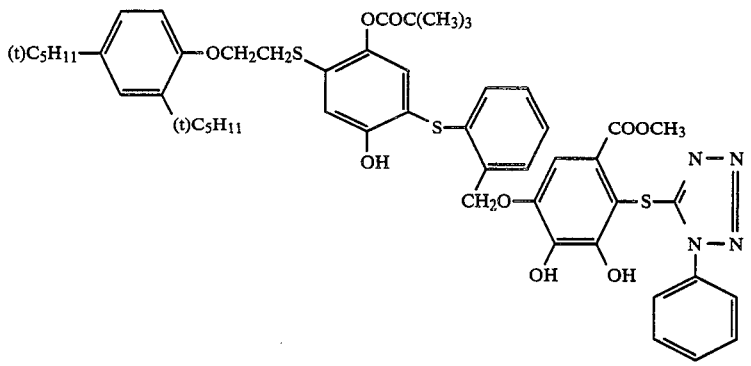
(105)
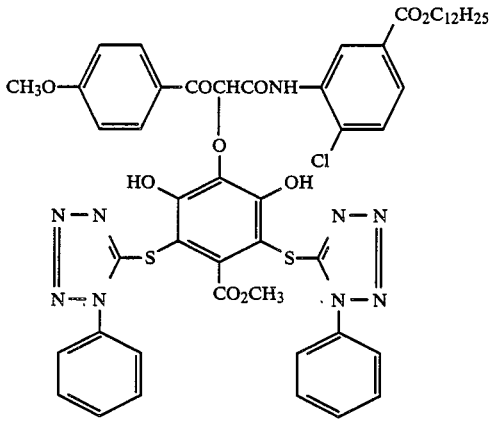
(106)
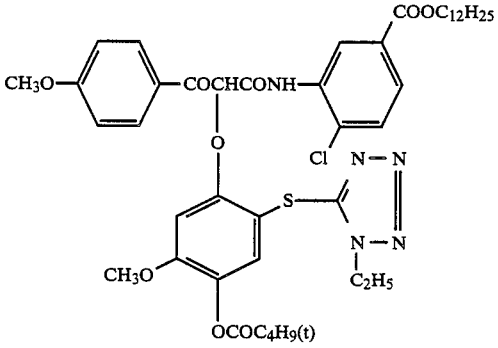
(107)
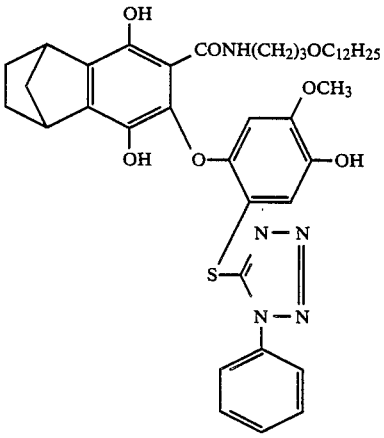

-continued
(108)
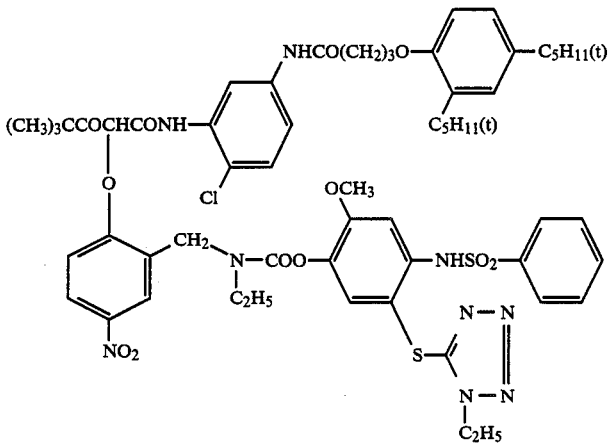
(109)
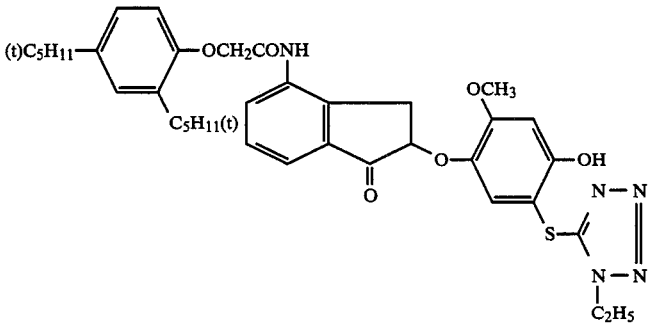
(110)
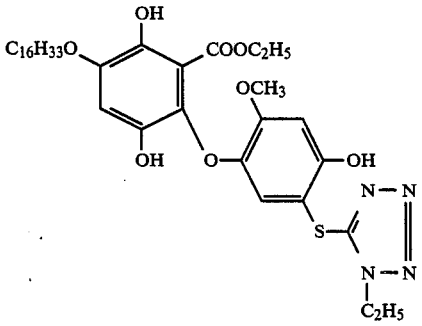
(111)
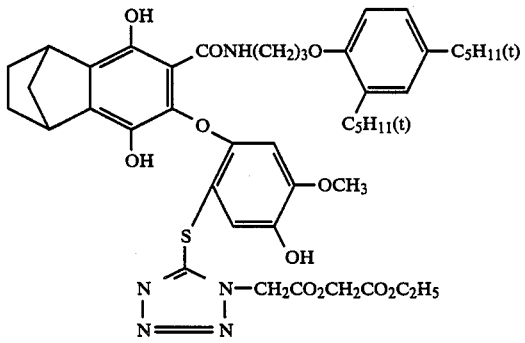
Typical synthesis examples of the compounds according to the present invention are illustrated below, and other compounds can be synthesized in a similar manner.
SYNTHESIS EXAMPLES 1
Synthesis of Compound (1)
Compound (1) was synthesized according to the route schematically shown below.

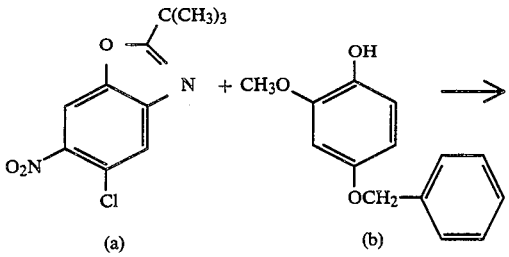

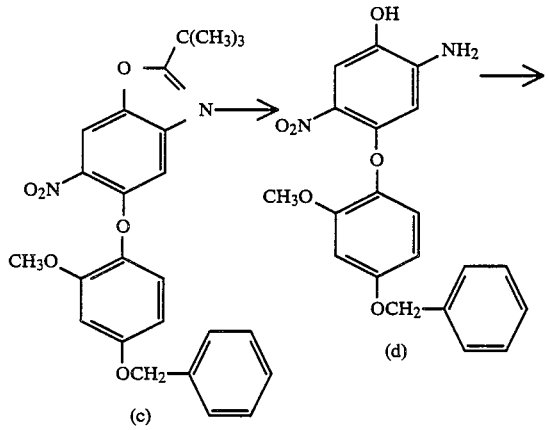

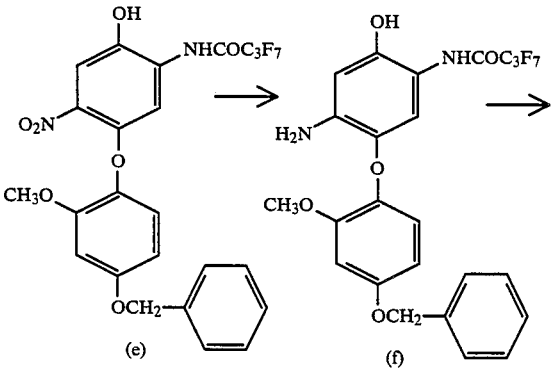

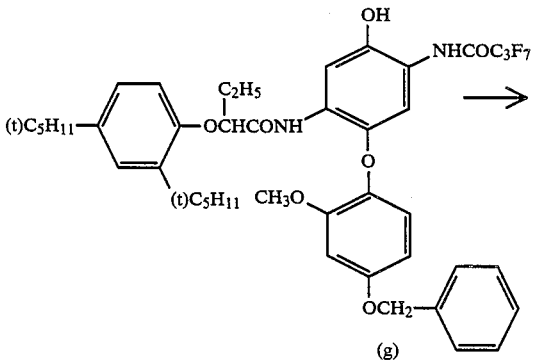

-continued

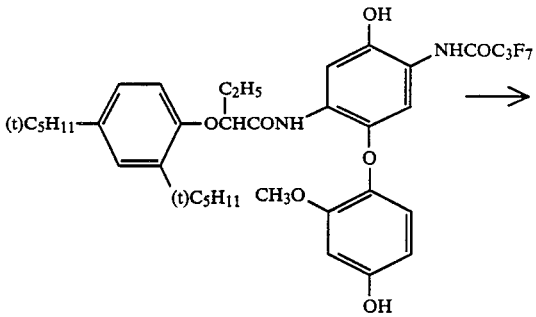

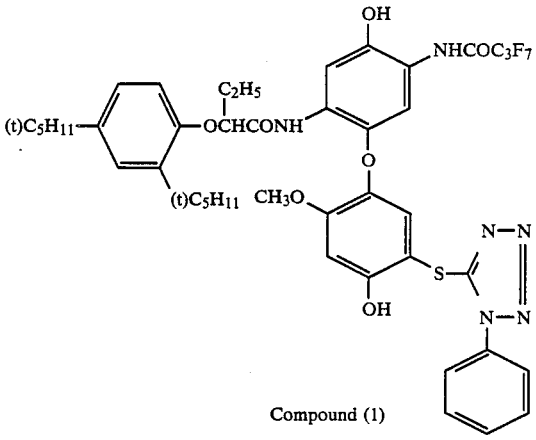

Compound (1)

Step (1): Synthesis of Compound (c)

62 g of Compound (b), 18 g of potassium hydroxide and 10 ml of water were added to 700 ml of toluene and the mixture was refluxed by heating for 1 hour under a nitrogen atmosphere. Then, water was distilled off together with toluene as an azeotropic mixture. To the residue was added 200 ml of N,N-dimethylformamide, the mixture was heated to 100° C., to which was added 57 g of Compound (a). After being reacted at 100° C. for 1 hour, the mixture was cooled to room temperature and ethyl acetate was added thereto. The mixture was put into a separatory funnel and washed with water. The ethyl acetate layer was separated and the solvent was distilled off under a reduced pressure to obtain 53 g of the oily residue containing Compound (c) as the main component.

Step (2): Synthesis of Compound (d)

53 g of Compound 3 obtained in Step (1) was dissolved in a solvent mixture of 400 ml of ethanol and 120 ml of water and 40 g of potassium hydroxide was added thereto. After refluxing by heating for 4 hours, the mixture was neutralized with hydrochloric acid and then separately extracted using ethyl acetate and water. The ethyl acetate layer was separated and the solvent was distilled off under a reduced pressure to obtain 43 g of the oily product containing Compound (d) as the main component.

Step (3): Synthesis of Compound (e)

43 g of Compound (d) obtained in Step (2) was dissolved in 300 ml of ethyl acetate and to the solution was added dropwise 69 g of anhydrous heptafluorobutyric acid at room temperature. After being reacted for 30 minutes, water was added to the mixture and washed with water using a separatory funnel. The oil layer was separated and the solvent was distilled off. The residue was treated with column chromatography in order to separate and purify the desired compound. Silica gel was used as a packing material and 2.5% ethanol was used as an eluent. 47 g of Compound 5 was obtained as the oil product.

Step (4): Synthesis of Compound (f)

47 g of Compound (e) obtained in Step (3), 36.3 g of iron powder and 10 ml of acetic acid were added to a solvent mixture of 40 ml of water and 400 ml of isopropanol, and the mixture was refluxed by heating for 1 hour. The reaction mixture was filtered while it was hot and the filtrate was concentrated to about half of the initial volume. The crystals thus-deposited were collected by filtration to obtain 44 g of Compound (f).

Step (5): Synthesis of Compound (g)

44 g of Compound (f) obtained in Step (4) was added to 400 ml of acetonitrile and refluxed by heating. 28 g of 2-(2,4-di-tert-amylphenoxy)butanoyl chloride was added dropwise thereto and the mixture was refluxed by heating for 30 minutes. Then, the mixture was cooled to room temperature, to which was added ethyl acetate and the mixture was washed with water using a separatory funnel. The oil layer was separated and the solvent was distilled off under a reduced pressure. The residue was recrystallized from acetonitrile to obtain 60 g of Compound 7.

Step (6): Synthesis of Compound (h)

69 g of Compound (g) obtained in Step (5) was added to 500 ml of dichloromethane, and the mixture was cooled to −10° C., to which was added dropwise 34.5 g of boron tribromide. After being reacted at −5° C. or below for 20 minutes, an aqueous solution of sodium carbonate was added to the mixture until the aqueous layer showed neutral. The mixture was put into a separatory funnel and washed with water. The oil layer was separated and the solvent was distilled off under reduced pressure. The residue was recrystallized from acetonitrile to obtain 45.2 g of Compound (h).

Step (7): Synthesis of Compound (1)

45.2 g of Compound (h) obtained in Step (6) was added to 600 ml of acetonitrile and to the mixture was added dropwise 100 ml of a chloroform solution containing 20.2 g of 1-phenyltetrazolyl-5-sulfenyl chloride at room temperature (25° C.). After adding ethyl acetate, the mixture was put into a separatory funnel and washed with water. The oil layer was separated and the solvent was distilled off. The residue was recrystallized from a solvent mixture of hexane and ethyl acetate to obtain 45.3 g of Compound (1).

SYNTHESIS EXAMPLE 2

Synthesis of Compound (28)

Compound (28) was synthesized in the same manner as described in Synthesis Example 1, except using 26.7 g of 1-ethoxycarbonylmethoxycarbonylmethyltetrazolyl-5-sulfenyl chloride in place of 20.2 g of 1-phenyltetrazolyl-5-sulfonyl chloride in Step (7). Further, the solvent for crystallization was changed to a solvent mixture of hexane and chloroform.

SYNTHESIS EXAMPLE 3

Synthesis of Compound (30)

Compound (30) was synthesized according to the route schematically shown below.

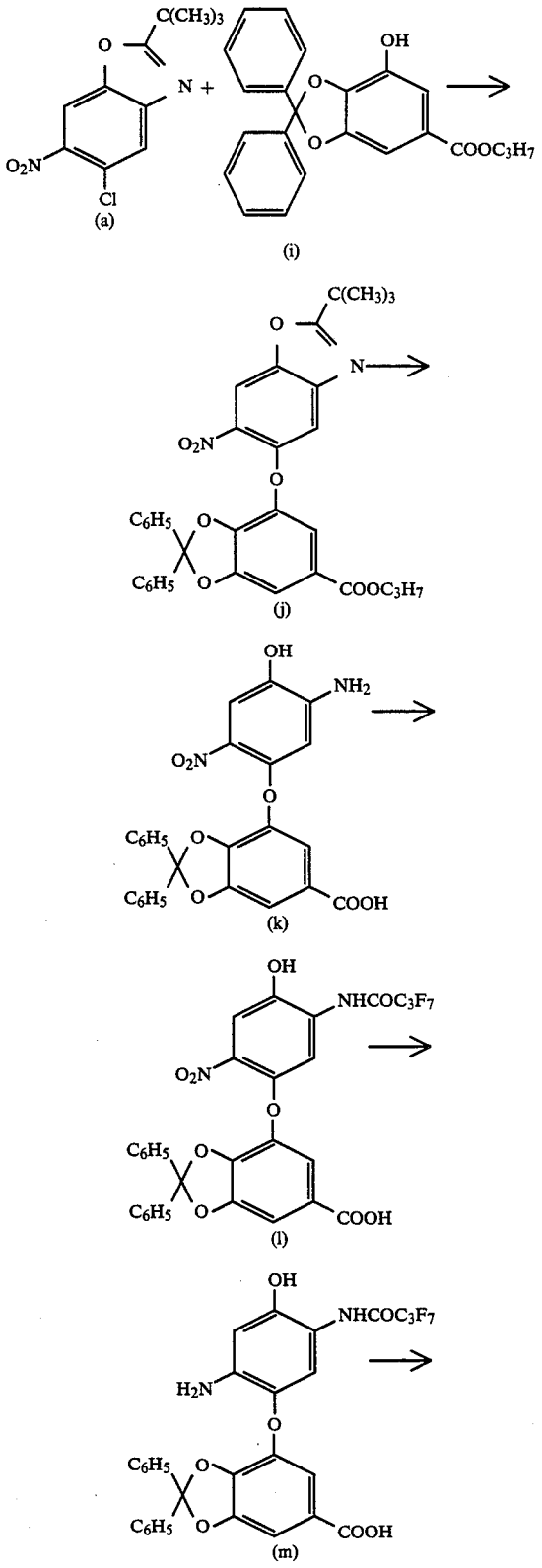

-continued

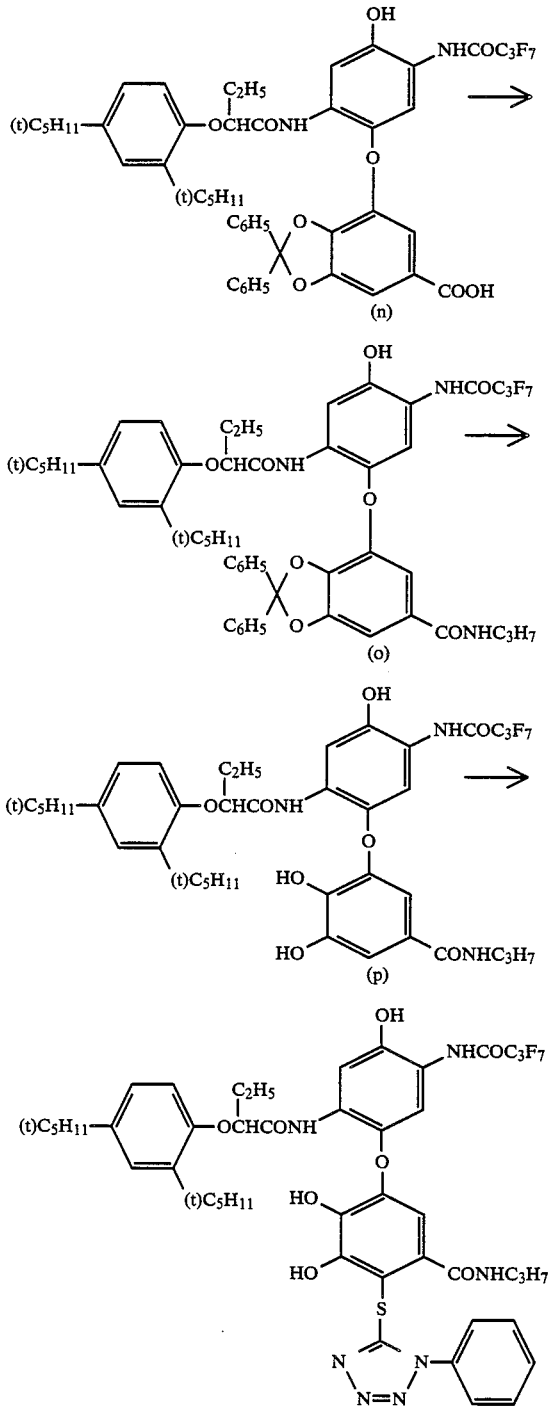

Compound (30)

Step (1): Synthesis of Compound (j)

147.7 g of Compound (i) (synthesized according to the method as described in J. Am. Chem. Soc., Vol. 81, page 4606 (1959)), 24.6 g of potassium hydroxide and 15 ml of water were added to 1 liter of toluene and the mixture was refluxed by heating for 1 hour. Water and toluene were distilled off as an azeotropic mixture. To the residue were added 500 ml of N,N-dimethylformamide, 70 g of Compound 1 and 0.5 g of cuprous chloride, and the mixture was reacted at 120° C. for 4 hours. After cooling to room temperature, 12 ml of hydrochloric acid, 150 ml of water and 500 ml of methanol were added thereto. The crystals thus-deposited were collected by filtration to obtain 120 g of Compound (j).

Step (2): Synthesis of Compound (k)

55.9 g of Compound (j) obtained in Step (1) was added to a solvent mixture of 300 ml of ethanol and 100 ml of water, and the solution was bubbled with nitrogen gas. To the solution was added 31.4 g of potassium hydroxide and the mixture was refluxed by heating for 6 hours. After cooling to room temperature, the mixture was neutralized with hydrochloric acid. 500 ml of ethyl acetate was added thereto and the mixture was put into a separatory funnel and washed with water. The oil layer was separated and the solvent was distilled off under reduced pressure to obtain 46.2 g of the residue.

Step (3): Synthesis of Compound (l)

46.2 g of Compound (k) obtained in Step (2) was dissolved in 500 ml of ethyl acetate and to the solution was added dropwise 47.3 g of anhydrous heptafluorobutyric acid at room temperature. After being reacted for 40 minutes at room temperature, an aqueous solution of sodium carbonate was added thereto to neutralize. The oil layar was washed with water in a separatory funnel and separated. The solvent was distilled off under a reduced pressure and to the residue was added chloroform. The crystals thus-deposited were removed by filtration and the filtrate was concentrated to obtain 52.5 g of Compound (l).

Step (4): Synthesis of Compound (m)

52.2 g of Compound (l) obtained in Step (3), 53 g of reduced iron, 3 g of ammonium chloride and 3 ml of acetic acid were added to a solvent mixture of 280 ml of isopropanol and 40 ml of water and the mixture was refluxed by heating for 1 hour. The reaction mixture was filtered while it was hot and the filtrate was concentrated under reduced pressure until the deposition of crystals were observed, followed by cooling. The crystals thus-deposited were collected by filtration to obtain 45.2 g of Compound (m).

Step (5): Synthesis of Compound (n)

45.2 g of Compound (m) obtained in Step (4) was added to 500 ml of acetonitrile and to the solution was added dropwise 28.3 g of 2-(2,4-di-tert-amylphenoxy)-butanoyl chloride under refluxing by heating. After being reacted under refluxing for 30 minutes, the mixture was cooled to room temperature, followed by addition of 500 ml of ethyl acetate and washing with water. The oil layer was separated and the solvent was distilled off under reduced pressure. The residue was recrystallized from a solvent mixture of ethyl acetate and n-hexane to obtain 56.7 g of Compound (n).

Step (6): Synthesis of Compound (o)

56.7 g of Compound (n) obtained in Step (5) was added to a solvent mixture of 250 ml of tetrahydrofuran, 250 ml of acetonitrile and 10 ml of N,N-dimethylformamide and to the solution was added dropwise 42.4 g of thionyl chloride at room temperature. After being reacted for 30 minutes, the solution was cooled to −10° C., to which was added dropwise 67.7 g of propylamine while maintaining the temperature below 0° C. After being reacted below 0° C. for 30 minutes, ethyl acetate was added to the solution and washed with water. The oil layer was separated and the solvent was distilled off under reduced pressure. The residue was recrystallized from a solvent mixture of ethyl acetate and hexane to obtain 45.2 g of Compound (o).

Step (7): Synthesis of Compound (p)

45.2 g of Compound 15 obtained in Step (6) was added to a solvent mixture of 300 ml of methanol and 15 ml of hydrochloric acid and the mixture was refluxed by heating for 1 hour. After cooling to room temperature, 200 ml of water was added thereto and the crystals thus-deposited were collected by filtration to obtain 28.6 g of Compound (p).

Step (8): Synthesis of Compound (30)

28.6 g of Compound (p) obtained in Step (7) was added to 600 ml of tetrahydrofuran, and the solution was cooled to −10° C., to which was added 4.6 g of aluminum chloride. To the solution was added dropwise 60 ml of a dichloromethane solution containing 8.8 g of 1-phenyltetrazolyl-5-sulfenyl chloride. After being reacted at −10° C. for 30 minutes, ethyl acetate, and water were added to the reaction mixture. The oil layer was separated using a separatory funnel and washed with water. The solvent was distilled off under a reduced pressure, and the residue was recrystallized from a solvent mixture of hexane and ethanol to obtain 24.9 g of Compound (30).

SYNTHESIS EXAMPLE 4

Synthesis of Compound (31)

Compound (31) was synthesized in the same manner as described in Synthesis Example 3 except using 16.8 g of 5-(4-methoxycarbonylphenoxycarbonylmethylthio)-1,3,4-thiadiazolyl-2-sulfenyl chloride in place of 8.8 g of 1-phenyltetrazolyl-5-sulfenyl chloride in Step (8).

SYNTHESIS EXAMPLE 5

Synthesis of Compound (73)

30.2 g of α-chloro-α-benzoyl-2-chloro-5-octadecyloxycarbonylacetanilide, 24.3 g of propyl ester of 2-{1-[2-(4-cyanophenoxycarbonyl)ethyl]tetrazolyl-5-thio}-3,4,5-trihydroxybenzoic acid and 6.9 g of potassium carbonate were added to a solvent mixture of 50 ml of N,N-dimethylformamide and 100 ml of toluene, and the mixture was reacted at 50° C. for 2 hours. After cooling to room temperature, the reaction mixture was put into a separatory funnel and washed successively with water, diluted hydrochloric acid, and then water. The oil layer was dried with anhydrous sodium sulfate. The solvent was distilled off under a reduced pressure and the residue was recrystallized from a solvent mixture of ethyl acetate and n-hexane to obtain desired Compound (73).

The compound represented by formula (I) used in the present invention is preferably incorporated into a light-sensitive silver halide emulsion layer or an adjacent layer thereto of the color light-sensitive material. The amount of the compound added is generally in a range from $1\times10^{-6}$ to $1\times10^{-3}$ mol/m$^2$, preferably from $3\times10^{-6}$ to $5\times10^{-4}$ mol/m$^2$, and more preferably from $1\times10^{-5}$ to $2\times10^{-4}$ mol/m$^2$.

The compound represented by formula (I) according to the present invention can be incorporated into the color light-sensitive material in a manner similar to conventional couplers as described hereinafter.

The water washing bath in the present invention is a bath having a main purpose of washing out the components of the processing solutions adhered to or contained in color light-sensitive materials, and the components of the color light-sensitive materials which should be removed therefrom in order to maintain photographic properties and stability of images formed after processing.

A stabilizing bath is a bath capable of imparting an image stabilizing function which can not be obtained by the water washing bath in addition to the function of the water washing bath described above. For example, a bath containing an aldehyde such as a formaldehyde, may impart such function.

The terminology "amount carried over from the preceding bath" means an amount of the preceding bath, which is adhered or contained in the color light-sensitive material and introduced into the water washing bath. The amount can be determined by immersing the color light-sensitive material collected just before the introduction thereof to the water washing bath in water, extracting the components in the preceding bath and measuring the amount of the components of the preceding bath.

In the present invention, the amount of replenishment to the water washing bath or the stabilizing bath substituted therefor is in a range from 2 to 50 times, preferably from 3 to 50 times, and more preferably from 5 to 30 times, of the amount carried over from the preceding bath per a unit area of the color light-sensitive material. When the amount of replenishment exceeds the 50 times, the superior property of the coupler according to the present invention is not exhibited and on the other hand, when the amount is not more than 2 times, the function of water washing is not achieved and stain occurs in the color light-sensitive material.

The pH of the water washing bath or the stabilizing bath is generally from 4 to 10, preferably from 5 to 9, and more preferably from 6.5 to 8.5.

It is preferred to employ water which is subjected to water softening treatment as washing water or a stabilizing solution. The water softening treatment can be carried out by a method using an ion exchange resin or a reverse permeation device.

As an ion exchange resin, a sodium type strong acidic cationic exchange resin in which a counter ion of an exchange group is a sodium ion is preferred. As a resin substratum, a copolymer of styrene, divinylbenzene, etc.) is preferred. Particularly, a copolymer in which an amount of divinylbenzene is from 4 to 16% by weight based on the total weight of monomers used in the preparation thereof is preferred. Suitable examples of ion exchange resins include Diaion SK-1B, Diaion PK-216 (tradmark for product manufactured by Mitsubishi Chemical Industries Ltd.), etc.

Various reverse permeation devices can be employed. A device using a cellulose acetate or polyethersulfone film is suitably used. A device having pressure of 20 kg/cm$^2$ or less is preferably used because of its low noise.

With the water in which the amount of calcium or magnesium is reduced using an ion exchange resin or a reverse permeation device, the propagation of bacteria or molds is controlled, and thus preferred results can be obtained by using in combination with the method of the present invention.

According to a preferred embodiment, at least one cheloting agent selected from an aminocarboxylic acid, an aminophosphonic acid, a phosphonic acid, a phosphonocarboxylic acid and a salt thereof is added to the washing water or the stabilizing solution in an amount of from $5\times10^{-4}$ to $1\times10^{-2}$ mol per liter of the water or solution.

Specific examples of these aminocarboxylic acids, aminophosphonic acids, phosphonic acids, and phosphonocarboxylic acids are set forth below.

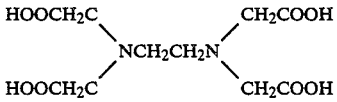
A-1

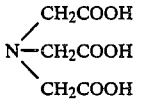
A-2

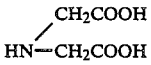
A-3

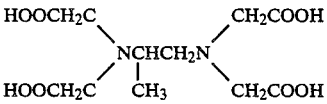
A-4

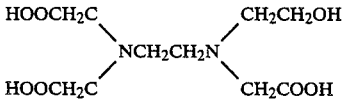
A-5

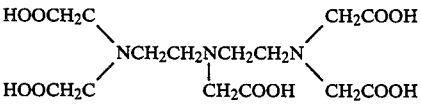
A-6

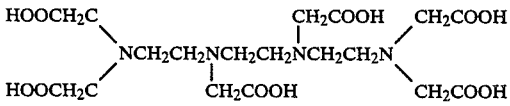
A-7

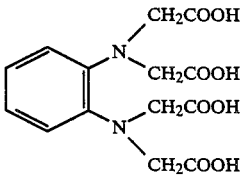
A-8

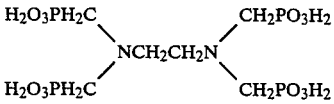
A-9

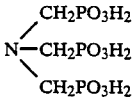
A-10

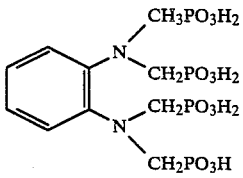
A-11

-continued

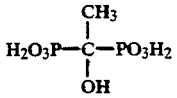
A-12

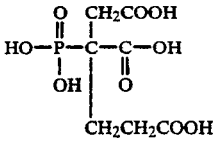
A-13

Useful salts for aminocarboxylic acids, amino-phosphonic acids, phosphonic acids or phosphonocarboxylic acids include a sodium salt, a potassium salt, a calcium salt, an ammonium salt, a magnesium salt, etc. Particularly, a sodium salt and a potassium salt are preferred.

The amount of amino carboxylic acid, aminophosphonic acid, phosphonic acid, phosphonocarboxylic acid or salt thereof to be incorporated into at least the final tank of the tanks constituting the water washing bath is from $5\times10^{-4}$ to $1\times10^{-2}$, preferably from $6\times10^{-4}$ to $5\times10^{-3}$ mol per liter of the water or solution. When the amount used is smaller than $5\times10^{-4}$ mol per liter, the effect of the compound can not be attained and on the other hand, the use of the amount exceeds $1\times10^{-2}$ mol per liter may lead to undesirable results in that deposits occur on the surface of the color light-sensitive material after drying and in that stickiness and adhesion of scum occur.

Further, it is preferred to add an isothiazoline type antibiotic to the washing water or the stabilizing solution. Specific examples of useful antibiotics are set forth below.

(1) 2-Methyl-4-isothiazolin-3-one
(2) 5-Chloro-2-methyl-4-isothiazolin-3-one
(3) 2-Methyl-5-phenyl-4-isothiazolin-3-one
(4) 4-Bromo-5-chloro-2-methyl-4-isothiazolin-3-one
(5) 2-Hydroxymethyl-4-isothiazolin-3-one
(6) 2-(2-Ethoxyethyl)-4-isothiazolin-3-one
(7) 2-(N-Methylcarbamoyl)-4-isothiazolin-3-one
(8) 5-Bromomethyl-2-(N-dichlorophenylcarbamoyl)-4-isothiazolin-3-one
(9) 4-Methyl-2-(3,4-dichlorophenyl)-4-isothiazolin-3-one
(10) 4-Methyl-2-(3,4-dichlorophenyl)-4-isothiazolin-3-one The antibiotic is employed in a range from 1 to 100 mg per liter, preferably from 3 to 30 mg per liter of the washing water or the stabilizing solution.

The above described water softening method using an ion exchange resin or a reverse permeation device, chelating agent such as an aminopolycarboxylic acid and isothiazolin type antibiotic can be employed in combination in order to effectively achieve their objects.

Moreover, irradiation with ultraviolet rays of at least one of the replenishing tanks and processing tanks for water washing or stabilizing is also a preferred embodiment for the purpose of controlling the propagation of bacteria or molds. In order to irradiate with ultraviolet rays, a method may be used in which ultraviolet rays are irradiated from outside of tanks, or a method may be used in which ultraviolet rays are irradiated in the water or solution by setting a waterproof type ultraviolet lamp in the replenishing tank or processing tank or its circulation system.

Various kinds of compounds may be added to the water washing bath or the stabilizing bath according to the present invention in addition to the above described materials. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., which can be used in combinations, also) in order to adjust pH of layers. Further, various additives such as a fluorescent brightening agent, a hardening agent, a metal salt, etc., may be employed. Two or more compounds for the same purpose or different purposes may be employed together.

Furthermore, it is possible to add various ammonium salts such as ammonium chloride, ammonium nitrate, ammonium sulfate, ammonium phosphate, ammonium sulfite, ammonium thiosulfate, etc., as pH adjusting agents for layers after development processing.

In the case wherein the preceding bath is a bath having a fixing function, a fixing agent component, for example, a thiosulfate is carried over into the water washing or stabilizing bath, and, as a result, a sulfidation phenomenon may occur. In order to prevent the sulfidation, a sulfite such as sodium sulfite, potassium sulfite, ammonium sulfite, etc., can be added to the water or solution.

Further, it is a preferred embodiment to employ a sulfanylamide, a benzotriazole, etc., for the purpose of preventing the propagation of bacteria in the water washing or stabilizing bath as disclosed in U.S. Pat. No. 4,590,150 and EP-A-204197, respectively.

The processing time for the water washing or stabilizing water can be varied depending on purposes and kinds of color light-sensitive materials, but is usually from 10 seconds to 10 minutes, and preferably from 20 seconds to 5 minutes. The temperature of the water washing or stabilizing bath is usually from 20° C. to 45° C., preferably from 25° C. to 40° C. and particularly preferably from 30° C. to 40° C.

It is preferred in the present invention that the water washing or stabilizing bath is composed of a multistage countercurrent process using two or more tanks in view of saving with respect to the amount of replenishment required.

To the stabilizing bath, a component capable of imparting an image stabilizing effect which does not obtain by the water washing step is further added. For example, an aldehyde compound such as formalin (37 wt% formaldehyde solution), etc., can be employed for this purpose.

In the present invention, it is preferred to incorporate a p-hydroxybenzoic acid ester into the color light-sensitive material.

Useful p-hydroxybenzoic acid esters are represented by formula (PHB)

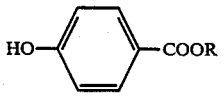

(PHB)

wherein R represents an alkyl group, a substituted alkyl group, an aralkyl group or a substituted aralkyl group each having from 1 to 18 carbon atoms in total.

Examples of the substituents for the alkyl group or the aralkyl group include an aryl group (for example, a phenyl group, etc.), a nitro group, a hydroxy group, a cyano group, a sulfo group, an alkoxy group (for example, methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), or a sulfonyl group (for example, a methylsulfonyl group, etc.), etc. When two or more substituents are present, they may be the same or different.

Preferred group for R is an unsubstituted alkyl group, and particularly a methyl group, an ethyl group, an n-propyl group or an n-butyl group is preferred; n-Butyl group is most preferred.

The p-hydroxybenzoic acid ester used in the present invention can be easily synthesized according to a conventional ester synthesis method. More specifically, p-oxybenzoic acid, an alcohol and sulfuric acid are heated at 70° to 80° C. After the reaction, the mixture is allowed to cool and the ester thus-deposited was decolorized and recrystallized from ethanol. Further, commercial products can be easily obtained.

The p-hydroxybenzoic acid ester can be added to any layer of the color light-sensitive material.

The amount of the p-hydroxybenzoic acid ester to be added is from 0.001 g to 0.05 g, preferably from 0.005 g to 0.02 g per square meter of the color light-sensitive material. The p-hydroxybenzoic acid ester may be added to the color light-sensitive material by dissolving it to a solvent which does not affect on the photographic properties (for example, water, methanol, ethanol, ethyl acetate, etc.) or directly as powder at any stage of the production of the color light-sensitive material.

In the photographic emulsion layers of the color light-sensitive material used in the present invention, any of silver bromide, silver iodobromide, silver iodochlorobromide, silver chlorobromide and silver chloride may be used as the silver halide. A preferred silver halide is silver iodobromide or silver iodochlorobromide each containing about 30 mol% or less of silver iodide. Silver iodobromide containing from 2 mol% to 25 mol% of silver iodide is particularly preferred.

Silver halide grains in the photographic emulsion may have a regular crystal structure, for example, a cubic, octahedral or tetradecahedral structure, etc., an irregular crystal structure, for example, a spherical structure, etc., a crystal defect, for example, a twin plane, etc., or a composite structure thereof.

A grain size of silver halide may be varied, and includes from fine grains having a diameter of 0.1 micron or less to large size grains having a diameter of 10 microns or more, based on the projected area of the particles, described in more detail below. Further, a monodisperse emulsion having a narrow grain size distribution, or a polydisperse emulsion having a broad grain size distribution may be used.

The photographic emulsion used in the present invention can be prepared in any suitable manner, for example, by the methods as described in P. Glafkides, *Chimie*

*et Physique Photographique,* Paul Montel (1967) pages 329–425; G. F. Duffin, *Photographic Emulsion Chemistry,* The Focal Press (1966) pages 57–82; and V. L. Zelikman et al., *Making and Coating Photographic Emulsion,* Focal Press (1964) pages 69–87, etc. That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide grains are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

Silver halide emulsions composed of regular grains as described above can be obtained by controlling pAg and pH during the step of formation of silver halide grains. The detail thereof are described, for example, in *Photographic Science and Engineering,* Vol. 6, pages 159 to 165 (1962), *Journal of Photographic Science,* Vol. 12, pages 242 to 251 (1964), U.S. Pat. No. 3,655,394, and British Pat. No. 1,413,748, etc.

Representative monodisperse emulsions are those comprising silver halide grains having an average grain diameter of about 0.1 micron or more and at least about 95% by weight of the total silver halide grains having a diameter within the range of ±40% of the average grain diameter. In the present invention, it is possible to employ a monodisperse emulsion comprising silver halide grains having an average grain diameter of from about 0.25 microns to 2 microns and at least about 95% by weight or by number of particles of the total silver halide grains having a diameter within the range of ±20% of the average grain diameter. Methods for preparation of such monodisperse emulsions are described in U.S. Pat. Nos. 3,574,628 and 3,655,394, British Pat. No. 1,413,748, etc. Further, monodisperse emulsions as described in Japanese patent application (OPI) Nos. 8600/73, 39027/76, 83097/76, 137133/78, 48521/79, 99419/79, 37635/83 and 49938/83, etc., are preferably employed in the present invention.

By utilizing tabular silver halide grains in the silver halide photographic emulsion used in the present invention, increases in sensitivity, including increases in spectral sensitizing efficiency with a sensitizing dye, improvement in the relationship between sensitivity and graininess, improvement in sharpness, improvement in a development proceeding property, increase in covering power, and improvement in crossover, etc., can be achieved.

The tabular silver halide grains used in the present invention are those having a diameter/thickness ratio of 5 or more (i.e., 5/1 or more), for example, those having a ratio of more than 8 and those having a ratio of from 5 to 8, etc.

Here, the term "diameter" of silver halide grains as used herein means a diameter of a circle which has an area equal to the projected area of the grain. In the present invention, the diameter of tabular silver halide grains is in a range of from 0.3 to 5.0 μm, preferably from 0.5 to 3.0 μm.

Further, the thickness of tabular silver halide grains is generally 0.4 μm or less, preferably 0.3 μm or less, and more preferably 0.2 μm or less.

Generally, the tabular silver halide grain is a plate having two parallel faces. Accordingly, the term "thickness" as used in the present invention is represented by a distance between the two parallel faces composing the tabular silver halide grain.

It is possible to use tabular silver halide grains in which the grain diameter and/or thickness in silver halide grains is a mono disperse state according to a method as described in Japanese Patent Publication No. 11386/72, etc.

The term "monodispersed" tabular grain silver halide emulsion as used herein means a tabular grain silver halide emulsion in which at least 95% of the total silver halide grains have a size within the range of ±40% of the number average grain size. The number average grain size means a number average diameter calculated from the diameters of projected areas of silver halide grains.

With respect to the proportion of tabular silver halide grains in the silver halide emulsion containing tabular silver halide grains used in the present invention, it is desired that tabular silver halide grains occupy 50% or more, more preferably 70% or more, and particularly preferably 90% or more, based on the total projected area of silver halide grains contained in the emulsion.

The halogen composition of the tabular silver halide grains is preferably silver bromide, silver iodobromide, silver chlorobromide, silver chloroiodobromide, silver chloride or silver iodochloride. For use in a high speed color light-sensitive material, silver iodochloride is particularly preferred. The content of silver iodide in silver iodochloride is usually 40 mol% or less, preferably 20 mol% or less, and more preferably 15 mol% or less. On the other hand, silver chlorobromide or silver bromide is particularly preferred in the case of color light-sensitive materials for print.

The tabular silver halide grains may have uniform halogen composition or may be composed of two or more phases having different halogen compositions. For example, in the case of silver iodobromide, tabular silver iodobromide grains having a layered structure composed of plural phases having an iodide content different from each other can be used.

Preferred examples of the halogen composition and halogen distribution in grains of the tabular silver halide grains are described in Japanese patent application (OPI) Nos. 113928/83 and 99433/84, etc. Generally speaking, it is desirable to select the optimum relationship of a relative content of iodide contained in each phase of tabular silver halide grains depending on a kind of development processing applied to the color light-sensitive material containing these tabular silver halide grains (for example, an amount of a silver halide solvent present in a developing solution, etc.).

The tabular silver halide grains may be junction type silver halide crystals in which crystals of an oxide such as lead oxide are connected with crystals of silver halide such as silver chloride, or silver halide crystals upon epitaxial growth (for example, crystals prepared by epitaxial growth of silver chloride, silver iodobromide, silver iodide, etc., on silver bromide crystals, crystals prepared by epitaxial growth of silver chloride, silver bromide, silver iodide, silver chloroiodobromide on hexagonal or octahedral silver iodide crystals), etc.

Examples of these grains are described in U.S. Pat. Nos. 4,435,501 and 4,463,087, etc.

With respect to the site of latent image formation, either grains in which latent images are formed mainly on the surface thereof or grains in which latent images are formed mainly in the interior thereof can be employed. This is appropriately selected depending on the use of the color light-sensitive material in which the tabular silver halide grains are employed, or the depth of latent images in the grains which can be developed with a developing solution used in processing of the color light-sensitive material.

Preferred methods for using the tabular silver halide grains are described in detail in *Research Disclosure,* No. 22534 (January, 1983) and *ibid.,* No. 25330 (May, 1985). In the cited literature, for example, a method for using tabular grains based on the relation between the thickness of tabular grains and the optical property thereof is described.

Crystal structure of silver halide grains may be uniform, composed of different halide compositions between the inner portion and the outer portion, or may have a layer structure. Examples of such emulsion grains are described in British Pat. No. 1,027,146, U.S. Pat. Nos. 3,505,068 and 4,444,877, and Japanese patent application (OPI) No. 141,733/85, etc.

Further, silver halide emulsions in which silver halide grains having different compositions are connected upon epitaxial junctions or silver halide emulsion in which silver halide grains are connected with compounds other than silver halide such as silver thiocyanate, lead oxide, etc., may also be employed. Examples of these emulsion grains are described in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese patent application (OPI) No. 162540/84, etc.

Moreover, a mixture of grains having various crystal forms may be employed.

In order to accelerate ripening of silver halide grains, silver halide solvents are useful. For example, it is known that an excess amount of halogen ions is supplied to a reaction vessel for the purpose of facilitating the ripening. Therefore, it is apparent that the ripening can be facilitated simply by introducing a solution of halide into the reaction vessel. Other ripening agents can also be employed. These ripening agents can be wholly provided to a dispersing medium in the reaction vessel before the addition of a silver salt and a halide or they may be introduced to the reaction vessel together with one or more of a silver salt, a halide and a deflocculating agent. In another embodiment, the ripening agent may be introduced independently at the stage of addition of a silver salt and a halide.

Examples of ripening agents to be used other than the halogen ions, include ammonia, amine compounds, thiocyanates, for example, alkali metal thiocyanates, particularly sodium thiocyanate and potassium thiocyanate, and ammonium thiocyanate. The use of thiocyanate type ripening agents is described in U.S. Pat. Nos. 2,222,264, 2,448,534, 3,320,069, etc. Further, conventional thioether type ripening agents as described in U.S. Pat. Nos. 3,271,157, 3,574,628 and 3,737,313, etc. can be employed. Moreover, thione compounds as described in Japanese patent application (OPI) Nos. 82408/78 and 144319/78 can be used.

Properties of silver halide grains can be controlled by means of the presence of various compounds at the stage of formation of silver halide grains. Such compounds can be provided initially in the reaction vessel. Further, they may be added to the reaction vessel together with one or more of salts. Characteristics of silver halide grains can be controlled by the presence of the compounds such as compounds of copper, iridium, lead, bismuth, cadmium, zinc, chalcogen (such as sulfur, selenium and tellurium, etc.), gold and noble metal of the group VIII in the Periodic Table as described in U.S. Pat. Nos. 2,448,060, 2,628,167, 3,737,313 and 3,772,031, *Research Disclosure,* Vol. 134, No. 13452 (June, 1975), etc. The silver halide emulsion can be subjected to reduction sensitization in the interior of grains at the stage of formation of grains as described in Japanese Patent Publication No. 1410/83 and Moisar et al, *Journal of Photographic Science,* Vol. 25, pages 19 to 27 (1977).

The silver halide emulsion is usually chemically sensitized. The chemical sensitization can be carried out using active gelatin as described in T. H. James, *The Theory of the Photographic Process,* 4th ed., pages 67 to 76 (The Macmillan Co., 1977). Further, the chemical sensitization can be conducted using a sensitizer such as sulfur, selenium, tellurium, gold, platinum, palladium, iridium or a combination of two or more thereof at pAg of 5 to 10, pH of 5 to 8 and temperature of 30° to 80° C. as described in *Research Disclosure,* Vol. 120, No. 12008 (April, 1974), *ibid.,* Vol. 134, No. 13452 (June, 1975), U.S. Pat. Nos. 2,642,361, 3,297,446, 3,772,031, 3,857,711, 3,901,714, 4,266,018 and 3,904,415, British Pat. No. 1,315,755, etc. Suitable chemical sensitization is conducted in the presence of a gold compound and a thiocyanate compound or in the presence of a sulfur containing compound as described in U.S. Pat. Nos. 3,857,711, 4,266,018 and 4,054,457 or a sulfur containing compound such as hypo, a thiourea type compound, a rhodanine type compound, etc.

The chemical sensitization may be carried out in the presence of a chemical sensitizing assistant. Examples of the chemical sensitizing assistants to be employed include compounds which are known as compounds for preventing fog during the chemical sensitization step and increasing sensitivity, such as azaindene, azapyridazine, azapyrimidine, etc. Examples of chemical sensitizing assistant modifiers are described in U.S. Pat. Nos. 2,131,038, 3,411,914 and 3,554,757, Japanese patent application (OPI) No. 126526/83; and G. F. Duffin, *Photographic Emulsion Chemistry,* pages 138 to 143 (The Focal Press, 1966), etc.

In addition to or in place of the chemical sensitization, reduction sensitization using hydrogen as described in U.S. Pat. Nos. 3,891,446 and 3,984,249, etc., reduction sensitization using a reducing agent such as stanous chloride, thiourea dioxide, a polyamine, etc. as described in U.S. Pat. Nos. 2,518,698, 2,743,182 and 2,743,183, etc., or reduction sensitization using treatment at low pAg (for example, pAg of less than 5) and/or high pH (for example, pH of more than 8) can be conducted.

Moreover, spectral sensitivity can be improved using the chemical sensitization as described in U.S. Pat. Nos. 3,917,485, 3,966,476, etc.

The silver halide photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. Furthermore, the carbon atoms of these nuclei can be substituted with groups ther than hydrogen.

The merocyanine dye and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidone-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those as described in U.S. Pat. Nos. 2,933,390 and 3,635,721), aromatic organic acid-formaldehyde condensates (e.g., those as described in U.S. Pat. No. 3,743,510), cadmium salts, azaindene compounds, and the like, can be present. The combinations as described in U.S. Pat. Nos. 3,615,613, 3,615,641, 3,617,295 and 3,635,721, etc. are particularly useful.

The spectral sensitization of the silver halide emulsion according to the present invention can be carried out at any stage of the preparation thereof.

In general, spectral sensitizing dyes are added to the emulsion chemically sensitized before coating of the emulsion. For example, the method wherein spectral sensitizing dyes are added to the emulsion before or during chemical sensitization as described in U.S. Pat. No. 4,425,426, etc., may be employed. Further, the method in which spectral sensitizing dyes are added to the emulsion before the completion of the formation of silver halide grains, as described in U.S. Pat. Nos. 2,735,766, 3,628,960, 4,183,756, 4,225,666, etc., may be used. Particularly, according to the method in which spectral sensitizing dyes are added to the emulsion after the formation of stable nuclei in the step of formation of silver halide grains as described in U.S. Pat. Nos. 4,183,756 and 4,225,666, the increase in photographic sensitivity and the intensified adsorption of spectral sensitizing dyes on silver halide grains are advantageously obtained.

Known photographic additives which can be used in the present invention are described in the above-mentioned *Research Disclosure* and concerned items thereof are summarized in the table below.

| Additive | RD 17643 | RD 18716 |
|---|---|---|
| 1. Chemical sensitizers | Page 23 | Page 648, right column |
| 2. Sensitivity increasers | | " |
| 3. Spectral sensitizers and supersensitizers | Pages 23 and 24 | Page 648, right column to page 649, right column |
| 4. Brightening agents | Page 24 | |
| 5. Fogging agents and stabilizers | Pages 24 and 25 | Page 649, right column |
| 6. Light absorbers and filter dye ultraviolet absorbers | Pages 25 and 26 | Page 649, right column to page 650, left column |
| 7. Stain preventive agents | Page 25, right column | Page 650, left column to light column |
| 8. Dye image stabilizers | Page 25 | |
| 9. Hardeners | Page 26 | Page 651, left column |
| 10. Binders | Page 26 | " |
| 11. Plasticizers and lubricants | Page 27 | Page 650, right column |
| 12. Application aids and surface active agents | Pages 26 and 27 | " |
| 13. Antistatic agents | Page 27 | " |

The photographic emulsion layer of the color light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development. For example, those as described in U.S. Pat. Nos. 2,400,532, 2,423,549, 2,716,062, 3,617,280, 3,772,021 and 3,808,003, British Pat. No. 1,488,991, etc. may be employed.

The photographic silver halide emulsion used in the present invention may include various compounds for the purpose of preventing fog formation or of stabilizing photographic performance in the photographic light-sensitive material during the production, storage, or photographic processing thereof. For example, those compounds known as antifoggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxy-substituted (1,3,3a,7)tetraazaindenes), pentaazaindenes, etc., benzenethiosulfonic acids; benzensulfinic acids; benzenesulfonic amides; etc.

Various color couplers can be employed in the present invention. The term "color couplers" as used herein refers to the compound capable of forming dyes upon the coupling reaction with the oxidation products of aromatic primary amine developing agents. Typical examples of useful color couplers include naphthol or phenol type compounds, pyrazolone or pyrazoloazole type compounds and open-chain or heterocyclic ketomethylene type compounds. Specific examples of utilizable cyan, magenta and yellow couplers in the present invention are described in the patents cited in *Research Disclosure,* No. 17643, VII-D (December, 1978) and ibid., No. 18717 (November, 1979).

It is preferable that these couplers which are incorporated into color light-sensitive materials are diffusion resistant by means of containing a ballast group or being polymerized. It is also preferred that the coupling active position of these couplers is substituted with a group capable of being released (two-equivalent couplers) than with a hydrogen atom (four-equivalent couplers) from the standpoint that the coating amount of silver is reduced. Further, couplers which forms dyes having an appropriate diffusibility, non-color forming couplers, or couplers capable of releasing development inhibitors (DIR couplers) or development accelerators accompanying with the coupling reaction can be employed.

As typical yellow couplers used in the present invention, oil protected acylacetamide type couplers are exemplified. Specific examples thereof are described in U.S. Pat. Nos. 2,407,210, 2,875,057 and 3,265,506, etc. In the present invention, two-equivalent yellow couplers are preferably employed and typical examples thereof include yellow couplers of oxygen atom releasing type as described in U.S. Pat. Nos. 3,408,194, 3,447,928, 3,933,501 and 4,022,620, etc. and yellow couplers of nitrogen atom releasing type as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of dyes formed, and α-benzylacetanilide type couplers are characterized by providing a high color density.

As magenta couplers used in the present invention, oil protected indazolone type couplers, cyanoacetyl type couplers, and preferably 5-pyrazolone type couplers and pyrazoloazole type couplers such as pyrazolotriazoles are exemplified. Of 5-pyrazolone type couplers, those substitutes with an arylamine group or an acylamino group at the 3-position thereof are preferred in view of hue and a color density of dyes formed. Typical examples thereof are described in U.S Pat Nos. 2,311,082, 2,343,703, 2,600,788, 2,908,573, 3,062,653, 3,152,896 and 3,936,015, etc. Two-equivalent 5-pyrazolone type couplers are preferably used. Particularly, nitrogen atom-releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Pat. No. 73,636 are advantageous because they provide a high color density.

Examples of pyrazoloazole type couplers include pyrazolobenzimidazoles as described in U.S. Pat. No. 3,061,432, and preferably pyrazolo[5,1-c][1,2,4]triazoles as described in U.S. Pat. No. 3,725,067, pyrazolotetrazoles as described in *Research Disclosure* No. 24220 (June, 1984) and Japanese Patent Application (OPI) No. 33552/85 and pyrazolopyrazoles as described in *Research Disclosure,* No. 24230 (June, 1984) and Japanese Patent Application (OPI) No. 43659/85. Imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of less yellow subsidiary absorption and light fastness of dyes formed.

As cyan couplers used in the present invention, oil protected naphthol type and phenol type couplers are exemplified. Typical examples thereof include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat Nos. 2,369,929, 2,801,171, 2,772,162 and 2,895,826, etc.

Cyan couplers fast to humidity and temperature are preferably used in the present invention. Typical examples thereof include phenol type cyan couplers having an alkyl group more than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,344,011 and 4,327,173, West German Patent Application (OLS) No. 3,329,729, European Pat. No. 121,365, etc., and phenol type couplers having a phenylureido group at the 2-position thereof and an acylamino group at the 5-position thereof as described in U.S. Pat. Nos. 3,446,622, 4,333,999, 4,451,559 4,427,767, etc. Further, naphthol type cyan couplers having a sulfonamido group, an amido group, etc., at the 5-position thereof as described in EP-A-161,626, etc., are excellent in fastness of color image formed therefrom and preferably used in the present invention.

It is preferred to use colored couplers together in color negative photographic light-sensitive materials for photography in order to correct undesirable absorptions in shorter wavelength regions, which dyes formed magenta couplers and cyan couplers typically have. Typical examples include yellow-colored magenta couplers as described in U.S. Pat. No. 4,163,670, Japanese Patent Publication No. 39413/82, etc. and magenta-colored cyan couplers as described in U.S. Pat. Nos. 4,004,929 and 4,138,258, British Pat. No. 1,146,368, etc.

Further, couplers capable of forming appropriately diffusible dyes can be used together in order to improve graininess. Specific examples of such smearing types of magenta couplers are described in U.S. Pat. No. 4,366,237 and British Pat. No. 2,125,570, etc. and those of yellow, magenta and cyan couplers are described in European Pat. No. 96,570, West German Patent Application (OLS) No. 3,234,533, etc.

These dye forming couplers and special couplers described above may be used in the form of polymers including dimers or more. Typical examples of dye forming polymer couplers are described in U.S. Pat. Nos. 3,451,820 and 4,080,211, etc. Specific examples of magenta polymer couplers are described in British Pat. No. 2,102,173 U.S. Pat. No. 4,367,282, Japanese Patent Application (OPI) No. 232455/86, etc.

Two or more kinds of various couplers which can be used in the present invention can be incorporated together into the same layer for the purpose of satisfying the properties required of the color light-sensitive material, or the same compound can be incorporated into different two or more layers.

The color couplers are generally employed in an amount of from 0.001 mol to 1 mol per mol of light-sensitive silver halide contained in a layer to be added. It is preferred that the amounts of yellow couplers, magenta couplers, and cyan couplers used are in ranges of from 0.01. mol to 0.5 mol, 0.003 mol to 0.3 mol, and 0.002 mol to 0.3 mol per mol of light-sensitive silver halide, respectively.

The color light-sensitive material of the present invention may contain couplers capable of releasing a development inhibitor, i.e., so-called DIR couplers.

Examples of DIR couplers that can be used in the present invention include those which release a heterocyclic mercapto type development inhibitor as described in U.S. Pat. No. 3,227,554, etc., those which release a benzotriazole derivative as a development inhibitor as described in Japanese Patent Publication No. 9942/83, etc., so-called non-color forming DIR couplers as described in Japanese Patent Publication No. 16141/76, etc., those which release a nitrogen-containing heterocyclic development inhibitor upon decomposition of methylol after cleavage as described in Japanese Patent Application (OPI) No. 90932/77, those which release a development inhibitor upon intramolecular nucleophilic reaction cleavage as described in U.S. Pat. No. 4,248,962, and Japanese Patent Application (OPI) No. 56837/82, those which release a development inhibitor upon electron transfer via a conjugated system after cleavage as described in Japanese Patent Application (OPI) Nos. 114946/81, 154234/82, 188035/82, 98728/83, 209736/83, 209737/83, 209738/83, 209739/83 and 209740/83, etc., those which release a diffusible development inhibitor which deactivate its development inhibiting function in a developing solution as described in Japanese Patent Application (OPI) Nos. 151944/82 and 217932/83, etc., and those which release a reactive compound which reacts in a layer during development to form a development inhibitor or to deactivate a development inhibitor as described in Japanese Patent Application (OPI) Nos. 182438/85 and 184248/85, etc. Of these DIR couplers described above, those of deactivation type in a developing solution as represented by Japanese Patent Application (OPI) No. 151044/82, those of timing type as represented by U.S. Pat. No. 4,248,962 and Japanese Patent Application (OPI) No. 154234/82 and those of reactive type as represented by Japanese Patent Application (OPI) No. 184248/85 are preferred to use in combination of the present invention. Further, DIR couplers of deactivation type in a developing solution as described in Japanese Patent Application (OPI) Nos. 151944/82, 217932/83, 218644/85, 225156/85, 233650/85, etc., and DIR couplers of reactive type as described in Japanese Patent Application (OPI) No. 184248/85, etc., are particularly preferred.

In the color light-sensitive material of the present invention, compounds which release imagewise a nucleating agent, a development accelerator or a precursor thereof (hereinafter referred to as a "development accelerator", etc.) ad proceeding of development can be employed. Typical examples of these compounds are couplers which release a development accelerator, etc., upon the coupling reaction with the oxidation products of aromatic primary amine development agents, that is, DAR couplers as described in British Pat. Nos. 2,097,140 and 2,131,188, etc.

DAR couplers capable of releasing a development accelerator, etc. which has an adsorbing group with respect to silver halide are preferred. Specific examples of such DAR couplers are described in Japanese Patent Application (OPI) Nos. 157638/84 and 170840/84, etc. DAR couplers capable of releasing an N-acyl-substituted hydrazine which is released from the coupling active position of a photographic coupler at its sulfur atom or the nitrogen atom and which has a mono-cyclic or condensed heterocyclic ring as an adsorbing group are particularly preferred. Specific examples of these DAR couplers are described in Japanese Patent Application (OPI) No. 128446/85, etc.

Compounds having a development accelerator portion in a coupler residual group thereof as described in Japanese Patent Application (OPI) No. 37556/85 or compounds capable of releasing a development accelerator upon the oxidation reduction reaction with developing agents as described in Japanese Patent Application (OPI) No. 107029/85 may also be employed in the color light-sensitive material of the present invention.

DAR couplers are preferably incorporated into a light-sensitive silver halide emulsion of the color light-sensitive material of the present invention. Further, it is preferred to incorporate substantially light-insensitive silver halide grains into at least one photographic constituting layer as described in Japanese Patent Application (OPI) Nos. 172640/84, and 128429/85, etc.

The color light-sensitive material used in the present invention may contain hydroquinone derivatives, aminophenol derivatives, amines, gallic acid derivatives, catechol derivatives, ascorbic acid derivatives, noncolor-forming couplers, sulfonamidophenol derivatives, etc., as color fog preventing agents or color mixing preventing agents.

In the color light-sensitive material used in the present invention, various know color fading preventing agents can be employed. Typical examples of known color fading preventing agents include hindered phenols, for example, hydroquinones, 6-hydroxychromans, 5-hydroxycoumarans, spirochromans, p-alkoxyphenols, bisphenols, etc., gallic acid derivatives, methylendioxybenzenes, aminophenols, hindered amines, or ether or ester derivatives thereof derived from each of these compounds by sililation or alkylation of the phenolic hydroxy group thereof. Further, metal complexes represented by (bis-salicylaldoxymate) nickel complexes and (bis-N,N-dialkyldithiocarbamate) nickel complexes may be employed.

The color light-sensitive material of the present invention may contain an ultraviolet ray absorbing agent in a hydrophilic colloid layer thereof. Examples of the ultraviolet ray absorbing agents used are benzotriazole compounds substituted with an aryl group as described in U.S. Pat. Nos. 3,533,794 and 4,236,013, Japanese Patent Publication No. 6540/76, European Pat. No. 57,160, etc., butadiene compounds as described in U.S. Pat. Nos. 4,450,229 and 4,195,999, etc., cinnamic acid ester compounds as described in U.S. Pat Nos. 3,705,805 and 3,707,375, etc., benzophenone compounds as described in U.S. Pat. No. 3,215,530, British Pat. No. 1,321,355, etc., and polymer compounds having ultraviolet ray absorbing residues as described in U.S. Pat. Nos. 3,761,272 and 4,431,726, etc.

Further, fluorescent whitening agents having ultraviolet ray absorbing function as described in U.S. Pat. Nos. 3,499,762 and 3,700,455, etc. may be used. Typical examples of the ultraviolet ray absorbing agents are also described in *Research Disclosure,* No. 24239 (June, 1984), etc.

The color light-sensitive material according to the present invention may contain one or more kinds of surface active agents for various purposes such as improvement of coating properties, antistatic properties, slipping properties, emulsion dispersibility, anti-adhesion properties and photographic properties (for example, development acceleration, increase in contrast, sensitization, etc.).

The color light-sensitive material of the present invention may contain water-soluble dyes as filter dyes or for irradiation or halation prevention or other various purposes in a hydrophilic colloid layer thereof. These dyes preferably used include oxonol dyes, hemioxonol dyes, styryl dyes, merocyanine dyes, authraquinone dyes, and azo dyes. In addition, cyanine dyes, azomethine dyes, triarylmethane dyes, and phthalocyanine dyes are also useful. It is also possible that oil-soluble dyes are emulsified by an oil droplet in water type dispersing method and then added to a hydrophilic colloid layer.

In order to incorporate oleophilic compounds such as photographic couplers into a hydrophilic colloid layer of the color light-sensitive material according to the present invention, various methods, for example, an oil droplet in water type dispersing method, a latex dispersing method, a solid dispersing method, an alkali dispersing method, etc., can be employed. A preferred method can be suitably selected depending on the chemical structure and the physical and chemical properties of the compound to be introduced.

The photographic couplers used in the present invention can be added to one or more silver halide emulsion layers, etc., by means of, preferably, a latex dispersing method, and more preferably an oil droplet in water type dispersing method. By means of the oil droplet in water type dispersing method, couplers are dissolved in an organic solvent having a high boiling point of 175° C. or more at a normal pressure (hereinafter referred to as an "oil") or a mixture thereof with an auxiliary solvent having a low boiling point, if desired, nd then the solution is finely dispersed in water or an aqueous solution of a binder such as gelatin, etc. in the presence of a surface active agent.

Typical examples of the organic solvents having a high boiling point include phthalates as described in U.S. Pat. Nos. 2,272,191 and 2,322,027, Japanese Patent Application (OPI) Nos. 31728/79 and 118246/79, etc., phosphates or phosphonates as described in Japanese Patent Application (OPI) Nos. 1520/78 and 36869/80, U.S. Pat. Nos. 3,676,137, 4,217,410, 4,278,757, 4,326,022 and 4,353,979, etc., benzoates as described in U.S. Pat. No. 4,080,209, etc., amides as described in U.S. Pat. Nos. 2,533,514, 4,106,940 and 4,127,413, etc. alcohols or phenols as described in Japanese Patent Application (OPI) Nos. 27922/76, 13414/78 and 130028/78, U.S. Pat. No. 2,835,579, etc., aliphatic carboxylic acid esters as described in Japanese Patent Application (OPI) Nos. 26037/76, 27921/76, 149028/76, 34715/77, 1521/78, 15127/78, 58027/79, 64333/81 and 114940/81, U.S. Pat. Nos. 3,748,141, 3,779,765, 4,004,028, 4,430,421 and 4,430,422, etc., anilines as described in Japanese Patent Application (OPI) No. 105147/83, etc., hydrocarbons as described in Japanese Patent Application (OPI) Nos. 62632/75 and 99432/79, U.S. Pat. No. 3,912,515, etc., and others as described in Japanese Patent Application (OPI) No. 146622/78, U.S. Pat. Nos. 3,689,271, 3,700,454, 3,764,336, 3,765,897, 4,075,022 and 4,239,851, West German Patent Application (OLS) No. 2,410,914, etc. Two or more kinds of organic solvents having a high boiling point may be employed together, and examples of using phthalates together with phosphates are described in U.S. Pat. No. 4,327,175.

It is also possible to utilize the dispersing method using polymers, as described in Japanese Patent Application (OPI) No. 59943/76, Japanese Patent Publication Nos. 39853/76 and 126830/81, U.S. Pat. Nos. 2,772,163 and 4,201,589, etc.

As the binder or the protective colloid for the photographic emulsion layers or intermediate layers of the color light-sensitive material according to the present invention, gelatin is advantageously used, but other hydrophilic colloids can also be used.

For example, it is possible to use proteins such as gelatin derivatives, graft polymers of gelatin and other polymers, albumin, casein, etc., saccharides such as cellulose derivatives such as hydroxyethyl cellulose, carboxymethyl cellulose, cellulose sulfate, etc., sodium alginate, starch derivatives, etc., and various synthetic hydrophilic polymeric substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

As gelatin, not only lime-processed gelatin conventionally used, but also acid-processed gelatin and enzyme-processed gelatin as described in *Bull. Soc. Sci. Phot. Japan,* No. 16, page 30 (1966) may be used. Further, hydrolyzed products of gelatin can also be used.

The color light-sensitive material of the present invention may contain inorganic or organic hardeners in the photographic light-sensitive layer and other hydrophilic colloid layers thereof, including a backing layer. For example, chromium salts, aldehydes (e.g., formaldehyde, glyoxal, glutaraldehyde, etc.), N-methylol compounds (e.g., dimethylolurea, etc.) are illustrated. Active halogen compounds (e.g., 2,4-dichloro-6-hydroxy-1,3,5-triazine, etc.) and active vinyl compounds (e.g., 1,3-bisvinylsulfonyl-2-propanol, 1,2-bisvinylsulfonylacetamidoethane, a vinyl type polymer having vinylsulfonyl groups in its side chain, etc.) are preferred since they rapidly harden hydrophilic colloids such as gelatin and provide stable photographic characteristics. Also, N-carbamoylpyridinium salts or haloamidinium salts are preferred because of their high hardening speed.

The present invention can be applied to a multilayer multicolor photographic light-sensitive material having at least two differently spectrally sensitized silver halide photographic emulsion layers on a support. The multilayer natural color photographic light-sensitive material usually has at least one red-sensitive silver halide emulsion layer, at least one green-sensitive silver halide emulsion layer, and at least one blue-sensitive silver halide emulsion layer on a support. The order of the disposition of these emulsion layers can be suitably selected depending on the particular characteristics desired. A preferred disposition is that a red-sensitive layer, a green-sensitive layer and a blue-sensitive layer are arranged in the order stated from the support side. Further, each of the above described emulsion layers may be composed of two or more emulsion layers having different sensitivities in order to increase sensitivity achieved, or may be composed of three layers in order to further improve graininess. Moreover, between two or more emulsion layers sensitive to the same spectral wavelength range, a light-insensitive layer may be present. Furthermore, between emulsion layers sensitive to the same spectral wavelength range, an emulsion layer sensitive to different spectral wavelength range therefrom may be interposed.

In a multilayer multicolor photographic light-sensitive material, a filter layer which absorbs light having a specified wavelength range or a layer for the purpose of antihalation may be provided. In these light absorbing layers, not only the above described organic dyes, but also colloidal silver particles can be used.

For the purpose of increasing sensitivity based on light reflection or trapping of development inhibiting substances, multilayer multicolor photographic light-sensitive material may have one or more light-insensitive layers containing a light-insensitive fine grain silver halide emulsion.

It is usual that the red-sensitive silver halide emulsion layer contains a cyan-forming coupler, the green-sensitive silver halide emulsion layer contains a magenta-forming coupler, and the blue-sensitive silver halide emulsion layer contains a yellow-forming coupler, but different combinations may be employed, if desired. For example, in case of false color photography or for semiconductor laser exposure, an infrared sensitive layer is combined. Further, a coupler which forms color other than color that is in the complementary color relation with light to which an emulsion layer is sensitive may be mixed in the emulsion layer in order to reduce unnatural color-sensation, as described, e.g., in Japanese Patent Publication No. 3481/58.

In the color light-sensitive material of the present invention, photographic emulsion layer and other layers are coated on a flexible support such as a plastic film, paper, cloth, etc., or a rigid support such as glass, ceramic, metal, etc. conventionally used for photographic light-sensitive materials. Examples of useful flexible support which can be used include films composed of semi-synthetic or synthetic polymers such as cellulose nitrate, cellulose acetate, cellulose acetate butyrate, polystyrene, polyvinyl chloride, polyethylene terephthalate, polycarbonate, etc.; and paper coated or laminated with a baryta layer or an α-olefin polymer (e.g., polyethylene, polypropylene, an ethylenebutene copolymer, etc.).

Supports may be colored with dyes or pigments. Further, they may be rendered black for the purpose of shielding light. The surfaces of these supports are, in general, subjected to a subbing treatment to increase adhesiveness to photographic emulsion layers. Before or after receiving the subbing treatment, the surfaces of the support may be subjected to a glow discharge treatment, a corona discharge treatment, an ultraviolet irradiation treatment, a flame treatment, etc.

In the present invention, photographic emulsion layers and other hydrophilic colloid layers can be coated on a support or other layers using various conventional coating methods. Examples of such coating methods include a dip coating method, a roller coating method, a curtain coating method, an extrusion coating method, etc. By the coating methods as described in U.S. Pat. Nos. 2,681,294, 2,761,791, 3,526,528, 3,508,947, etc., multilayers are coated at the same time, if desired.

Various means of exposure can be employed with respect to the color light-sensitive material of the present invention. Any appropriate light sources emitting radiation corresponding to a light-sensitive wavelength range of the color light-sensitive material can be used as illuminating light sources or recording light sources. For example, natural light (sun light), an incandescent lamp, a halogen lamp, a mercury lamp, a fluorescent lamp, and a flash light source such as an electronic flash (strobe) or a metal combustion flash bulb, etc., are generally employed. A gas, dye solution or semiconductor laser, a light-emitting diode, and a plasma light source, each of which may emit light in a wavelength range from ultraviolet region to infrared region, are also employed as a recording light source. Further, a fluorescent light emitted from a fluorescent body excited with electron beam, (such as a CRT, etc.), a microshutter alley utilizing a liquid crystal (LCD) or lead titanium zirconate doped with lanthanium (PLZT), etc., an exposure means composed of a combination of line-state or face-state light sources may be used. Spectral distribution for exposure can be controlled by means of a color filter, if desired.

A color developing solution which can be used in development processing of the color light-sensitive material according to the present invention is an alkaline aqueous solution containing preferably an aromatic primary amine type developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, chloride, phosphate, p-toluenesulfonate, tetraphenylborate or p-(tert-octyl)benzenesulfonate thereof, etc. These diamines are preferably employed in the form of salts, since the salts are generally more stable than their free forms.

The aminophenol type derivatives include, for example, o-aminophenol, p-aminophenol, 4-amino-2-methylphenol, 2-amino-3-methylphenol, 2-oxy-3-amino-1,4-dimethylbenzene, etc.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc., may be used.

Two or more kinds of color developing agents may be employed in combination, if desired.

The color developing solution can further contain pH buffering agents, such as carbonates, borates or phosphates of alkali metals, etc.; development inhibitors or anti-fogging agents such as bromides, iodides, benzimidazoles, benzothiazoles or mercapto compounds, etc.; preservatives such as hydroxylamine, triethanolamine, the compounds as described in West German Patent Application (OPI) No. 2,622,950, sulfites, bisulfites, etc.; organic solvents such as diethylene glycol, etc.; development accelerators such as benzyl alcohol, polyethylene, quaternary ammonium salts, amines, thiocyanates, 3,6-dithiaoctane-1,8-diol, etc.; dye forming couplers; competing couplers; nucleating agents such as sodium borohydride, etc.; auxiliary developing agents such as 1-phenyl-3-pyrazolidone, etc.; viscosity imparting agents; and chelating agents including aminopolycarboxylic acids represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the compounds as described in Japanese Patent Application (OPI) No. 195845/83, etc., organic phosphonic acids such as 1-hydroxyethylidine-1,1'-diphosphonic acid, those as described in *Research Disclosure,* No. 18170 (May, 1979), etc., aminophosphonic acids such as aminotris(methylenephosphonic acid), ethylenediamine-N,N,N',N'-tetramethylenephosphonic acid, etc., phosphonocarboxylic acids as described in Japanese Patent Application (OPI) Nos. 102726/77, 42730/78, 121127/79, 4024/80, 4025/80, 126241/80, 65955/80 and 65956/80, *Research Disclosure,* No. 18170 (May, 1977), etc.

The color developing agent can be used in an amount ranging generally from about 0.1 g to about 30 g, preferably from about 1 g to about 15 g, per liter of the color developing solution. The pH of the color developing solution used is usually 7 or more, and preferably in a range from about 9 to about 13. Further, an amount of replenishment for the color developing solution can be reduced using a replenisher in which concentrations of halogenides, color developing agents, etc., are controlled.

In the case of development processing for reversal color light-sensitive materials, color development is usually conducted after black-and-white development. In a black-and-white developing solution, known black-and-white developing agents, for example, dihydroxybenzenes such as hydroquinone, hydroquinone monosulfonate, etc., 3-pyrazolidones such as 1-phenyl-3-pyrazolidone, etc., or aminophenols such as N-methyl-p-aminophenol, etc., may be employed, individually or in a combination.

After color development, the photographic emulsion layers are usually subjected to a bleach processing. The bleach processing can be performed simultaneously with a fix processing using a mono-bath bleach-fixing solution (flix processing), or it can be performed independently from the fix processing. Further, for the purpose of a rapid processing, a processing method wherein after a bleach processing a bleach-fix processing is conducted may be employed.

Examples of bleaching agents which can be employed in the bleach processing or bleach-fix processing include compounds of a multivalent metal such as iron (III), cobalt (III), chromium (VI), copper (II), etc. (for example, ferricyanides, etc.); peracids; quinones; nitroso compounds; dichloromates; organic complex salts of iron (III) or cobalt (III), (for example, complex salts of aminopolycarboxylic acids (such as ethylenediaminetetraacetic acid, diethylenetriaminepentaacetic acid, etc., aminopolyphosphonic acids, phosphonocarboxylic acids or organic phosphonic acids, etc. or complex salts of organic acids such as citric acid, tartaric acid, malic acid, etc.); persulfates; hydrogen peroxide, permanganates; etc. Of these compounds, organic complex salts of iron (III) and persulfates are preferred in view of rapid processing and less environmental pollution.

Specific examples of useful aminopolycarboxylic acids, aminopolyphosphonic acids or salts thereof suitable for forming organic complex salts of iron (III) are set forth below.

Ethylenediaminetetraacetic acid
Diethylenetriaminepentaacetic acid
Ethylenediamine-N-(β-oxyethyl)-N,N,N'-triacetic acid
1,2-Diaminopropanetetraacetic acid
Triethylenetetraminehexaacetic acid
1,3-Diaminopropanetetraacetic acid
Propylenediaminetetraacetic acid
Nitrilotriacetic acid
Nitrilotripropionic acid
Cyclohexanediaminepentaacetic acid
1,3-Diamino-2-propanoltetraacetic acid
Methyliminodiacetic acid
Iminodiacetic acid
Hydroxyliminodiacetic acid
Dihydroxyethylglycine
Dihydroxyethylglycineethyl ether diaminetetraacetic acid
Glycol ether diaminetetraacetic acid
Ethylenediaminetetrapropionic acid
Ethylenediaminedipropionic acid
Phenylenediaminetetraacetic acid
2-Phosphonobutane-1,2,4-triacetic acid
1,3-Diaminopropanol-N,N,N',N'-tetramethylenephosphonic acid
Ethynenediamine-N,N,N',N'-tetramethylenephosphonic acid
1,3-Propylenediamine-N,N,N';N'-tetramethylenephosphonic acid
1-Hydroxyethylidene-1,1'-diphosphonic acid Of these compounds, iron (III) complex salt of ethylenediaminetetraacetic acid, diethylenetriaminepentaacetic acid, cyclohexanediaminetetraacetic acid, 1,3-diaminopropanetetraacetic acid or methyliminodiacetic acid are preferred because of their high bleaching power.

The iron (III) complex salts may be used in the form of a complex salt per se, or may be formed in situ in solution by using an iron (III) salt (e.g., ferric sulfate, ferric chloride, ferric nitrate, ferric ammonium sulfate or ferric phosphate, etc.) and a chelating agent (e.g., an aminopolycarboxylic acid, aminopolyphosphonic acid or phosphonocarboxylic acid, etc.). When they are used in the form of a complex salt, they may be used alone or as a combination of two or more. On the other hand, where a complex is formed in situ in solution by using a ferric salt and a chelating agent, one, two or more ferric salts may be used. Further, one, two or more chelating agents may also be used. In every case, a chelating agent may be used in an excess amount of that necessary for forming a ferric ion complex salt.

The bleaching solution or the bleach-fixing solution containing the above-described ferric ion complex may further contain metal ions or complexes of metals other than iron such as calcium, magnesium aluminum, nickel, bismuth, zinc, tungsten, cobalt, copper, etc., or hydrogen peroxide.

Suitable examples of persulfates which can be employed in the bleach processing or bleach-fix processing according to the present invention include alkali metal persulfates such as potassium persulfate, sodium persulfate, etc., ammonium persulfate, etc.

The bleaching solution or the bleach-fixing solution according to the present invention can contain rehalogenating agents such as bromides (e.g., potassium bromide, sodium bromide, ammonium bromide, etc.), chlorides (e.g., potassium chloride, sodium chloride, ammonium chloride, etc.), or iodides (e.g., ammonium iodide, etc.). Further, one or more kinds of inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), corrosion preventing agents (e.g., ammonium nitrate, guanidine, etc.), or the like may be added.

The amount of bleaching agent is usually from 0.1 to 2 mols per liter of the bleaching solution, and the pH of the bleaching solution is preferably from 0.5 to 8.0, when a ferric ion complex salt is used, and particularly from 4.0 to 7.0, when a ferric ion complex salt of an aminopolycarboxylic acid, aminopolyphosphonic acid, phosphonocarboxylic acid or organic phosphonic acid is used. In the case of using a persulfate, the amount of a persulfate is preferably from 0.1 to 2 mols per liter of the bleaching solution, and the pH of the bleaching solution is preferably from 1 to 5.

As fixing agents which can be employed in the fixing solution or bleach-fixing solution, known fixing agents, that is, water-soluble silver halide solvents such as thiosulfates (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8-octanediol, etc.); and thioureas may be used alone individually or in combination with two or more. In addition, special bleach-fixing solution comprising a combination of fixing agent and a large amount of a halide compound such as potassium iodide as described in Japanese Patent Application (OPI) No. 155354/80 can be used as well.

In the fixing solution or bleach-fixing solution, it is desirable that the amount of fixing agent is from 0.2 to 4 mols per liter of the fixing solution or bleach-fixing solution. In the bleach-fixing composition, it is desirable that the ferric ion complex salt is present in an amount of from 0.1 to 2 mols and the amount of fixing agent is from 0.2 to 4 mols, per liter of the bleach-fixing solution. Further, the pH of the fixing solution or bleach-fixing solution is preferably from 4.0 to 9.0, particularly preferably from 5.0 to 8.0.

The fixing solution or bleach-fixing solution can contain the aforesaid additives to be added to the bleaching solution and preservatives such as sulfites (e.g., sodium sulfite, potassium sulfite, ammonium sulfite, etc.), bisulfite, hydroxylamine, hydrazine, aldehyde-bisulfite adducts (e.g., acetaldehyde-sodium bisulfite adduct), etc. Further, various fluorescent brightening agents, defoaming agents, surface active agents, polyvinyl pyrrolidone, organic solvents (e.g., methanol, etc.), etc., may be incorporated.

In the bleaching solution, the bleach-fixing solution or a prebath thereof, a bleach accelerating agent can be used, if desired. Specific examples of suitable bleach accelerating agents include compounds having a mercapto group or a disulfide group as described in U.S. Pat. No. 3,893,858, West German Patent Application (OLS) Nos. 1,290,812 and 2,059,988, Japanese Patent Application (OPI) Nos. 32736/78, 57831/78, 37418/78, 65732/78, 72623/78, 95630/78 95631/78, 104232/78, 124424/78, 141623/78 and 28426/78, Research Disclosure, No. 17129 (July, 1978), etc.; thiazolidine derivatives as described in Japanese Patent Application (OPI) No. 140129/75, etc.; thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Pagent 1,127,715, Japanese Patent Application (OPI) No. 16235/83, etc.; polyethyleneoxides as described in West German Pat. Nos. 966,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79 26506/80 and 163940/83; iodine ions; and bromine ions. Of these compounds, the compounds having a mercapto group or a disulfide group are preferred in view of their large bleach accelerating effects. Particularly, compounds as described in U.S. Pat. No. 3,893,858, West German Pat. No. 1,290,812 and Japanese Patent Application (OPI) No. 95630/78 are preferred. Further, the compounds as described in U.S. Pat. No. 4,552,834 are also preferred. These bleach accelerating agents may be incorporated into the color light-sensitive material.

Moreover, in the case of continuous processing, the variation of composition in each processing solution can be prevented using a replenisher for the processing solution, whereby a constant finish can be achieved. The amount of replenisher can be reduced to one half or less of the standard amount of replenishment for the purpose of reducing cost.

In each of the processing baths, a heater, a temperature sensor, a liquid level sensor, a circulation pump, a filter, a floating cover, a squeezer, etc., may be provided, if desired.

A bleach-fixing process can be utilized conventionally in the case wherein the color light-sensitive material of the present invention is a color paper, and, if desired, when it is a color light-sensitive material for photography.

The method of the present invention can be applied to processing of color negative films, color reversal films, color positive films, color papers, and color reversal papers. Particularly, the method can be applied to processing color light sensitive materials for photography including color negative films.

The present invention is explained in greater detail with reference to the following examples, with the present invention should not be construed as being limited thereto.

EXAMPLE 1

Sample 101

On a cellulose triacetate film support provided with a subbing layer were coated layers having the compositions set forth below to prepare a multilayer color light-sensitive material, which was designated as Sample 101.

With respect to the compositions of the layers, coated amounts are shown in units of g/m$^2$, coated amounts of silver halide and colloidal silver are shown by a silver coated amount in units of g/m$^2$, those of couplers and sensitizing dyes are shown as a molar amount per mol of silver halide present in the layer.

| | |
|---|---|
| First Layer: Antihalation Layer | |
| Black colloidal silver | 0.18 (as silver) |
| Gelatin | 1.40 |
| Second Layer: Intermediate Layer | |
| 2,5-Di-tert-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |
| Third Layer: First Red-Sensitive Emulsion Layer | |
| Silver iodobromide emulsion (silver iodide: 6 mol %, average particle size: 0.8 μm) | 0.50 (as silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| C-2 | 0.146 |
| HBS-1 | 0.005 |
| Compound (35) of the present invention | 0.005 |
| Gelatin | 1.20 |
| Fourth Layer: Second Red-Sensitive Emulsion Layer | |
| Silver iodobromide emulsion (silver iodide: 5 mol %, average particle size: 0.85 μm) | 1.15 (as silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| C-2 | 0.060 |
| C-3 | 0.008 |
| Compound (35) of the present invention | 0.004 |
| HBS-1 | 0.005 |
| Gelatin | 1.50 |
| Fifth Layer: Third Red-Sensitive Emulsion Layer | |
| Silver iodobromide emulsion (silver iodide: 10 mol %, average particle size: 1.5 μm) | 1.50 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |
| Sixth Layer: Intermediate Layer | |
| Gelatin | 1.06 |
| Seventh Layer: First Green-Sensitive Emulsion Layer | |
| Silver iodobromide emulsion (silver iodide: 6 mol %, average particle size: 0.8 μm) | 0.35 (as silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| C-6 | 0.120 |
| C-1 | 0.021 |
| C-7 | 0.030 |
| C-8 | 0.025 |
| HSB-1 | 0.20 |
| Gelatin | 0.70 |
| Eighth Layer: Second Green-Sensitive Emulsion Layer | |
| Silver iodobromide emulsion (silver iodide: 5 mol %, average particle size: 0.85 μm) | 0.75 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| C-6 | 0.021 |
| C-8 | 0.004 |
| C-1 | 0.002 |
| C-7 | 0.003 |
| HBS-1 | 0.15 |

-continued

| | |
|---|---|
| Gelatin | 0.80 |
| Ninth Layer: Third Green-Sensitive Emulsion Layer | |
| Silver iodobromide emulsion (silver iodide: 10 mol %, average particle size: 1.5 μm) | 1.80 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| C-16 | 0.012 |
| C-1 | 0.001 |
| HBS-1 | 0.69 |
| Gelatin | 1.74 |
| Tenth Layer: Yellow Filter Layer | |
| Yellow colloidal silver | 0.05 (as silver) |
| 2,5-Di-tert-pentadecylhydroquinone | 0.03 |
| Gelatin | 0.95 |
| Eleventh Layer: First Blue-Sensitive Emulsion Layer | |
| Silver iodobromide emulsion (silver iodide: 6 mol %, average particle size: 0.6 μm) | 0.24 (as silver) |
| Sensitizing Dye VIII | $3.5 \times 10^{-4}$ |
| C-9 | 0.27 |
| C-8 | 0.005 |
| HBS-1 | 0.28 |
| Gelatin | 1.28 |
| Twelfth Layer: Second Blue-Sensitive Emulsion Layer | |
| Silver iodobromide emulsion (silver iodide: 10 mol %, average particle size: 1.0 μm) | 0.45 (as silver) |
| Sensitizing Dye VIII | $2.1 \times 10^{-4}$ |
| C-9 | 0.098 |
| HBS-1 | 0.03 |
| Gelatin | 0.46 |
| Thirteenth Layer: Third Blue-Sensitive Emulsion Layer | |
| Silver iodobromide emulsion (silver iodide: 10 mol %, average particle size: 1.8 μm) | 0.77 (as silver) |
| Sensitizing Dye VIII | $2.2 \times 10^{-4}$ |
| C-9 | 0.036 |
| HBS-1 | 0.07 |
| Gelatin | 0.69 |
| Fourteenth Layer: First Protective Layer | |
| Silver iodobromide (silver iodide: 1 mol %, average particle size: 0.07 μm) | 0.5 (as silver) |
| U-1 | 0.11 |
| U-2 | 0.17 |
| n-Butyl p-hydroxybenzoate | 0.012 |
| HBS-1 | 0.90 |
| Fifteenth Layer: Second Protective Layer | |
| Polymethyl methacrylate particle (diameter: about 1.5 μm) | 0.54 |
| S-1 | 0.15 |
| S-2 | 0.10 |
| Gelatin | 0.72 |

Gelatin Hardener H-1 and a surface active agent were added to each of the layers in addition to the above described components.

Samples 102 and 103

Samples 102 and 103 were prepared in the same manner as described for Sample 101, except using equimolar amounts of Compound (30) of the present invention and Comparative Compound C-11 in place of Compound (35) of the present invention added to the third layer and fourth layer of Sample 101, respectively.

Samples 104 to 106

Samples 104 to 106 were prepared in the same manner as described for Samples 101 to 103, except eliminating n-butyl p-oxybenzoate from to the fourteenth layer of Samples 101 to 103, respectively.

The chemical structures or chemical names of the compounds employed for preparing the samples as described Examples 1 and 2 are shown below.
U-1
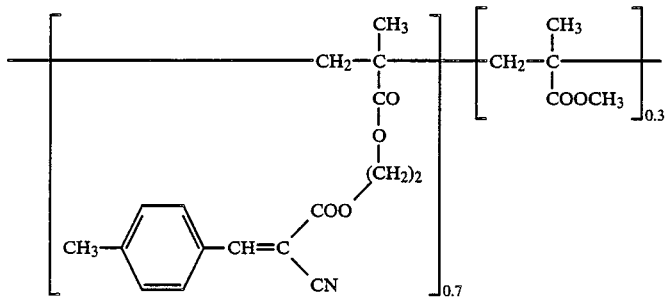
U-2
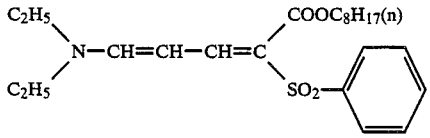
C-1
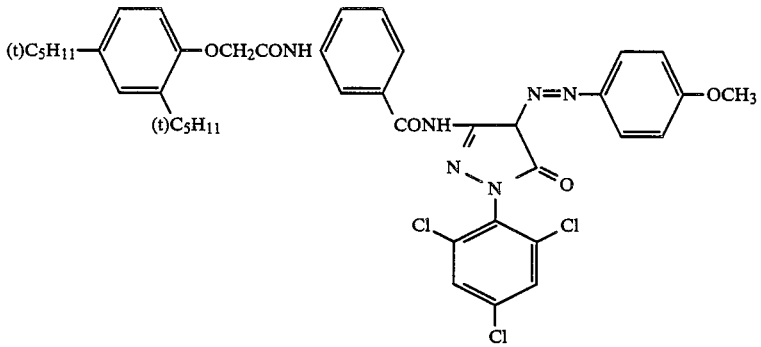
C-2
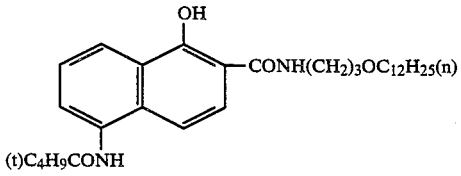
C-3
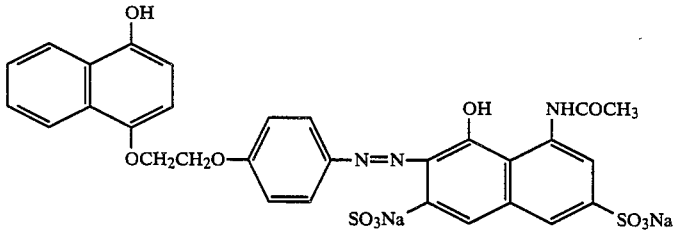
C-4
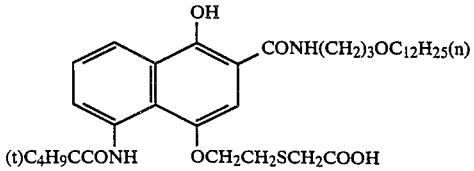

-continued
C-5
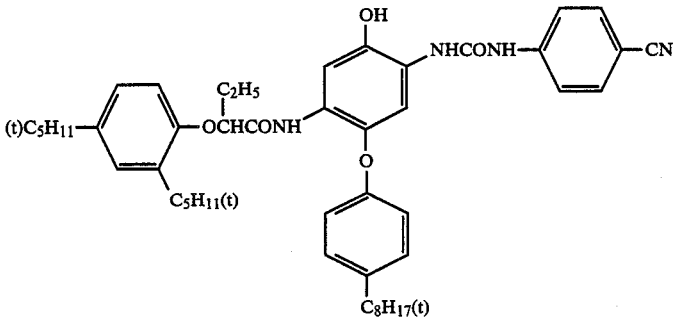
C-6
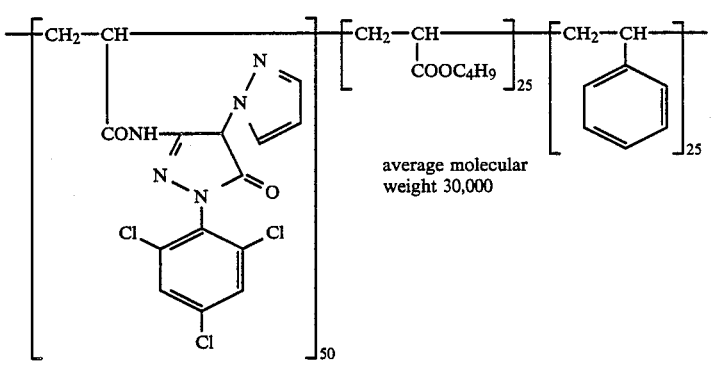
C-7
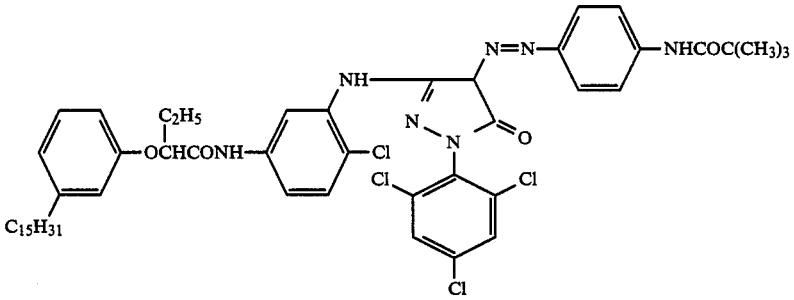
(Coupler disclosed in U.S. Pat. No. 4,477,563)
C-8
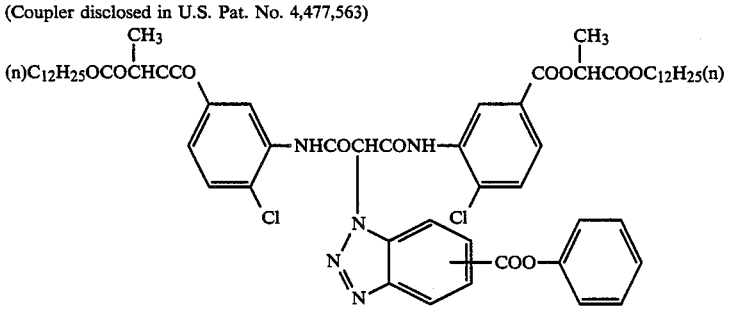
C-9
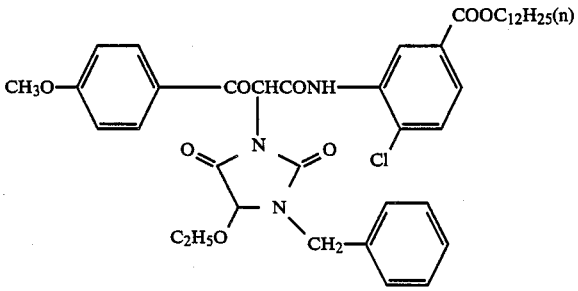
(Coupler disclosed in U.S. Pat. No. 4,477,563)
C-10

-continued
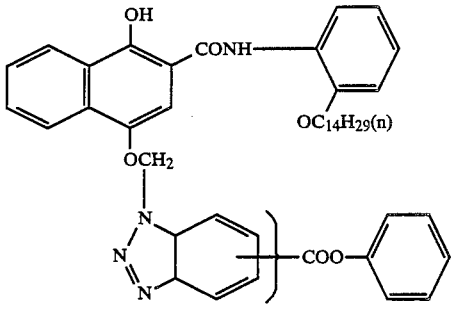
(Coupler disclosed in U.S. Pat. No. 3,227,554) C-11
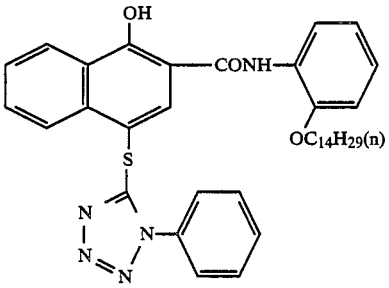
C-12
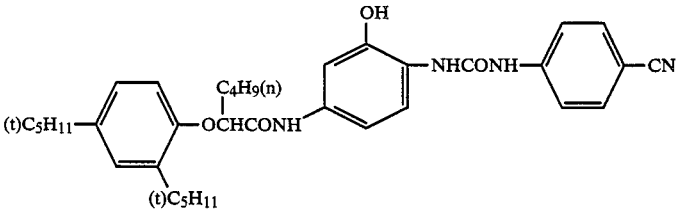
C-13
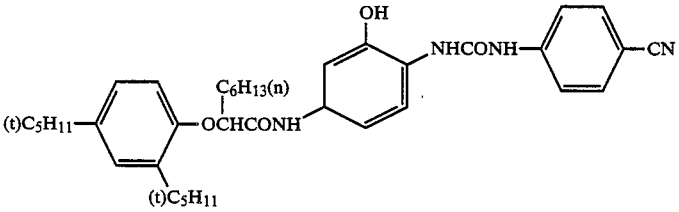
C-14
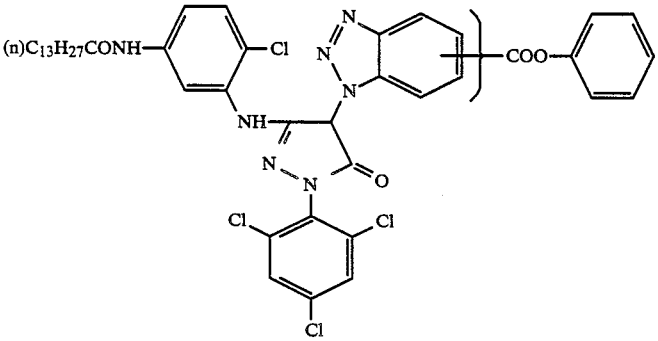

-continued
C-16
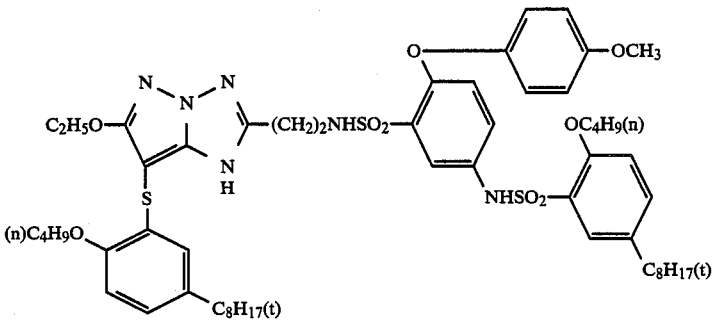
S-1
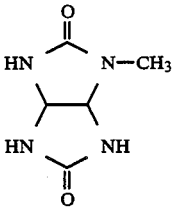
S-2
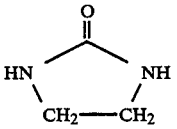
Tricresylphosphate HBS-1
Dibutylphthalate HBS-2
Tri-n-hexylphosphate HBS-3
H-1
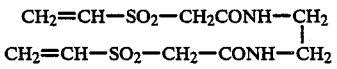
Sensitizing Dye
I
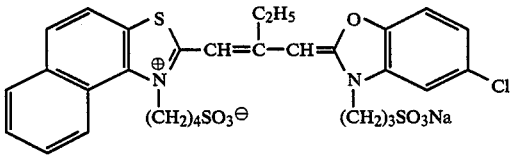
II
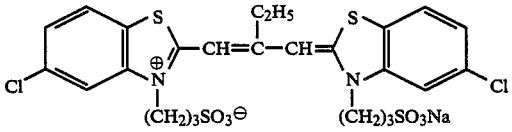
III
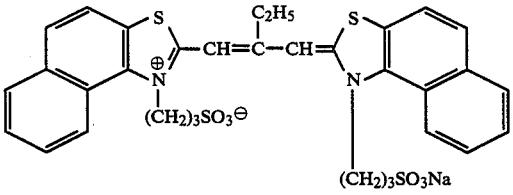
IV
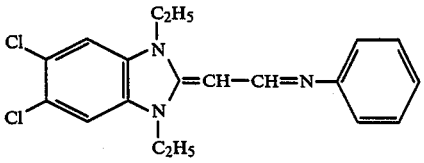

-continued

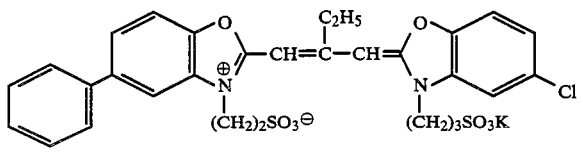

V

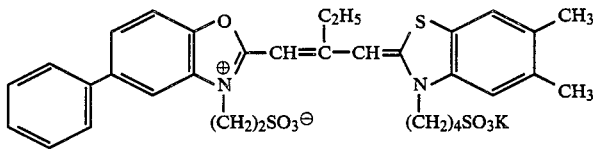

VI

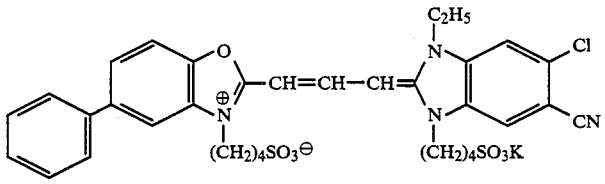

VII

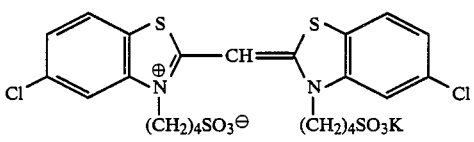

VIII

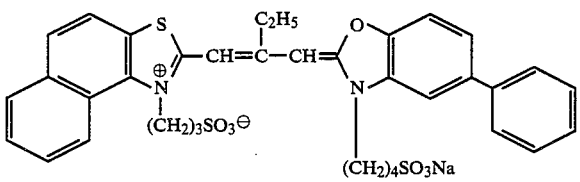

IX

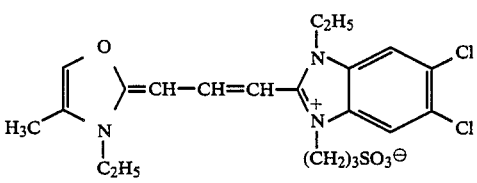

X

Sample 101 of these multilayer color light-sensitive materials was cut into strips of a 35 mm width, used to photograph standard subjects out-doors, and then processed according to the processing steps shown in Table 1 below using the processing solution described below by means of an automatic developing machine.

TABLE 1

| Processing Step | Processing Time | Processing Temperature | Capacity of Tank | Amount of Replenishment* |
|---|---|---|---|---|
| Color Development | 3 min 15 sec | 38° C. | 8 l | 38 ml |
| Bleaching | 4 min 20 sec | 38° C. | 8 l | 18 ml |
| Fixing | 3 min 15 sec | 38° C. | 8 l | 33 ml |
| Washing with Water (1) | 1 min 30 sec | 35° C. | 4 l | — |
| Washing with Water (2) | 1 min 30 sec | 35° C. | 4 l | Shown in Table 2 |
| Stabilizing | 1 min 05 sec | 38° C. | 4 l | 33 ml |

*Amount of replenishment per 1 meter of a 35 mm width strip.

In the above described processing steps, the washing with water steps (1) and (2) were carried out using a countercurrent water washing process from Washing with Water (2) to Washing with Water (1).

The composition of each processing solution is illustrated below.

| | Tank Solution | Replenisher |
|---|---|---|
| Color Developing Solution: | | |
| Diethylenetriaminepenta-acetic Acid | 1.0 g | 1.1 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |

-continued

| | Tank Solution | Replenisher |
|---|---|---|
| Potassium Bromide | 1.4 g | 0.7 g |
| Potassium Iodide | 1.3 mg | — |
| Hydroxylamine | 2.4 g | 2.6 g |
| 4-(N—Ethyl-N—β-hydroxyethyl-amino)-2-methylaniline Sulfate | 4.5 g | 5.0 g |
| Water to make | 1 liter | 1 liter |
| pH | 10.00 | 10.05 |
| Bleaching Solution: | | |
| Iron (III) Ammonium Ethylene-diamine tetraacetate | 100 g | 110 g |
| Disodium Ethylenediamine-tetraacetate | 10 g | 11 g |
| Aqueous Ammonia | 7 ml | 5 ml |
| Ammonium Nitrate | 10.0 g | 12.0 g |
| Ammonium Bromide | 150 g | 170 g |
| Water to make | 1 liter | 1 liter |
| pH | 6.0 | 5.8 |
| Fixing Solution: | | |
| Disodium Ethylenediamine-tetraacetate | 1.0 g | 1.2 g |
| Sodium Sulfite | 4.0 g | 5.0 g |
| Sodium Bisulfite | 4.6 g | 5.8 g |
| Ammonium Thiosulfate (70% aq. soln.) | 175 ml | 200 ml |
| Water to make | 1 liter | 1 liter |
| pH | 6.6 | 6.6 |
| Stabilizing Solution: | | |
| Formalin (37% formaldehyde (w/v)) | 2.0 ml | 3.0 ml |
| Polyoxyethylene-p-monononyl-phenylether (average degree of polymerization = 10) | 0.3 g | 0.45 g |
| Water to make | 1 liter | 1 liter |

Washing Water and Replenisher of Washing Water

Shown in Table 2 below

The conditions of the processing conducted are shown in Table 2 below.

TABLE 2

| Running | Amount Taken Over from *1 Preceding Bath (A) | Amount of Replenishing Water (B) *2 | Rate of Replenishment (B/A) | Water Quality of Washing Water and Replenisher | Amount of Processing |
|---|---|---|---|---|---|
| 1 | 2 ml | 1,000 ml*3 | 500 | City Water *4 | 50 m/day × 20 days |
| 2 | 2 ml | 100 ml | 50 | City Water *4 | 50 m/day × 20 days |
| 3 | 2 ml | 30 ml | 15 | City Water *4 | 50 m/day × 20 days |
| 4 | 2 ml | 30 ml | 15 | Ion Exchanged Water *5 | 50 m/day × 20 days |
| 5 | 2 ml | 10 ml | 5 | City Water *4 | 50 m/day × 30 days |

*1 1 meter of a sample was gathered just before introduction of the sample into the water washing bath, immediately immersed in 1 liter of distilled water and maintained at 30° C. for 10 minutes while stirring with a magnetic stirrer. Then, the concentration of thiosulfate ion $C_1$ (g/l) in the liquid was determined. Also, the concentration of thiosulfate ion $C_2$ (g/l) in the preceding fixing solution was determined. From these values the amount carried over A (ml) was calculated according to the following equation.

$$C_1 \times \frac{(1000 + A)}{A} = C_2$$

The determination on the concentration of thiosulfate ion was carried out using a acidic iodine titration method after sulfite ions were masked with formaldehyde.

*2 Amount of replenishing water per 1 meter of the sample.

*3 Approximately standard amount of washing water in the case wherein the amount of washing water was not saved.

*4 City water having the following water quality was used.

| | |
|---|---|
| pH | 6.8 |
| Calcium | 25 mg/l |
| Magnesium | 8 mg/l |

*5 City water was treated with a Na type strong acidic cation exchange resin (trade name: Diaion SK-(B) manufactured by Mitsubishi Chemical Industries (Ltd.) to prepare water having the water quality as follows:

| | |
|---|---|
| pH | 6.6 |
| Calcium | 1.3 mg/l |
| Magnesium | 0.7 mg/l |

After conducting the above described running, Samples 101 to 106 which had been exposed wedgewise at a color temperature of 4800° K. and 20 CMS were processed.

Further, the compounds as shown in Table 3 below were added to the water washing tank and stabilizing tank, and Samples 101 to 106 were processed therewith in the same manner.

With Samples 101 to 106 thus-processed, propagation of mold and fading of cyan dye were evaluated. The results obtained are shown in Table 3 below.

Evaluation on Propagation of Mold

Aspergillus niger, as a fungus was suspended in a solution having 1/10 concentration of M-40Y (nutritive medium), and 0.03 ml of the suspension was spotted on the center of the emulsion layer side of the sample cut 35 m/m×40 m/m. The spotted area was a circle having a diameter of about 2 m/m.

The sample was put into a sterilized plastic plate having therein an absorbent cotton containing sterilized water as a moisture source. The plate was covered up and maintained at 27° C. for 3 weeks. After 3 weeks, an average diameter of the area wherein the mold propagated in a circle from the center of spot was measured and graded as follows:

| | |
|---|---|
| (−) | No extent from the spotted area |
| (+) | Propagation area was within a circle having a diameter of 1 cm. |
| (++) | Propagation area was within a circle having a diameter of 2 cm. |
| (+++) | Propagation area exceeded a circle having a diameter of 2 cm. |

-continued

Evaluation on Fading of Cyan dye

The sample after processing was stored in a thermobox at 80° C. in which humidity was not controlled for 3 weeks, and then fading (decrease in optical density) of cyan dye at the area having the initial color density of 1.5 was measured.

In Table 3 below, Compounds A, B, and C are as follows:

Compound A: Butyl p-hydroxybenzoate as added to the fourteenth layer of the sample.

Compound B: 25% Aqueous ammonia having a mold preventing effect as described in Japanese Patent Application (OPI) No. 135942/85.

Compound C: 5-Chloro-2-methyl-4-isothiazolin-3-one

TABLE 3

| Remark | Test No. | Running | Rate of Replenishment | Sample No. | Compound A | Additive to Water Washing Tank and Stabilizing Tank: Amount of Compound B | Amount of Compound C | Degree of Propagation of Mold | Fading |
|---|---|---|---|---|---|---|---|---|---|
| Comparison | 1 | 1 | 500 | 101 | Present | — | — | (−) | −0.11 |
| " | 2 | | " | 102 | " | — | — | (−) | −0.11 |
| " | 3 | | " | 103 | " | — | — | (−) | −0.12 |
| " | 4 | | " | 104 | Absent | — | — | (+) | −0.10 |
| " | 5 | | " | 105 | " | — | — | (+) | −0.11 |
| " | 6 | | " | 106 | " | — | — | (+) | −0.12 |
| Present Invention | 7 | 2 | 50 | 101 | Present | — | — | (−) | −0.11 |
| " | 8 | | " | 102 | " | — | — | (−) | −0.11 |
| Comparison | 9 | | " | 103 | " | — | — | (++) | −0.13 |
| Present Invention | 10 | | " | 104 | Absent | — | — | (−) | −0.11 |
| " | 11 | | " | 105 | " | — | — | (−) | −0.11 |
| Comparison | 12 | | " | 106 | " | — | — | (+++) | −0.13 |
| Present Invention | 13 | 3 | 15 | 101 | Present | — | — | (−) | −0.11 |
| " | 14 | | " | 102 | " | — | — | (−) | −0.11 |
| Comparison | 15 | | " | 103 | " | — | — | (++) | −0.15 |
| Present Invention | 16 | | " | 104 | Absent | — | — | (+) | −0.11 |
| " | 17 | | " | 105 | " | — | — | (+) | −0.11 |
| Comparison | 18 | | " | 106 | " | — | — | (+++) | −0.15 |
| Present Invention | 19 | 3 | 15 | 101 | Present | 2.0 ml/l | — | (−) | −0.19 |
| " | 20 | | " | 102 | " | " | — | (−) | −0.19 |
| Comparison | 21 | | " | 103 | " | " | — | (++) | −0.23 |
| Present Invention | 22 | | " | 104 | Absent | " | — | (+) | −0.19 |
| " | 23 | | " | 105 | " | " | — | (+) | −0.19 |
| Comparison | 24 | | " | 106 | " | " | — | (+++) | −0.24 |
| Present Invention | 25 | 3 | 15 | 101 | Present | 2.0 ml | 0.01 g/l | (−) | −0.19 |
| " | 26 | | " | 102 | " | " | " | (−) | −0.19 |
| Comparison | 27 | | " | 103 | " | " | " | (++) | −0.22 |
| Present Invention | 28 | | " | 104 | Absent | " | " | (−) | −0.18 |
| " | 29 | | " | 105 | " | " | " | (−) | −0.19 |
| Comparison | 30 | | " | 106 | " | " | " | (+++) | −0.23 |
| Present Invention | 31 | 4 | 15 | 101 | Present | — | — | (−) | −0.11 |
| " | 32 | | " | 102 | " | — | — | (−) | −0.11 |
| Comparison | 33 | | " | 103 | " | — | — | (++) | −0.13 |
| Present Invention | 34 | | " | 104 | Absent | — | — | (−) | −0.11 |
| " | 35 | | " | 105 | " | — | — | (−) | −0.11 |
| Comparison | 36 | | " | 106 | " | — | — | (+++) | −0.14 |
| Present Invention | 37 | 4 | 15 | 101 | Present | — | 0.01 g/l | (−) | −0.11 |
| " | 38 | | " | 102 | " | — | " | (−) | −0.11 |
| Comparison | 39 | | " | 103 | " | — | " | (+) | −0.13 |
| Present Invention | 40 | | " | 104 | Absent | — | " | (−) | −0.11 |
| " | 41 | | " | 105 | " | — | " | (−) | −0.11 |

TABLE 3-continued

| Remark | Test No. | Running | Rate of Replenishment | Sample No. | Compound A | Additive to Water Washing Tank and Stabilizing Tank: Amount of Compound B | Amount of Compound C | Degree of Propagation of Mold | Fading |
|---|---|---|---|---|---|---|---|---|---|
| Comparison | 42 | | " | 106 | " | — | " | (+) | −0.14 |
| Present Invention | 43 | 5 | 5 | 101 | Present | — | — | (−) | −0.13 |
| " | 44 | | " | 102 | " | — | — | (−) | −0.13 |
| Comparison | 45 | | " | 103 | " | — | — | (++) | −0.17 |
| Present Invention | 46 | | " | 104 | Absent | — | — | (+) | −0.13 |
| " | 47 | | " | 105 | " | — | — | (+) | −0.13 |
| Comparison | 48 | | " | 106 | " | — | — | (+++) | −0.18 |

From the results shown in Table 3 above, it can be seen that on Samples 101, 102, 104 and 105 each containing the compound according to the present invention, the propagation of mold is small in comparison with Samples 103 and 106 (comparison) which do not contain a compound according to the present invention. Further, it is seen that the compound according to the present invention does not adversely affect on fading of cyan dye.

The compounds according to the present invention exhibits larger effects in the cases wherein they are employed in combination with 5-chloro-2-methyl-4-isothiazolin-3-one, as illustrated in Test Nos. 25 to 30 and 37 to 42, and with ion-exchanged water as illustrated in Test Nos. 31 to 36.

EXAMPLE 2

Sample 201

On a cellulose triacetate film support provided with a subbing layer were coated layers having the compositions set forth below to prepare a multilayer color light-sensitive material which was designated Sample 201.

The coated amounts of the compositions are indicated in the same manner as shown in Example 1.

| | |
|---|---|
| First Layer: Antihalation Layer | |
| Black colloidal silver | 0.15 (as silver) |
| U-1 | 0.5 |
| U-2 | 0.2 |
| HBS-3 | 0.4 |
| Gelatin | 1.5 |
| Second Layer: Intermediate Layer | |
| C-7 | 0.10 |
| C-3 | 0.11 |
| 2,5-Di-tert-octylhydroquinone | 0.05 |
| HBS-1 | 0.10 |
| Gelatin | 1.50 |
| Third Layer: First Red-Sensitive Emulsion Layer | |
| Mono-dispersed silver iodobromide emulsion (silver iodide: 5 mol %, coefficient of variation: 17%, average particle size: 0.4 μm) | 0.9 (as silver) |
| C-12 | 0.35 |
| C-13 | 0.37 |
| C-3 | 0.12 |
| Compound (30) of the present invention | 0.052 |
| HBS-3 | 0.30 |
| Sensitizing Dye I | $4.5 \times 10^{-4}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Gelatin | 1.50 |
| Fourth Layer: Second Red-Sensitive Emulsion Layer | |
| Mono-dispersed silver iodobromide emulsion (silver iodide: 6 mol %, coefficient of variation 16%, | 1.0 (as silver) |

-continued

| | |
|---|---|
| average particle size: 1.0 μm) | |
| Sensitizing Dye I | $3.0 \times 10^{-4}$ |
| Sensitizing Dye II | $1.0 \times 10^{-5}$ |
| Sensitizing Dye III | $1.5 \times 10^{-4}$ |
| Sensitizing Dye IV | $2.0 \times 10^{-5}$ |
| C-4 | 0.078 |
| C-3 | 0.045 |
| HBS-1 | 0.010 |
| Gelatin | 0.80 |
| Fifth Layer: Intermediate Layer | |
| 2,5-Di-tert-octylhydroquinone | 0.12 |
| HBS-1 | 0.20 |
| Gelatin | 1.0 |
| Sixth Layer: First Green-Sensitive Emulsion Layer | |
| Mono-dispersed silver iodobromide emulsion (silver iodide: 6 mol %, coefficient of variation: 17%, average particle size: 0.4 μm) | 0.5 (as silver) |
| Sensitizing Dye V | $6.0 \times 10^{-5}$ |
| Sensitizing Dye VI | $2.0 \times 10^{-4}$ |
| Sensitizing Dye VII | $4.0 \times 10^{-4}$ |
| C-6 | 0.27 |
| C-1 | 0.072 |
| C-7 | 0.12 |
| C-8 | 0.010 |
| HBS-1 | 0.15 |
| Glatin | 0.70 |
| Seventh Layer: Second Green-Sensitive Emulsion Layer | |
| Tabular silver iodobromide emulsion (silver bromide: 5 mol %, average aspect ratio: 7.5, average diameter based on projected area: 1.8 μm) | 0.80 (as silver) |
| Sensitized Dye V | $4.0 \times 10^{-5}$ |
| Sensitized Dye VI | $1.5 \times 10^{-4}$ |
| Sensitized Dye VII | $3.0 \times 10^{-4}$ |
| C-6 | 0.071 |
| C-1 | 0.021 |
| C-7 | 0.016 |
| HBS-2 | 0.10 |
| Gelatin | 0.91 |
| Eighth Layer: Intermediate Layer | |
| 2,5-Di-tert-octylhydroquinone | 0.05 |
| HBS-2 | 0.10 |
| Gelatin | 0.70 |
| Ninth Layer: Emulsion Layer | |
| Tabular silver iodobromide emulsion (silver iodide: 4 mol %, average aspect ratio: 7.0, average diameter based on projected areas: 1.6 μm) | 0.40 (as silver) |
| Sensitizing Dye X | $5.0 \times 10^{-4}$ |
| C-8 | 0.051 |
| C-14 | 0.095 |
| HBS-1 | 0.15 |
| HBS-2 | 0.15 |
| Gelatin | 0.60 |
| Tenth Layer: Yellow Filter Layer | |
| Yellow colloidal silver | 0.85 (as silver) |
| 2,5-Di-tert-octylhydroquinone | 0.15 |
| HBS-1 | 0.20 |
| Gelatin | 0.80 |

-continued

| | |
|---|---|
| Eleventh Layer: First Blue-Sensitive Emulsion Layer | |
| Tabular silver iodobromide emulsion (silver iodide: 4 mol %, average aspect ratio: 7.3, average diameter based on projected areas: 1.3 μm) | 0.35 (as silver) |
| Sensitizing Dye VIII | $7.0 \times 10^{-4}$ |
| C-9 | 1.10 |
| Compound (73) of the present invention | 0.050 |
| HBS-1 | 0.40 |
| Gelatin | 1.5 |
| Twelfth Layer: Second Blue-Sensitive Emulsion Layer | |
| Tabular silver iodobromide emulsion (silver iodide: 5 mol %, average aspect ratio: 7.2, average diameter based on projected areas: 1.7 μm) | 0.6 (as silver) |
| Sensitizing Dye VIII | $1.5 \times 10^{-4}$ |
| C-9 | 0.31 |
| HBS-1 | 0.12 |
| Gelatin | 0.88 |
| Thirteenth Layer: Intermediate Layer | |
| U-1 | 0.12 |
| U-2 | 0.16 |
| HBS-3 | 0.12 |
| Gelatin | 0.75 |
| Fourteenth Layer: Protective Layer | |
| Silver iodobromide emulsion (silver iodide: 4 mol %, coefficient of variation: 10%, average particle size: 0.08 μm) | 0.15 (as silver) |
| Polymethyl methacrylate particle (diameter: 1.5 μm) | 0. |
| n-Propyl p-hydroxybenzoate | 0.008 |
| S-1 | 0.05 |
| S-2 | 0.15 |
| Gelatin | 0.80 |

A surface active agent and Gelatin Hardener H-1 were added to each of the layers in addition to the above described components.

Sample 202

Sample 202 was prepared in the same manner as described for Sample 201, except using the equimolar amount of Comparative Compound C-10 in place of Compound (30) of the present invention added to the third layer and Compound (73) of the present invention added to the eleventh layer, respectively.

Samples 203 and 204

Sample 203 and 204 were prepared in the same manner as described for Samples 201 and 202, except eliminating n-propyl p-hydroxybenzoate added to the fourteenth layer of Samples 201 and 202, respectively.

Sample 201 of these multilayer color light-sensitive materials was cut into strips of a 35 mm width, used for photographing standard subjects outdoors, and then processed according to the processing steps shown in Table 4 below using the processing solution described below by means of an automatic developing machine.

TABLE 4

| Processing Step | Processing Time | Capacity of Tank | Amount of Replenishment* |
|---|---|---|---|
| Color Development | 3 min 15 sec | 8 l | 45 ml |
| Bleaching | 3 min 00 sec | 8 l | 5 ml |
| Fixing | 4 min 00 sec | 8 l | 33 ml |
| Stabilizing (1) | 30 sec | 4 l ← | — |
| Stabilizing (2) | 30 sec | 4 l ← 4 l | — |
| Stabilizing (3) | 30 sec | 4 l ← 4 l | 40 ml |

*Amount of replenishment per 1 meter of a 35 mm width strip

In the above described processing steps, the stabilizing steps (1), (2) and (3) were carried out using a three-stage countercurrent stabilizing process of (3)→(2)→(1).

The composition of each processing solution is illustrated below.

Color Developing Solution

Same as described in Example 1

| | Tank Solution | Replenisher |
|---|---|---|
| Bleaching Solution: | | |
| Iron (III) Ammonium 1,3-Diamino propanetetraacetate | 120 g | 140 g |
| Disodium Ethylenediamine-tetraacetate | 10 g | 12 g |
| Aqueous Ammonia | 7 ml | 5 ml |
| Ammonium Nitrate | 10 g | 12 g |
| Ammonium Bromide | 160 g | 180 g |
| Water to make | 1 liter | 1 liter |
| pH | 5.8 | 5.6 |
| Fixing Solution: | | |
| Same as described in Example 1. | | |
| Stabilizing Solution: | | |
| Formalin (37% formaldehyde (w,v)) | 0.75 ml | 0.9 ml |
| Polyoxyethylene-p-mono-nonylphenylether (average degree of polymerization = 10) | 0.3 g | 0.45 g |
| 5-Chloro-2-methyl-4-isothiazolin-3-one | 0.010 g | 0.015 g |
| Water to make | 1 liter | 1 liter |

The conditions of the processing conducted are shown in Table 5 below.

TABLE 5

| Running | Amount Taken Over from Preceding Bath (A)* | Amount of Replenishing Water (B)* | Rate of Replenishment (B/A) | Amount of Processing |
|---|---|---|---|---|
| 1 | 2 ml | 200 ml | 500 | 30 m/day × 10 days |
| 2 | 2 ml | 100 ml | 50 | 30 m/day × 10 days |
| 3 | 2 ml | 30 ml | 15 | 30 m/day × 10 days |
| 4 | 2 ml | 10 ml | 5 | 30 m/day × 15 days |
| 5 | 2 ml | 4 ml | 2 | 30 m/day × 20 days |

*Same as described in Table 2 of Example 1.

After conducting the above described running, Samples 201 to 204 which had been exposed wedgewise at color temperature of 4800° K. and 20 CMS were processed.

With Samples 201 to 204 thus-processed, propagation of mold and formation of yellow stain were evaluated. The results obtained are shown in Table 6 below.

Evaluation on Propagation of Mold

Same as described in Example 1

Evaluation on Formation of Yellow Stain

The sample after processing was stored in a thermo-hygrostat at 60° C. and 70% RH for 4 weeks, then increase in the minimum yellow density was measured, whereby the degree of yellow stain was determined.

TABLE 6

| Remark | Test No. | Running | Rate of Replenishment | Sample No. | Compound A | Degree of Propagation of Mold | Yellow Stain |
|---|---|---|---|---|---|---|---|
| Comparison | 1 | 1 | 100 | 201 | Present | (−) | 0.04 |
| " | 2 | | " | 202 | " | (−) | 0.04 |
| " | 3 | | " | 203 | Absent | (−) | 0.04 |
| " | 4 | | " | 204 | " | (−) | 0.04 |
| Present Invention | 5 | 2 | 50 | 201 | Present | (−) | 0.04 |
| Comparison | 6 | | " | 202 | " | (++) | 0.06 |
| Present Invention | 7 | | " | 203 | Absent | (−) | 0.04 |
| Comparison | 8 | | " | 204 | " | (++) | 0.06 |
| Present Invention | 9 | 3 | 10 | 201 | Present | (−) | 0.05 |
| Comparison | 10 | | " | 202 | " | (++) | 0.09 |
| Present Invention | 11 | | " | 203 | Absent | (+) | 0.05 |
| Comparison | 12 | | " | 204 | " | (++) | 0.09 |
| Present Invention | 13 | 4 | 5 | 201 | Present | (−) | 0.06 |
| Comparison | 14 | | " | 202 | " | (++) | 0.13 |
| Present Invention | 15 | | " | 203 | Absent | (+) | 0.06 |
| Comparison | 16 | | " | 204 | " | (+++) | 0.13 |
| Present Invention | 17 | 5 | 2 | 201 | Present | (−) | 0.07 |
| Comparison | 18 | | " | 202 | " | (++) | 0.15 |
| Present Invention | 19 | | " | 203 | Absent | (−) | 0.07 |
| Comparison | 20 | | " | 204 | " | (+++) | 0.15 |

From the results shown in Table 6 above, it is apparent that Samples 201 and 203 each containing the compound according to the present invention exhibit excellent properties of low degree of propagation of mold and small yellow stain at the rate of replenishment ranging from 2 times to 50 times, in comparison with Samples 202 and 204.

EXAMPLE 3

Sample 101 of the multilayer color light-sensitive materials as described in Example 1 was cut into strips of 35 mm width, used for photographing standard subjects outdoors, and then processed according to the processing steps shown in Table 7 below using the processing solution described below by means of an automatic developing machine.

TABLE 7

| Processing Step | Processing Time | Capacity of Tank | Amount of Replenishment* |
|---|---|---|---|
| Color Development | 3 min 15 sec | 8 l | 15 ml |
| Bleach-Fixing | 2 min 30 sec | 8 l | 25 ml |
| Washing with Water (1) | 20 sec | 4 l | — |
| Washing with Water (2) | 20 sec | 4 l | — |
| Washing with Water (3) | 20 sec | 4 l | 10 ml |
| Stabilizing | 20 sec | 4 l | 10 ml |

*Amount of replenishment per 1 meter of a 35 mm width strip.

In the above described processing steps, the washing with water steps (1), (2) and (3) were carried out using a three-stage countercurrent water washing process of from (3) to (2) to (1).

The composition of each processing solution is illustrated below.

| | Tank Solution | Replenisher |
|---|---|---|
| Color Developing Solution: | | |
| Diethylenetriaminepenta-acetic Acid | 1.0 g | 1.2 g |
| 1-Hydroxyethylidene-1,1-diphosphonic Acid | 2.0 g | 2.4 g |
| Sodium Sulfite | 2.0 g | 4.8 g |
| Potassium Carbonate | 35.0 g | 45.0 g |
| Potassium Bromide | 1.6 g | — |
| Potassium Iodide | 2.0 mg | — |
| Hydroxylamine | 2.0 g | 3.6 g |
| 4-(N—Ethyl-N—β-hydroxyethyl-amino)-2-methylaniline Sulfate | 5.0 g | 7.5 g |
| Water to make | 1 liter | 1 liter |
| Adjusted pH with potassium hydroxide to | 10.20 | 10.35 |
| Bleach-fixing Solution: | | |
| Iron (III) Ammonium Ethylene-diaminetetraacetate | 40 g | 45 g |
| Iron (III) Ammonium Diethylene-triaminepentaacetate | 40 g | 40 g |
| Disodium Ethylenediaminetetra-acetate | 10 g | 10 g |
| Sodium Sulfite | 15 g | 20 g |
| Ammonium Thiosulfate (70% w/v aq. soln.) | 240 ml | 270 ml |
| Bleach Accelerating Agent | 0.5 g | 0.8 g |

-continued

| | Tank Solution | Replenisher |
|---|---|---|
| 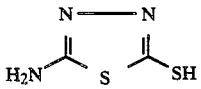 | | |
| Aqueous Ammonia (26%) | 14 ml | 12 ml |
| Water to make | 1 liter | 1 liter |
| pH | 6.7 | 6.5 |

Washing Water

The following three kinds of washing water were employed.

[1] City Water

| | |
|---|---|
| Calcium | 26 mg/l |
| Magnesium | 9 mg/l |
| pH | 7.2 |

[2] Ion Exchanged Water

The above described city water was treated with a Na type strong acidic cation exchange resin manufactured by Mitsubishi Chemical Industries Ltd. to prepare water having the water quality as follows:

| | |
|---|---|
| Calcium | 1.1 mg/l |
| Magnesium | 0.4 mg/l |
| pH | 6.6 |

[3] City Water Containing Chelating Agent

To the above described city water, was added disodium ethylenediaminetetraacetate in an amount of 500 mg per liter.

| | |
|---|---|
| pH | 6.7 |

The conditions of the processings conducted are shown in Table 8 below.

TABLE 8

| Running | Amount Taken Over from Preceding Bath (A) | Amount of Replenishing Water (B) | Rate of Replenishment (B/A) | Type of Washing Water | Amount of Processing |
|---|---|---|---|---|---|
| 1 | 2 ml | 10 ml | 5 | City Water | 30 m/day × 14 days |
| 2 | 2 ml | 10 ml | 5 | Ion Exchanged Water | 30 m/day × 14 days |
| 3 | 2 ml | 10 ml | 5 | City Water Containing Chelating Agent | 30 m/day × 14 days |

After conducting the above described running for 14 days, Samples 101 to 103 which had been exposed wedgewise at color temperature of 4800° K. and 20 CMS were processed.

With Samples 101 to 103 thus processed, fading of cyan dye under preservation at 80° C. for 3 weeks and formation of yellow stain under preservation at 60° C. and 70% RH for 4 weeks were evaluated.

Further, propagation of bacteria and molds in the water washing tank was observed after the above described running for 14 days. The results obtained are shown in Table 9 below.

TABLE 9

| Remark | Test No. | Running | Concentration in Final Water Washing Tank Ca (mg/) | Mg (mg/) | Propagation of Bacteria and Molds in Water Washing Tank | Sample No. | Fading of Cyan Dye | Yellow Stain |
|---|---|---|---|---|---|---|---|---|
| Present Invention | 1 | 1 | 28 | 11 | Some turbidity due to bacteria and generation of molds were observed | 101 | −0.09 | 0.05 |
| " | 2 | | " | " | " | 102 | −0.10 | 0.06 |
| Comparison | 3 | | " | " | " | 103 | −0.15 | 0.08 |
| Present Invention | 4 | 2 | 2.2 | 1.0 | Generation of bacteria and molds was not observed | 101 | −0.07 | 0.03 |
| " | 5 | | " | " | " | 102 | −0.08 | 0.04 |
| Comparison | 6 | | " | " | " | 103 | −0.15 | 0.08 |
| Present Invention | 7 | 3 | 29 | 10 | Generation of bacteria and molds was not observed | 101 | −0.07 | 0.05 |
| " | 8 | | " | " | " | 102 | −0.07 | 0.06 |
| Comparison | 9 | | " | " | " | 103 | −0.15 | 0.09 |

From the results shown in Table 9 above, it can seen that the samples containing the compound according to the present invention provide excellent results with respect to fading of cyan dye and formation of yellow stain in comparison with the comparative sample.

Further, the present invention exhibits larger effects in combination wih using washing water which is subjected to ion exchange treatment or to which a chelating agent is added.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which comprises, after color development of a silver halide color photographic material comprising a support having thereon at least one light-sensitive silver halide emulsion layer and at least one compound capable of releasing, after reaction with an oxidation produce of a developing agent, a development inhibitor upon a reaction with another molecule of an oxidation produce of a developing agent, treating said photographic material with a liquid having a fixing ability, and thereafter washing or stabilizing said photographic material while replenishing the washing water and stabilizing solution, respectively, each in an amount of from 2 to 50 times the amount carried over from the preceding bath per unit area of the silver halide color photographic material, wherein the silver halide color photographic material contains a p-hydroxybenzoic acid ester represented by formula (PHB)

(PHB)

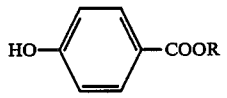

wherein R represents an alkyl group, a substituted alkyl group, an aralkyl group, or a substituted aralkyl group each having from 1 to 18 carbon atoms in total.

2. A method for processing a silver halide color photographic material as in claim 1, wherein the compound capable of releasing, after reaction with an oxidation product of a developing agent, a development inhibitor upon a reaction with another molecule of an oxidation product of a developing agent is a compound represented by formula (I)

$$A—PDI \quad (I)$$

wherein A represents a group capable of releasing PDI upon reaction with an oxidation product of a developing agent; and PDI represents a group which forms a development inhibitor through a reaction with an oxidation product of a developing agent after being released from A.

3. A method for processing a silver halide color photographic material as in claim 1, wherein the compound represented by formula (I) is a compound represented by formula (II)

$$A—(L_1)_v—B—(L_2)_w—DI \quad (II)$$

wherein A represents a group capable of relasing $(L_1)_v$—B—$(L_2)_w$—DI upon a reaction with an oxidation product of a developing agent; $L_1$ represents a group capable of releasing B—$(L_2)_w$—DI after being released from A; B represents a group capable of releasing $(L_2)_w$—DI upon reaction with an oxidation product of a developing agent after being released from A—$(L_1)_v$; $L_2$ represents a group capable of releasing DI after being released from B; DI represents a development inhibitor; and v and w each represents 0 or 1.

4. A method for processing a silver halide color photographic material as in claim 3, wherein the group represented by A represents a coupler residual or an oxidation reduction group.

5. A method for processing a silver halide color photographic material as in claim 4, wherein the coupler residual group represented by A is a yellow coupler residual group, a magenta coupler residual group, a cyan coupler residual group, or a non-color forming coupler residual group.

6. A method for processing a silver halide color photographic material as in claim 4, wherein the coupler residual group represented by A is selected from the group consisting of an open-chain ketomethylene type coupler residual group, a 5-pyrazolone type coupler residual group, a pyrazoloimidazole type coupler residual group, a pyrazolotriazole type coupler residual group, a phenol type coupler residual group, a naphthol type coupler residual group, an indanone type coupler residual group, and an acetophenone type coupler residual group.

7. A method for processing a silver halide color photographic material as in claim 4, wherein the oxidation reduction group represented by A is a group represented by formula (III)

$$A_1—P—(X{=}Y)_n—Q—A_2 \quad (III)$$

wherein P and Q each represents an oxygen atom or a substituted or unsubstituted imino group; at least one of n, X and Y represents a methine group having a group of —$(L_1)_v$—B—$(L_2)_w$—DI as a substituent, and the other X and Y each represents a substituted or unsubstituted methine group or a nitrogen atom; n represents an integer from 1 to 3, wherein the X and Y groups may be the same or different; $A_1$ and $A_2$ each represents a hydrogen atom or a group capable of being eliminated with an alkali; or any two substituents of P, X, Y, Q, $A_1$, and $A_2$ represent divalent groups and connect together to form a cyclic structure.

8. A method for processing a silver halide color photographic material as in claim 7, wherein the cyclic structure formed by $(X{=}Y)_n$ is a benzene ring or a pyridine ring.

9. A method for processing a silver halide color photographic material as in claim 3, wherein the group represented by formula $L_1$ or $L_2$ is a group represented by formula (T-1)

(T-1)

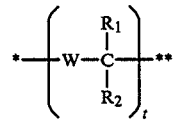

wherein the bond indicated by * denotes the position at which the group is connected to the left side group in formula (II); the bond indicated by ** denotes the position at which the group is connected to the right side group in formula (II), W represents an oxygen atom, a sulfur atom, or a group of

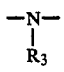

wherein $R_3$ represents an organic substituent; $R_1$ and $R_2$ each represents a hydrogen atom, an alkyl group, an aryl group, a heterocyclic group, an acyl group a sulfonyl group, t represents 1 or 2, and when t represents 2, the two $R_1$ groups and two $R_2$ groups may be the same or different; or any two of $R_1$, $R_2$, and R together form a cyclic structure.

10. A method for processing a silver halide color photographic material as in claim 3, wherein the group represented by formula $L_1$ or $L_2$ is a group represented by formula (T-2)

$$*\text{—Nu—Link—E—}^{**} \quad \text{(T-2)}$$

wherein the bond indicated by * denotes the position at which the group is connected to the left side group in formula (II); the bond indicated by  denotes the position at which the group is connected to the right side group in formula (II); Nu represents a nucleophilic group; E represents an electrophilic group which is able to cleave the bond indicated by  upon a nucleophilic attack of Nu; and Link represents a linking group which connects Nu with E in a stereochemical position capable of causing an intramolecular nucleophilic displacement reaction between Nu and E.

11. A method for processing a silver halide color photographic material as in claim 3, wherein the group represented by formula $L_1$ or $L_2$ is a group represented by formula (T-3)

$$*\text{—O}\left(\underset{R_1}{\underset{|}{C}}=\underset{R_2}{\underset{|}{C}}\right)_t CH_2\text{—}^{**} \quad \text{(T-3)}$$

wherein the bond indicated by * denotes the position at which the group is connected to the left side group in formula (II); the bond indicated by ** denotes the position at which the group is connected to the right side group in formula (II); and $R_1$ and $R_2$ each represents a hydrogen atom or a substituent; t represents 1 or 2, and when t represents 2, the two $R_1$ groups and the two $R_2$ groups may be the same or different; or $R_1$ and $R_2$ may be connected to each other to form a cyclic structure.

12. A method for processing a siliver halide color photographic material as in claim 3, wherein each of the groups represented by $L_1$ and $L_2$ is $$*\text{—O—}\overset{\overset{\text{O}}{\|}}{C}\text{—}^{**} \text{ or } *\text{—S—}\overset{\overset{\text{S}}{\|}}{C}\text{—}^{**}$$

wherein the bond indicated by * denotes the position at which the group is connected to the left side group in formula (II); and the bond indicated by ** denotes the position at which the group is connected to the right side group in formula (II).

13. A method for processing a silver halide color photographic material as in claim 3, wherein the group represented by B is a group capable of forming a coupler after being released from $A\text{-}(L_1)_v$ or a group capable of forming an oxidation reduction group after being released from $A\text{-}(L_1)_v$.

14. A method for forming a silver halide color photographic material as in claim 13, wherein the group capable of forming a coupler is selected from the group consisting of a group which is formed by eliminating a hydrogen atom from a hydroxy group of a phenol type coupler and is connected to $A\text{-}(L_1)_v$ at the oxygen atom of the hydroxy group, and a group which is formed by eliminating a hydrogen atom from a hydroxyl group of a 5-hydroxypyrazole which is a tautomer of a 5-pyrazolone type coupler and is connected to $A\text{-}(L_1)_v$ at the oxygen atom of the hydroxyl group.

15. A method for processing a silver halide color photographic material as in claim 13, wherein the group capable of forming an oxidation reduction group is a group represented by formula (B-1)

$$*\text{—P—}(X'=Y')_n\text{—Q—}A_2 \quad \text{(B-1)}$$

wherein the bond indicated by * denotes the position at which the group is connected to $A\text{-}(L_1)_v$; $A_2$, P, Q and n each has the same meaning as defined in the general formula (III); at least one of the X' and Y' groups represents a methine group having a group of $(L_2)_w$—DI as a substituent, and the other X' and Y' groups each represents a substituted or unsubstituted methine group or a nitrogen atom; or any two substituents of $A_1$, P, Q, X' and Y' represent divalent groups connected together to form a cyclic structure.

16. A method for processing a silver halide color photographic material as in claim 3, wherein the group represented by DI is selected from the group consisting of a tetrazolylthio group, a benzimidazolylthio group, a benzothiazolylthio group, a benzoxazolylthio group, a benzotriazolyl group, a benzindazolyl group, a triazolylthio group, an imidazolylthio group, a thiadiazolylthio group, a thioether-substituted triazolyl group and an oxadiazolyl group, each of which may be substituted.

17. A method for processing a silver halide color photographic material as in claim 16, wherein a substituent for the group is selected from the group consisting of a halogen atom, an aliphatic group, a nitro group, an acylamino group, an aliphatic oxycarbonyl group, an aromatic oxycarbonyl group, an imido group, a sulfonamido group, an aliphatic oxy group, an aromatic oxy group, an amino group, an imino group, a cyano group, an aromatic group, an acyloxy group, a sulfonyloxy group, an aliphatic thio group, an aromatic thio group, an aromatic oxysulfonyl group, an aliphatic oxysulfonyl group, an aliphatic oxycarbonylamino group, an aromatic oxycarbonylamino group, an aliphatic oxycarbonyloxy group, a heterocyclic oxycarbonyl group, a heterocyclic oxy group, a sulfonyl group, an acyl group, a ureido group, a heterocyclic group, and a hydroxy group.

18. A method for processing a silver halide color photographic material as in claim 3, wherein the compound represented by formula (II) is a polymer derived from a monomer compound represented formula (P-1) having a recurring unit represented by formula (P-2)

$$CH_2=\overset{\overset{R}{|}}{C}\left(A_2\right)_l\left(A_3\right)_j\left(A_1\right)_k Q \quad \text{(P-1)}$$

$$\left(CH_2-\underset{\underset{(A_2)_l(A_3)_j(A_1)_k Q}{|}}{\overset{\overset{R}{|}}{C}}\right) \quad \text{(P-2)}$$

wherein R represents a hydrogen atom, a lower alkyl group having from 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —S—, —NH— or —O—; $A_2$ represents —CONH— or —COO—; $A_3$ represents a substituted or unsubstituted alkylene group having from 1 to 10 carbon atoms, a substituted or unsubstituted aralkylene group, or a substituted or unsubstituted arylene group; Q represents a group of the compound represented by formula (II); and i, j, and k each represents 0 or 1, provided that i, j, and k are not simultaneously O: or is a copolymer of the above described monomer compound (P-2) and at least one non-color-forming monomer containing at least one ethylene group which does not have an ability of coupling with an oxidation product of an aromatic primary amine developing agent.

19. A method for processing a silver halide color photographic material as in claim 18, wherein the non-color forming ethylenic monomer is selected from the group consisting of an acrylic acid, an ester derived from an acrylic acid, an amide derived from an acrylic acid, methylenebisacrylamide, a vinyl ester, an acrylonitrile, an aromatic vinyl compound, a maleic acid derivative, and a vinylpyridine.

20. A method for processing a silver halide color photographic material as in claim 3, wherein A represents a coupler residual group represented by formula (Cp-1), (Cp-2), (Cp-3), (Cp-4), (Cp-5), (Cp-6), (Cp-7), (Cp-8) or (Cp-9)

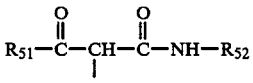
(Cp-1)

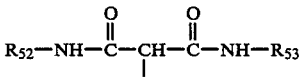
(Cp-2)

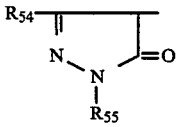
(Cp-3)

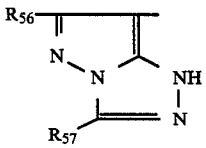
(Cp-4)

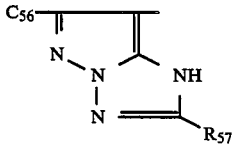
(Cp-5)

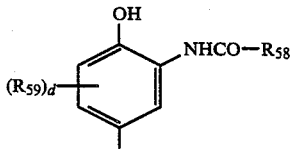
(Cp-6)

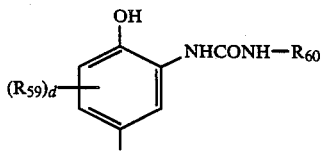
(Cp-7)

-continued

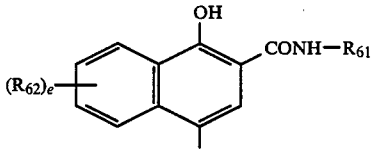
(Cp-8)

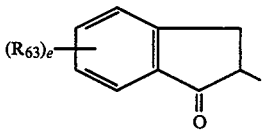
(Cp-9)

wherein $R_{41}$ represents an aliphatic group, an aromatic group, or a heterocyclic group; $R_{42}$ represents an aromatic group or a heterocyclic group; and $R_{43}$, $R_{44}$, and $R_{45}$ each represents a hydrogen atom, an aliphatic group, an aromatic group, or a heterocyclic group;

$R_{51}$ represents a group as defined for $R_{41}$;

$R_{52}$ and $R_{53}$ each represents a group as defined for $R_{42}$;

$R_{54}$ represents a group as defined for $R_{41}$, $R_{41}-\underset{\underset{R_{43}}{|}}{CON}-$, $R_{41}-\underset{\underset{R_{43}}{|}}{N}-$, $R_{41}-SO_2\underset{\underset{R_{43}}{|}}{N}-$, $R_{41}-S-$, $R_{43}-O-$, $R_{45}-\underset{\underset{R_{43}}{|}}{N}\underset{\underset{R_{44}}{|}}{CON}-$. $R_{41}-OOC-$, $R_{44}-\underset{\underset{R_{43}}{|}}{N}CO-$, or $N\equiv C-$;

$R_{55}$ represents a group as defined for $R_{41}$;

$R_{56}$ and $R_{57}$ each represents a group as defined for $R_{43}$, $R_{41}-S-$, $R_{43}-O-$, $R_{41}-\underset{\underset{R_{43}}{|}}{CON}-$, $R_{41}-\underset{\underset{R_{43}}{|}}{N}-$, $R_{43}-\underset{\underset{R_{44}}{|}}{N}\underset{\underset{R_{45}}{|}}{CON}-$, or $R_{41}-SO_2\underset{\underset{R_{43}}{|}}{N}-$;

$R_{58}$ represents a group as defined for $R_{41}$;

$R_{59}$ represents a group as defined for $R_{41}$;

$R_{41}-\underset{\underset{R_{43}}{|}}{CON}-$, $R_{41}-O\underset{\underset{R_{43}}{|}}{CON}-$, $R_{41}-SO_2\underset{\underset{R_{43}}{|}}{N}-$, $R_{43}-\underset{\underset{R_{44}}{|}}{N}\underset{\underset{R_{45}}{|}}{CON}-$, $R_{43}-\underset{\underset{R_{44}}{|}}{N}\underset{\underset{R_{45}}{|}}{SO_2N}-$, $R_{41}-O-$, $R_{41}-S-$, a halogen atom, or $R_{41}-\underset{\underset{R_{43}}{|}}{N}-$;

d represents an integer from 0 to 3, and when d represents 2 or more, the two or more $R_{59}$ groups are the same or different, or two $R_{59}$ groups each represents a divalent group connected together to form a cyclic structure;

$R_{60}$ represents a group as defined for $R_{41}$;

$R_{61}$ represents a group as defined for $R_{41}$;

$R_{62}$ represents a group as defined for $R_{41}$, $R_{41}-CONH-$, $R_{41}-OCONH-$, $R_{41}-SO_2NH-$, -continued $R_{43}-\underset{\underset{R_{44}}{|}}{N}C\underset{\underset{R_{45}}{|}}{N}-$, $R_{43}-\underset{\underset{R_{44}}{|}}{N}SO_2\underset{\underset{R_{45}}{|}}{N}-$, $R_{43}-O-$, $R_{41}-S-$, a halogen atom, or $R_{41}-N-$;

$R_{63}$ represents a group as defined for $R_{41}$, $R_{43}-C\underset{\underset{R_{44}}{|}}{N}-$, $R_{43}-\underset{\underset{R_{44}}{|}}{N}CO-$, $R_{41}-SO_2\underset{\underset{R_{44}}{|}}{N}-$, $R_{43}-\underset{\underset{R_{44}}{|}}{N}SO_2-$, a halogen atom, a nitro group, a cyano group, or $R_{43}-CO-$;

e represents an integer from 0 to 4, and when e represents 2 or more, the $R_{62}$ and $R_{63}$ groups may be the same or different.

21. A method for processing a silver halide color photographic material as in claim 7, wherein P and Q each represents a substituted or unsubstituted imino group.

22. A method for processing a silver halide color photographic material as in claim 7, wherein P and Q each represents an imino group substituted with a sulfonyl group or an acyl group.

23. A method for processing a silver halide color photographic material as in claim 22, wherein P and Q each represents a group represented by formula (N-1) or (N-2)

(PHB)

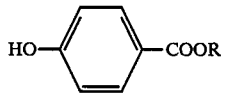

wherein the bond indicated by * denotes the position at which the group is connected to $A_1$ and $A_2$, respectively; the bond indicated by ** denotes the position at which the group is connected to one of the free bonds of $-(X{=}Y)_n-$;, and G represents an aliphatic group containing from 1 to 32 carbon atoms, an aromatic group containing from 6 to 10 carbon atoms, or a 4-membered, 5-membered, 6-membered or 7-membered heterocyclic group containing as a hetero atom a nitrogen atom, a sulfur atom, or an oxygen atom.

24. A method for processing a silver halide color photographic material as in claim 7, wherein P represents an oxygen atom and $A_2$ represents a hydrogen atom.

25. A method for processing a silver halide color photographic material as in claim 7, wherein X and Y each represents a substituted or unsubstituted methine group, provided that at least one of X or Y represents a methine group having a group of $-(L_1)_v-B-(L_2)_w-DI$ as a substituent.

26. A method for processing a silver halide color photographic material as in claim 7, wherein the group represented by formula (III) is a group represented by formula (IV) or (V)

(IV)

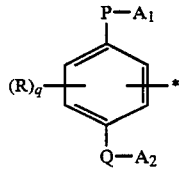

(V)

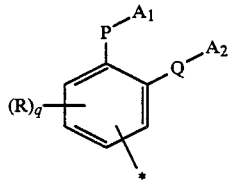

wherein the bond indicated by * denotes the position at which the group is connected to $-(L_1)_v-B-(L_2)_w-DI$; P, Q, $A_1$, and $A_2$ each has the same meaning as defined for formula (III); R represents a substituent; q represents an integer of 0, 1, 2, or 3; and when q represents 2 or 3, the R groups may be the same of different, or two R groups represent substituents positioned on adjacent two carbon atoms, that are divalent groups connected together to form a cyclic structure.

27. A method for processing a silver halide color photographic material as in claim 26, wherein the substituent represented by R is selected from an aliphatic group, an aromatic group, a halogen atom, an alkoxy group, an alkylthio group, an aryloxy group, an arylthio group, a carbamoyl group, an alkoxycarbonyl group, an aryloxycarbonyl group, a sulfonyl group, a sulfamoyl group, an acylamino group, a sulfonamido group, an acyl group, an nitroso group, an acyloxy group, a ureido group, a nitro group, a cyano group, a heterocyclic group, a hydroxy group, a carboxy group, an alkoxycarbonylamino group, a sulfo group, an amino group, an arylamino group, an aliphatic amino group, a sulfinyl group, a sulfamoylamino group, a thioacyl group, a thioureido group, a heterocyclic thio group, an imido group, and a heterocyclic amino group.

28. A method for processing a silver halide color photographic material as in claim 15, wherein P represents an oxygen atom and Q represents an oxygen atom or one of the groups $-\underset{\underset{SO_2-G}{|}}{N}-$ and $*-\underset{\underset{CO-G}{|}}{N}-**$ wherein the bond indicated by * denotes the position at which the group is connected to $-(X'{=}Y')_n-$; the bond indicated by ** denotes the position at which the group is connected to $A_2$; and G represents an aliphatic group containing from 1 to 32 carbon atoms, an aromatic group containing from 6 to 10 carbon atoms, or a 4-membered, 5-membered, 6-membered, or 7-membered heterocyclic group containing as a hetero atom a nitrogen atom, a sulfur atom, or a oxygen atom.

29. A method for processing a silver halide color photographic material as in claim 3, wherein the group represented by B represents a group represented by formula (B-2) or (B-3)

(B-2)

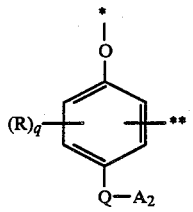

(B-3)

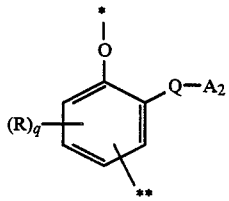

wherein the bond indicated by * denotes the position at which the group is connected to A—$(L_1)_v$—; the bond indicated by ** denotes the position at which the group is connected to —$(L_2)_w$—DI; and R. q, Q and $A_2$ each has the same meaning as defined for formula (IV) or (V).

30. A method for processing a silver halide color photographic material as in claim 29, wherein the substituent represented by R is selected from the group consisting of an aliphatic group, an alkoxy group, an alkylthio group, an alkoxycarbonyl group, an aryloxycarbonyl group, a carbamoyl group, a sulfonamido group, an acylamino group, a heterocyclic thio group, a hydroxy group, and an aromatic group.

31. A method for processing a silver halide color photographic material as in claim 3, wherein each of v and w is 0.

32. A method for processing a silver halide color photographic material as in claim 3, wherein the group represented by A is a coupler residue.

33. A method for processing a silver halide color photographic material as in claim 3, wherein the development inhibitor represented by DI is a development inhibitor which is a compound having a development inhibiting function when being released as DI and capable of being decomposed or changed into a compound having substantially no effect on photographic properties after being discharged into a color developing solution.

34. A method for processing a silver halide color photographic material as in claim 33, wherein the development inhibitor represented by DI is a group represented by formula (D-1), (D-2), (D-3), (D-4), (D-5), (D-6), (D-7), (D-8), (D-9), (D-10), or (D-11)

(D-1)

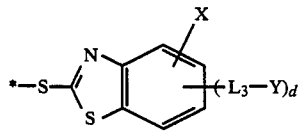

(D-2)

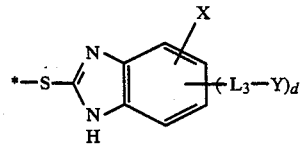

-continued (D-3)

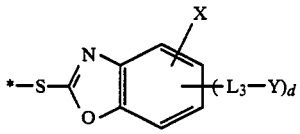

(D-4)

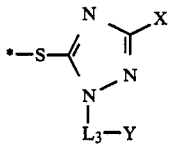

(D-5)

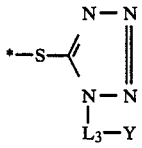

(D-6)

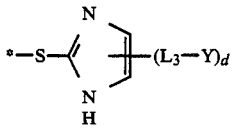

(D-7)

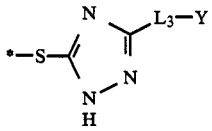

(D-8)

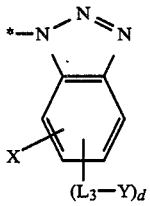

(D-9)

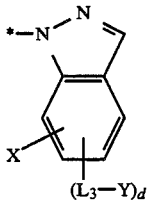

(D-10)

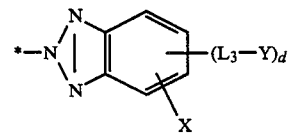

(D-11)

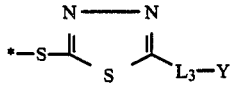

wherein the bond indicated by * denotes the position at which the group is connected to A—$(L_1)_v$—B—$(L_2)_w$—; X represents a hydrogen atom or a substituent; d represents 1 or 2; $L_3$ represents a group containing a chemical bond which is capable of being cleaved in a developing solution; and Y represents a substituent capable of generating the development inhibiting function and is selected from an aliphatic group, an aromatic group, or a heterocyclic group.

35. A method for processing a silver halide color photographic material as in calim 34, wherein the substituent represented by R is selected from the group consisting an aliphatic group, an acylamino group, an alkoxy group, a halogen atom, a nitro group, and a sulfonamido group.

36. A method for processing a silver halide color photographic material as in claim 34, wherein the chemical bond included in $L_3$ is selected from the group consisting $$-COO-,\ NHCOO-,\ -SO_2O-,\ -OCH_2CH_2SO_2-,$$

$$-\underset{\underset{O}{\|}}{OC}O-,\ \text{and}\ -\underset{\underset{O}{\|}}{NHC}\underset{\underset{O}{\|}}{C}O-.$$

37. A method for processing a silver halide color photographic material as in claim 1, wherein water employed in the washing water or stabilizing solution is water that has been subjected to a water softening treatment.

38. A method for processing a silver halide coloe photographic material as in claim 1, wherein each concentration of calcium ions and magnesium ions in the final tank of the water washing step or stabilizing step is not more than 5 mg per liter of the washing water or the stabilizing solution.

39. A method for processing a silver halide color photographic material as in claim 1, whrerin the washing water or stabilizing solution contains a chelating agent selected from the group consisting of an aminocarboxylic acid, an aminophosphonic acid, a phosphonic acid, a phosphonocarboxylic acid, and a salt thereof.

40. A method for processing a silver halide color photographic material as in claim 1, wherein the washing water or stabilizing solution contains an isothiazoline type antibiotic.

41. A method for processing a silver halide color photographic material as in claim 1, wherein the water washing step or stabilizing step is carried out according to a multistage countercurrent process using two or more tanks.

42. A method for processing a silver halide color photographic material as in claim 1, wherein the stabilizing bath contain an aldehyde compound.

43. A method for processing a silver halide color photographic material as in claim 1, wherein the silver halide color photographic material comprises at least one red-sensitive silver halide emulsion layer containing at least one cyan color forming coupler, at least one green-sensitive silver halide emulsion layer containing at least one magenta color forming coupler and at least one blue-sensitive silver halide emulsion layer containing at least one yellow color forming coupler.

44. A method for processing a silver halide color photographic material as in claim 1, wherein the solution having a sixing ability is a bleach-fixing solution.

45. A method for processing a silver halide color photographic material as in claim 38, wherein the washing water or stabilizing solution contains a chelating agent selected from the group consisting of an aminocarboxylic acid, an aminophosphonic acid, a phosphonic acid, a phosphonocarboxylic acid, and a salt thereof.

46. A method for processing a silver halide color photographic material as in claim 40, wherein the washing water or stabilizing solution contains a chelating agent selected from the group consisting of an aminocarboxylic acid, an aminophosphonic acid, a phosphonic acid, a phosphonocarboxylic acid, and a salt thereof.

47. A method for processing a silver halide color photographic material as in calim 40, wherein the washing water or stabilizing solution contains an isothiazoline type antibiotic.

48. A method for processing a silver halide color photographic material as in claim 1, wherein the silver halide color photographic material contains a p-hydroxybenzoic acid ester represented by formula (PHB)

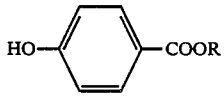

(PHB)

wherein R represents a methyl group, an ethyl group, an n-propyl group or an n-butyl group.

49. A method for processing a silver halide color photographic material as in claim 2, wherein the compound represented by formula (I) is incorporated into a light-sensitive silver halide emulsion layer or an adjacent layer thereto of the color light-sensitive material.

50. A method for processing a silver halide color photographic material as in claim 2, wherein an amount of the compound represented by formula (I) is added in a range from $3\times10^{-6}$ to $1\times10^{-3}$ mol/m$^2$.

51. A method for processing a silver halide color photographic material as in claim 40, wherein the amount of the compound represented by formula (I) is added in a range from $3\times10^{-6}$ to $5\times10^{-4}$ mol/m$^2$.

52. A method for processing a silver halide color photographic material as in claim 51, wherein the amount of the compound represented by formula (I) is added in a range from $1\times10^{-5}$ to $2\times10^{-4}$ mol/m$^2$.

* * * * *